US005464474A

United States Patent [19]

Nishimoto et al.

[11] Patent Number: 5,464,474

[45] Date of Patent: Nov. 7, 1995

[54] APPARATUS FOR CLEANING STRIPS BEFORE PRESS FORMING, HAVING DE-OILING ROLLS AND TACKY ROLLS TO REMOVE OIL AND FOREIGN MATTERS

[75] Inventors: Yutaka Nishimoto; Kimikazu Ikemoto, both of Toyota; Yuji Niimi, Nishikamo; Akio Asai, Aichi, all of Japan

[73] Assignee: Toyota Jidosha Kabushiki Kaisha, Toyota, Japan

[21] Appl. No.: 99,658

[22] Filed: Jul. 30, 1993

[30] Foreign Application Priority Data

Jul. 31, 1992 [JP] Japan ..... 4-225327
Jun. 29, 1993 [JP] Japan ..... 5-186619

[51] Int. Cl.[6] ..... B08B 1/02; B21C 47/34

[52] U.S. Cl. ..... 118/676; 118/695; 118/681; 118/686; 118/104; 118/72; 15/102; 15/104.002

[58] Field of Search ..... 118/695, 676, 118/681, 704, 686, 63, 64, 66, 104, 114, 121, 72; 15/3, 102, 104.002

[56] References Cited

U.S. PATENT DOCUMENTS 3,822,642 7/1974 Grindeland ..... 118/104
4,369,732 1/1983 Jackson et al. ..... 118/681
4,530,306 7/1985 Hovekamp ..... 118/681
4,705,388 11/1987 Huntjens et al. ..... 108/104
4,982,469 1/1991 Nishiwaki ..... 15/104.002
5,060,342 10/1991 Brazier ..... 15/322

FOREIGN PATENT DOCUMENTS 50-22836 3/1975 Japan .
62-5877 1/1987 Japan .

*Primary Examiner*—Robert J. Warden
*Assistant Examiner*—Hien Tran
*Attorney, Agent, or Firm*—Cushman Darby & Cushman

[57] ABSTRACT

A cleaning apparatus for removing foreign matters from workpieces in the form of strips or sheets cut from a larger blank, before the workpiece is subjected to a press forming operation, which apparatus includes a feeding device for feeding the successive workpieces, de-oiling rolls disposed in an upstream portion of a feed path of the workpieces as seen in a feeding direction and rotated in pressing rolling contact with the surfaces of each workpiece as each workpiece is fed, so as to remove by absorption oily substances from the surfaces of the workpiece, and tacky rolls disposed downstream of the de-oiling rolls as seen in the feeding direction and rotated in pressing rolling contact with the surfaces of the workpiece, so as to remove by tackiness thereof the foreign matters from the surfaces of the workpiece.

10 Claims, 43 Drawing Sheets

FIG. 13

DATA INPUT

PART No. 77

USE THE SWITCHES "△" AND "▽" TO ENTER VALUES.

UPPER LIMIT: 2 SEC.
LOWER LIMIT: 1 SEC.
ENTERED VALUE: 0 SEC.

| ITEMS TO BE SET | | CURRENT VALUES | SET VALUES |
|---|---|---|---|
| NOZZLES 21,31 | 1ST ON | 1.200 | 1.200 |
| | OFF | 1.200 | 1.200 |
| | 2ND ON | 1.200 | 1.200 |
| NOZZLES 22,32 | 1ST ON | 1.200 | 1.200 |
| | OFF | 1.200 | 1.200 |
| | 2ND ON | 1.200 | 1.200 |
| NOZZLES 23,33 | 1ST ON | 1.200 | 1.200 |
| | OFF | 1.200 | 1.200 |
| | 2ND ON | 1.200 | 1.200 |
| NOZZLES 24,34 | 1ST ON | 1.200 | 1.200 |
| | OFF | 1.200 | 1.200 |
| | 2ND ON | 1.200 | 1.200 |
| NOZZLES 25,35 | 1ST ON | 1.200 | 1.200 |
| | OFF | 1.200 | 1.200 |
| | 2ND ON | 1.200 | 1.200 |

7 8 9
4 5 6
1 2 3
0 · ±
▽ △
CLEAR WRITE
SET CURRENT VALUE

MENU SELECTION
ALARM
SYNCHRO OP.
AUTO. SETUP
MANUAL OP.
MANUAL SETUP
ADJUSTMENT
SELECTION
DATA DISPLAY
DATA WRITING

APPARATUS FOR CLEANING STRIPS BEFORE PRESS FORMING, HAVING DE-OILING ROLLS AND TACKY ROLLS TO REMOVE OIL AND FOREIGN MATTERS

BACKGROUND OF THE INVENTION

1. Field of the Invention

The present invention relates to an apparatus for cleaning a workpiece in the form of strips or sheets to be press-formed, to remove foreign matters from the workpiece prior to a press forming operation thereon.

2. Discussion of the Prior Art

Before a press forming operation is performed on a workpiece in a strip or sheet form prepared by cutting of a larger stock to desired size and shape, it is necessary to remove foreign matters such as dust and dirt, and particles produced by the cutting of the stock, which matters are deposited on or adhere to the surfaces of the workpiece. Otherwise, the foreign matters would mar or damage the workpiece during the pressing operation or cause defects on the product obtained from the workpiece. Usually, the stock to be cut into the workpiece strips or sheets is supplied or coated with a lubricant and/or an anti-rust oil during the cutting operation, and particles produced by the cutting operation and/or dust and dirt suspended in the ambient air are likely to adhere to the prepared strips or sheets. Therefore, the workpiece strips or sheets carrying such foreign matters are loaded onto a pressing machine or system. A cleaning apparatus to remove the foreign matters from successive workpiece strips or sheets should be adapted to clean the workpieces in synchronization with pressing cycles on the cleaned workpieces. In view of this requirement, there is widely used a cleaning apparatus of the type which uses brush rolls to brush the surfaces of the workpieces with a washing oil applied thereto while the workpiece strips or sheets are fed toward the pressing system. An example of such type of cleaning apparatus is disclosed in Publication No. 62-5877 of unexamined Japanese Utility Model Application.

Referring to FIG. 44, there will be described a known cleaning apparatus of the type as described above. This cleaning apparatus, which is indicated generally at 200 in this figure, is equipped with a belt feeder 202 which is adapted to feed workpiece strips 204 one after another, in the rightward direction as seen in FIG. 44. The cleaning apparatus 200 has a housing 206 with opposite end walls having an inlet and an outlet formed therethrough. The strips 204 enter and leave the housing 206 through these inlet and outlet, respectively. Within the housing 206, there are provided a pair of pinch rolls 208, a pair of brush rolls 210, a first pair of de-oiling rolls 212 and a second pair of de-oiling rolls 214, such that these pairs are arranged from the inlet toward the outlet in the order of description and such that the rolls of each pair are disposed one above the other. Strip guides 216 are provided between the adjacent pairs of rolls and at the inlet and outlet at the opposite ends of the housing 206.

The lower pinch roll 208 and de-oiling rolls 212, 214 are rotated clockwise at the same speed by a common drive motor (not shown), while the upper pinch roll 208 and de-oiling rolls 212, 214 are pressed against the lower rolls 208, 212, 214 by respective pneumatic cylinders (not shown), so that the strips 204 are fed in the rightward direction through the nips of the lower and upper rolls 208, 212, 214. The strips 204 leaving the outlet of the housing

206 are fed onto a loading station 218 of a pressing system in which the strips 204 are subjected to a predetermined pressing operation. The pair of brush rolls 210 are provided to brush and wash the upper and lower surfaces of each strip 204. Each brush roll 210 has a brush made of nylon, for example, on its circumference, which is forced onto the strip 204. The brush rolls 210 are rotated by a common motor (not shown) in a direction opposite to the feeding direction of the strip 204.

On the upstream and downstream sides of the pair of brush rolls 210, there are disposed a plurality of nozzles connected to a hydraulic circuit 220 for delivering a washing oil. The hydraulic circuit 220 has a clean oil reservoir 222 which stores the filtered washing oil, and a feeding pump 224 for pumping up the washing oil from the reservoir 222 and supplying the oil to the nozzles indicated above. The amount of delivery of the oil from the nozzles is adjustable by a regulating valve 226, while the flow rate of the oil is indicated by a flow meter 228. The operation of the feeding pump 224 is controlled on the basis of a moment at which each strip 204 is detected by a photoelectric tube 230 disposed on the belt feeder 202, so that the washing oil is supplied to the nozzles as long as the strip 204 is passing the nip of the brush rolls 210. The cleaning oil delivered from the nozzles is returned to a contaminated oil reservoir 234 through the bottom of the housing 206 and a filter 232. The washing oil overflowing the reservoir 234 is stored in an intermediate reservoir 236 and fed to a filtering device 240 by a filtering pump 238. The washing oil filtered by the filtering device 240 is supplied back to the clean oil reservoir 222 indicated above. The oil which overflows the clean oil reservoir 222 is stored in the intermediate reservoir 236.

A large amount of the washing oil remaining on the strip 204 after the washing of the strip 204 by the brush rolls 210 would cause an inadequate amount of tension on the strip 204 during a drawing operation on the strip 204 in the pressing system, whereby a product formed from the strip 204 would have a defect. To avoid this problem, the washing oil remaining on the brush-washed strip 204 is removed from the strip 204 by the de-oiling rolls 212, 214. These de-oiling rolls 212, 214 whose radially outer portion is made of an unwoven fabric and rotated in pressing contact with the surfaces of the strip 204, so that the residual washing oil is absorbed by the unwoven fabric of the rolls 212, 214.

However, the conventional method of washing the strips to remove the foreign matters by the brush rolls with a washing oil does not assure a sufficient cleaning effect when the feeding speed of the strip is relatively high. Further, the foreign matters such as dirt tend to easily adhere to the oil films covering the washed surfaces of the strips. There is also a risk that the foreign matters transferred to the brush rolls may be transferred back to the strips under washing. Although an increase in the amount of delivery of the washing oil would improve the washing effect, this solution would result in a failure of the de-oiling rolls to sufficiently remove the washing oil remaining on the strips. Thus, the amount of delivery of the washing oil has an upper limit.

Moreover, the conventional washing method deteriorates the operating environment due to scattering of the washing oil. In addition, the conventional method requires a considerably large reservoir and a filtering device, which are disposed in the ground, for receiving and filtering the contaminated oil. Thus, the conventional washing apparatus tends to be large-sized and require a considerably large installation space.

When strips of a relatively soft material such as aluminum strips or sheets to be formed into aluminum outer panels used on some motor vehicles of modern-vintage are washed by brush rolls as described above, the soft strips are likely to be marred, scratched or otherwise damaged by the brush rolls. Decreasing the force of the brush rolls acting on the strips would prevent such damage to the soft strips, but lead to an insufficient washing effect by the brush rolls.

SUMMARY OF THE INVENTION

It is therefore an object of the present invention to provide an apparatus for cleaning workpiece strips prior to press forming operations thereon, which has an excellent cleaning effect with the cleaned strips kept free from foreign matters, and which assures clean operating environments and requires a reduced installation space.

The above object may be achieved according to the principle of this invention, which provides a cleaning apparatus for removing foreign matters from workpieces in the form of strips or sheets cut from a larger blank, before the workpiece is subjected to a press forming operation, the "cleaning apparatus comprising: (a) a feeding device for feeding the workpieces successively one after another, through a feed path in a feeding direction; (b) de-oiling rolls disposed in an upstream portion of the feed path as seen in the feeding direction, and rotated in pressing rolling contact with the surfaces of each workpiece as the workpiece is fed, so as to remove by absorption oily substances from the surfaces of the workpiece; and (c) tacky rolls disposed downstream of the de-oiling rolls as seen in the feeding direction, and rotated in pressing rolling contact with the surfaces of the workpiece as the workpiece is fed, the tacky rolls having tackiness to remove the foreign matters from the surfaces of the workpiece.

In the cleaning apparatus of the present invention constructed as described above, the workpiece strips or sheets are successively fed, so that the oily substances adhering to the workpiece strips or sheets are first absorbed by the de-oiling rolls, and then the remaining foreign matters deposited on the workpieces are removed by the tacky rolls due to their tacky property. Since the oily substances such as a lubricant and an anti-rust oil which adhered to the workpieces during cutting of the blank to prepare the strips or sheets are removed by the de-oiling rolls, the subsequent removal of the foreign matters from the workpieces can be effectively accomplished, while reducing a possibility of transfer of the once removed foreign matters such as dust and dirt back to the workpieces.

According to the present cleaning apparatus which uses the tacky rolls capable of removing the foreign matters from the workpieces by transferring the foreign matters to the tacky rolls due to their tackiness, the operating environment of the apparatus is significantly improved as compared with that of the conventional apparatus adapted to brush the workpiece while applying a washing oil to the workpiece. The present cleaning apparatus which does not require a reservoir and a filtering device for such washing oil can be made compact and small-sized, leading to reduction in the required installation space. Further, the tacky rolls have a higher cleaning effect and are operable at a higher feeding speed of the workpiece, than the combination of the brush rolls and the cleaning oil. In addition, the foreign matters removed by the tacky rolls are unlikely to be transferred back to the workpiece, and the prior removal of the oil substances by the de-oiling rolls is effective to minimize a possibility of dust and dirt adhering to the cleaned workpiece. Moreover, the tacky rolls are capable of cleaning the workpiece without damaging the workpiece of a relatively soft material such as an aluminum strip or sheet.

According to one preferred feature of the present invention, the cleaning apparatus further comprises a lubricant coating device disposed downstream of the tacky rolls and including a plurality of nozzles which are arranged in a row that intersects the feeding direction. The nozzles are selectively supplied with a lubricating oil so as to apply the lubricating oil to a desired portion of the workpiece. Since the tacky rolls are adapted to remove the foreign matters from the workpiece without using any oil, a product to be obtained by a press forming operation such as a drawing operation on the workpiece may have some defect such as fracture due to insufficient slipping of the workpiece with respect to a punch-and-die assembly on a pressing machine, if the workpiece as cleaned by the present cleaning apparatus is loaded onto the pressing machine. To avoid this drawback, the lubricant coating device provided downstream of the tacky rolls as described above is adapted to apply a lubricant to a desired portion of the workpiece before the workpiece leaves the cleaning apparatus. For example, the lubricant is applied to a portion of the cleaned workpiece which contacts a pressure pad or blank holder pad on the pressing machine. Since the nozzles of the lubricant coating device are selectively supplied with the lubricant so as to lubricate only the desired portion of the workpiece, the locally lubricated workpiece is less likely to receive dust and dirt or other foreign matters, than the conventionally lubricated workpiece whose entire surfaces are coated with a lubricant.

According to another preferred feature of this invention, the cleaning apparatus further comprises a vacuum cleaning device disposed between the de-oiling rolls and the tacky rolls as seen in the feeding direction, so as to remove by vacuum suction the foreign matters from the workpiece. In the present form of the invention, the workpiece is cleaned by the vacuum cleaning device before it is cleaned by the tacky rolls. As a result, the amount of the foreign matters that should be removed by the tacky rolls is considerably reduced, whereby the expected life of the tacky rolls during which these tacky rolls exhibit a sufficient cleaning effect can be prolonged. In other words, the interval of replacement or cleaning of the contaminated tacky rolls having reduced tackiness is accordingly prolonged.

In one form of the above feature of the present invention, the vacuum cleaning device includes a cleaner head and guide rolls. The cleaner head has a suction slot having a form having alternate concave and convex portions as seen in a plane parallel to the surfaces of the workpiece, which concave and convex portions are concave and convex as seen in the feeding direction. The guide rolls are disposed adjacent to an opening of the suction slot through which the foreign matters on the workpiece are sucked under vacuum. These guide rolls include rolls located within a distance of concavity of the concave portions of the suction slot as measured in the feeding direction of the workpiece. The guide rolls are supported rotatably about respective axes perpendicular to the workpiece feeding direction, for rolling contact with the workpiece, so as to hold the workpiece spaced apart from the opening of the suction slot of the cleaner head by a predetermined distance.

In the above form of the cleaning apparatus, the suction slot formed through the vacuum cleaning device is shaped to have a form as seen in the plane parallel to the workpiece, so as to provide alternate portions which are concave and convex as seen in the feeding direction of the workpiece, and the guide rolls are disposed at least within the distance of concavity of the concave portions (convexity of the convex portions) of the suction slot. The guide rolls function to space the workpiece a suitable distance away from the operating end of the cleaner head, namely, away from the opening through which the foreign matters on the workpiece are sucked into the suction slot. Therefore, the guide rolls prevent the workpiece from being sucked and deflected toward the opening of the suction slot due to the suction force produced by the vacuum cleaning device. Thus, the guide rolls are effective to avoid interference between the workpiece and the cleaner head, and prevent reduction in the cleaning function of the cleaner head. There is provided a small clearance between the operating end of the cleaner head and the appropriate surface of the workpiece, so as to provide a suitable suction force or air flow at the operating end of the cleaner head. However, if the workpiece is a strip or sheet having a relatively small thickness or made of a soft material such as aluminum, the workpiece tends to be sucked toward the opening of the suction slot, whereby the leading edge of the workpiece is likely to interfere with the operating end of the cleaner head, or the intermediate portion of the workpiece is likely to slidingly contact the operating end of the cleaner head. In this event, the leading end portion or intermediate portion of the workpiece may be deformed or damaged, and the spacing between the operating end of the cleaner head and the workpiece surface tends to be narrowed, with a result of reducing the amount of flow of the ambient air into the suction slot through the clearance, which leads to reduced vacuum cleaning function of the cleaning device. However, the guide rolls disposed within the area of concavity or convexity of the suction slot according to the present feature of the invention contact a portion of the workpiece which faces the suction slot, thereby maintaining the desired amount of clearance between the operating end of the cleaner head and the workpiece, and thus preventing an interference of the workpiece with a portion of the cleaner head at which the suction slot is open. Accordingly, the cleaner head can maintain the intended suction force at the opening of the suction slot, and provide the intended cleaning effect. The guide rolls may be either positively driven in synchronization with the feeding speed of the workpiece, or alternatively supported freely rotatably in rolling contact with the workpiece.

The suction slot may be formed so as to extend along a straight line intersecting the workpiece feeding direction. In this case, the guide rolls may be disposed within the suction slot, for rolling contact with the workpiece. However, this arrangement is not desirable because the guide rolls prevent suction of the foreign matters, namely, prevent good removal of the foreign matters from the areas of the workpiece which correspond to the positions of the guide rolls.

The cleaning apparatus including the vacuum cleaning device according to the above feature of the invention further comprises an air blow device for applying compressed air to the workpiece, at a position adjacent to the opening of the suction slot. In the present cleaning apparatus, the compressed air is blown against the workpiece by the air blow device, at the position adjacent to the suction slot of the cleaner head. Like the guide rolls described above, the compressed air serves to prevent the workpiece from being sucked toward the opening of the suction slot, and thereby effectively protect the workpiece against deformation or damage and reduction in the vacuum cleaning function, which would arise from the interference of the workpiece with the cleaner head. The compressed air also functions to blow off the foreign matters deposited on the workpiece surface, aiding the vacuum cleaner head in removing the foreign matters and thus improving the cleaning capacity of the vacuum cleaning device. Air nozzles of the air blow device are suitably positioned and oriented so as to direct the blown-off particles into the suction slot, for preventing the removed particles from scattering around the cleaner head and deteriorating the operating environment of the cleaning apparatus.

According to a still further preferred feature of the present invention, the tacky rolls are supported freely rotatably about respective axes perpendicular to the feeding direction of the workpiece, and rotated in rolling contact with the workpiece by a feeding movement of the workpiece, the cleaning apparatus further comprising speed detecting means for detecting a rotating speed of the tacky rolls while the tacky rolls are in rolling contact with the workpiece and diagnosing means for diagnosing the tacky rolls for contamination by the foreign matters, on the basis of the rotating speed of the tacky rolls detected by the speed detecting means. In this form of the cleaning apparatus, the rotating speed of the tacky rolls which are rotated by the feeding movement of the workpiece is detected by the speed detecting means, and the tacky rolls are diagnosed for contamination by the foreign matters, namely, for reduction in the tacky forces thereof due to deposition of the foreign matters such as dust and dirt and oily substances removed from the workpieces which have been cleaned. Since the tacky rolls have tackiness which permits rotation thereof in rolling contact with the workpiece, a decrease in the tackiness or tacky forces of the tacky rolls causes an increase in the amount of slip of the tacky rolls with respect to the workpiece being fed, whereby the rotating speed of the tacky rolls is lowered as the tacky rolls are contaminated. Therefore, where the workpiece is fed at a known constant speed, for example, the tacky rolls can be diagnosed for contamination by determining whether the rotating speed of the tacky rolls is lowered below a predetermined threshold value lower than the feeding speed of the workpiece. Alternatively, the actual feeding speed of the workpiece is detected by detecting the rotating speed of pinch rolls used in the workpiece feeding device, and a difference between the detected rotating speeds of the tacky rolls and the pinch rolls is compared with a predetermined threshold value, to determine the contamination of the tacky rolls if the difference becomes equal to or exceeds the threshold value. Further alternatively, the tacky rolls can be diagnosed for contamination, by determining whether the number of revolutions of the tacky rolls during passage of the subject workpiece through the tacky rolls becomes smaller than a threshold value which is determined depending upon the length dimension of the workpiece. Two or more different threshold values corresponding to different degrees of contamination of the tacky rolls may be used to monitor the changing degree of contamination of the tacky rolls.

If the diagnosing means indicates that the tacky rolls have been contaminated to such an extent that prevents intended removal of the foreign matters from the workpiece, the surfaces of the tacky rolls are cleaned with a suitable solvent such as alcohol, or the contaminated tacky rolls may be replaced by new ones. The present arrangement does not require the tacky rolls to be cleaned or replaced by new ones at a predetermined frequency, for example, each time a predetermined number of the workpieces have been cleaned. The diagnosis as described above permits the tacky rolls to be cleaned or replaced right at the time when the cleaning or replacement becomes necessary. In this respect, it is noted that the amount of the foreign matters deposited on the workpieces is not constant. Therefore, the cleaning or replacement of the tacky rolls at a predetermined constant frequency would result in premature cleaning or replacement of the tacky rolls which are still sufficiently capable of removing the foreign matters, or continuing use of the contaminated tacky rolls which have lost their tackiness for sufficient removal of the foreign matters. The diagnosing means provided according to the present feature of the invention makes it possible to timely clean or replace the contaminated tacky rolls, and maintain the cleaning apparatus in a good operating state, while preventing a transfer of the foreign matters from the tacky rolls back to the cleaned workpiece. Thus, the tacky rolls are suitably diagnosed for contamination, so that the workpieces with high cleanliness are loaded onto a pressing machine, to assure the production of high-quality articles from the workpieces by the pressing machine.

According to a yet further preferred feature of the present invention, the cleaning apparatus further comprises drive means for rotating the tacky rolls, a monitoring roll rotated in rolling contact with the tacky rolls, speed detecting means for detecting a rotating speed of the monitoring roll and diagnosing means for diagnosing the tacky rolls for contamination by the foreign matters, on the basis of the rotating speed of the monitoring roll detected by the speed detecting means. In the present cleaning apparatus, the monitoring roll is rotated by the tacky rolls which are rotated by the drive means, and the rotating speed of the monitoring roll is detected by the speed detecting means, so that the tacky rolls are diagnosed for contamination on the basis of the detected rotating speed of the monitoring roll. Since the monitoring roll is rotated owing to the tackiness of the tacky rolls, a decrease in the tacky forces of the tacky rolls causes a decrease in the rotating speed of the monitoring roll, whereby the tacky rolls can be diagnosed for contamination on the basis of the rotating speed of the monitoring roll, as in the cleaning apparatus constructed according to the above feature of the invention. More specifically explained, the diagnosis is effected by determining whether the rotating speed of the monitoring roll becomes lower than a predetermined threshold value, whether a difference between the rotating speeds of the tacky and monitoring rolls becomes equal to or larger than a predetermined threshold value, or whether the number of revolutions of the monitoring roll for a given number of revolutions of the tacky rolls becomes smaller than a predetermined threshold value. Thus, the tacky rolls can be diagnosed to timely clean or replace the contaminated tacky rolls.

In the cleaning apparatus according to the above feature of the invention, the drive means may be adapted to always rotate the tacky rolls so that the tacky rolls remove the foreign matters from the workpiece as the workpiece is passed through the positively driven tacky rolls. However, the drive means may be activated only when the diagnosing means is operated, such that the tacky rolls are positively rotated by the drive means while the tacky rolls are not in rolling contact with the workpiece, and are negatively rotated in rolling contact with the workpiece by the feeding movement of the workpiece, as in the apparatus according to the preceding feature of the invention.

According to another preferred feature of this invention, the feeding device includes a drive motor for feeding the workpiece at a predetermined constant speed, and the cleaning apparatus further comprises torque detecting means for detecting a load torque of the drive motor, and diagnosing means for diagnosing the tacky rolls for contamination by the foreign matters, on the basis of the load torque detected by the torque detecting means. In the present cleaning apparatus, the torque detecting means is provided to detect the load torque of the drive motor for feeding the workpiece at the predetermined constant speed. For instance, the load torque is represented by a current applied to the drive motor. The tacky rolls are diagnosed on the basis of the detected load torque. In this respect, it is noted that the tacky rolls adhere to the workpiece due to the tacky property of the former. Therefore, when the tacky rolls have relatively large tacky forces, the load torque of the drive motor required to feed the workpiece in rolling contact with the tacky rolls is relatively large. As the tacky forces of the tacky rolls are reduced during use of the tacky rolls, the required load torque of the drive motor is reduced. Accordingly, the degree of contamination of the tacky rolls, which reduces the tacky forces thereof, can be detected on the basis of a change in the load torque of the drive motor. This arrangement also permits timely cleaning or replacement of the contaminated tacky rolls, as in the case where the rotating speed of the tacky rolls or monitoring roll is used to diagnose the tacky rolls. Further, the present cleaning apparatus can be made simpler in construction and more economical to manufacture, than the apparatus using the monitoring roll as described above.

In the case where the tacky rolls are not positively rotated by exclusive drive means but are negatively rotated in rolling contact with the workpiece by a feeding movement of the workpiece, the tacky rolls can be diagnosed on the basis of the load torque of the drive motor which functions to feed the workpiece through at least a tacky roll device which includes the tacky rolls. In the case where the tacky rolls are positively driven by an exclusive roll drive motor, that is, if the exclusive roll drive motor is provided to feed the workpiece and the tacky rolls also function to feed the workpiece, the tacky rolls can be diagnosed on the basis of the load torque of the roll drive motor. In this arrangement wherein the tacky rolls are rotated by the exclusive roll drive motor, the workpiece can be smoothly fed by the tacky rolls as long as the tacky rolls have sufficiently large tacky forces. In this condition, the load torque of the feeding motor other than the roll drive motor is relatively small. As the tacky forces of the tacky rolls are reduced, however, the function of the tacky rolls as a feeding motor to feed the workpiece is lowered, whereby the load torque of the feeding motor is accordingly increased. Consequently, the degree of contamination of the tacky rolls can be detected on the basis of a change in the load torque of the feeding motor.

According to a further preferred feature of this invention, the cleaning apparatus further comprises: a roll drive motor for rotating the tacky rolls to feed the workpiece at a predetermined constant speed through a tacky roll device which includes the tacky rolls; torque detecting means for detecting a load torque of the roll drive motor; determining means for determining a passage time required for the workpiece to pass through the tacky roll device, on the basis of the load torque detected by the torque detecting means; and diagnosing means for diagnosing the tacky rolls for contamination by the foreign matters, on the basis of the passage time determined by the determining means. In the present cleaning apparatus, the load torque of the roll drive motor for rotating the tacky rolls to feed the workpiece at the predetermined constant speed through the tacky roll device is detected by the torque detecting means, and the passage time required for the workpiece to pass through the tacky roll device is determined on the basis of the detected load torque of the roll drive motor, so that the tacky rolls are diagnosed for contamination, on the basis of the determined passage time of the workpiece. When the tacky rolls are not in contact with the workpiece, that is, when substantially no load acts on the roll drive motor for rotating the tacky rolls, the load torque of the roll drive motor is small. The load torque of this roll drive motor increases to a relatively high level soon after the workpiece has reached the tacky roll device. The load torque of the roll drive motor is maintained at this relatively high level as long as the workpiece is passing through the tacky roll device. Accordingly, the time duration of the passage of the workpiece through the tacky roll device can be determined based on a change in the load torque of the roll drive motor. In this connection, it is noted that the amount of slip of the tacky rolls with respect to the workpiece is relatively small while the tacky rolls have sufficient tacky forces, but increases with a decrease in the tacky forces of the tacky rolls. An increase in the amount of slip of the tacky rolls causes an increase in the passage time required for the workpiece to pass through the tacky roll device. Thus, the tacky rolls can be diagnosed for contamination, on the basis of the determined passage time of the workpiece. Like the preceding arrangements which utilize the rotating speed of the tacky rolls or monitoring roll or the load torque of the workpiece feeding motor, the present arrangement utilizing the time of passage of the workpiece through the tacky rolls permits timely cleaning or replacement of the contaminated tacky rolls.

In the cleaning apparatus according to the above feature of the invention, the tacky rolls constitute a part of the workpiece feeding device, so that the workpiece is passed through the tacky roll device by rotation of only the tacky rolls driven by the roll drive motor. Accordingly, the speed of feeding of the workpiece through the tacky roll device is lowered as the tacky forces of the tacky rolls are reduced. Further, the load torque of the roll drive motor is reduced as the tacky forces are reduced. However, the load torque of the roll drive motor after the tacky forces have been reduced is larger than that when substantially no load acts on the roll drive motor. Hence, the passage time of the workpiece can be determined based on the load torque of the roll drive motor even after the tacky forces of the tacky rolls have been reduced, namely, even after the tacky rolls have been contaminated.

According to a still further feature of the invention, the cleaning apparatus further comprises a roll cleaning device which includes: drive means for rotating the tacky rolls; a cleaning pad disposed movably between an operating position for cleaning the tacky rolls, and a non-operating position spaced apart from the tacky rolls; and liquid supply means for supplying a cleaning liquid to the cleaning pad. The tacky rolls are cleaned by the cleaning pad in pressing rolling contact with the tacky rolls while the tacky rolls are rotated by the drive means and while the cleaning liquid is supplied to the cleaning pad from the liquid supply means. In the present cleaning apparatus, the tacky rolls when contaminated can be easily cleaned by the cleaning pad supplied with the cleaning liquid, without having to remove the tacky rolls from the apparatus.

According to another feature of the invention, a plurality of tacky roll devices each including the tacky rolls are disposed downstream of the de-oiling rolls as seen in the feeding direction. Each tacky roll device is movable between an operating position in which the tacky rolls partially define the feed path of the workpiece, and a non-operating position spaced apart from the feed path. In the present cleaning apparatus wherein each tacky roll device is movable between the operating and non-operating positions, one of the tacky roll devices is placed in the operating position while the other tacky roll device or devices is/are placed in the non-operating position. When the tacky rolls of the tacky roll device placed in the operating position have been contaminated and are not capable of effectively removing the foreign matters from the workpiece, this tacky roll device is moved to the non-operating position while another tacky roll device is moved to the operating position, so that the cleaning operation of the apparatus can be continued. The contaminated tacky rolls thus brought to the non-operating position can be cleaned by a suitable cleaning device constructed, for example, according to the above feature of the invention, or replaced by new tacky rolls. Thus, the present arrangement permits cleaning or replacement of the contaminated tacky rolls, without requiring interruption of an operation of a pressing system which includes the present cleaning apparatus or to which the present apparatus is connected. Even if a temporary interruption of the pressing system is necessary, the time of the interruption is at a minimum required for interchanging the contaminated and non-contaminated tacky roll devices. Accordingly, the operating efficiency of the pressing system is considerably improved, according to the present arrangement, as compared with an arrangement which requires interruption of the pressing system for a relatively long period of time necessary for cleaning or replacing the contaminated tacky rolls. The present arrangement is also advantageous particularly where the amount of foreign matters deposited on the workpieces is relatively large. In this case, the tacky roll devices are selectively brought to the operating position so that the tacky rolls placed in the operating position always have a sufficiently high degree of tackiness for efficient removal of the foreign matters from the workpieces.

BRIEF DESCRIPTION OF THE DRAWINGS

The above and optional objects, features and advantages of the present invention will become more apparent by reading the following detailed description of presently preferred embodiments of the invention, when considered in connection with the accompanying drawings, in which:

FIG. 13 is a view indicating a screen image provided on the control panel, for setting up lengths of time during which the spray nozzles of the lubricant coating device of FIG. 9, depending upon the kind of the workpiece strip;

FIGS. 35, 36 and 37 are flow charts illustrating an example of a routine executed by the controller of FIG. 33, for diagnosing the tacky rolls for contamination, on the basis of the detected current In;

FIGS. 38 and 39 are flow charts illustrating another example of the routine for diagnosing the tacky rolls for contamination, on the basis of the detected current In;

DETAILED DESCRIPTION OF THE PREFERRED EMBODIMENTS

Figure 1:
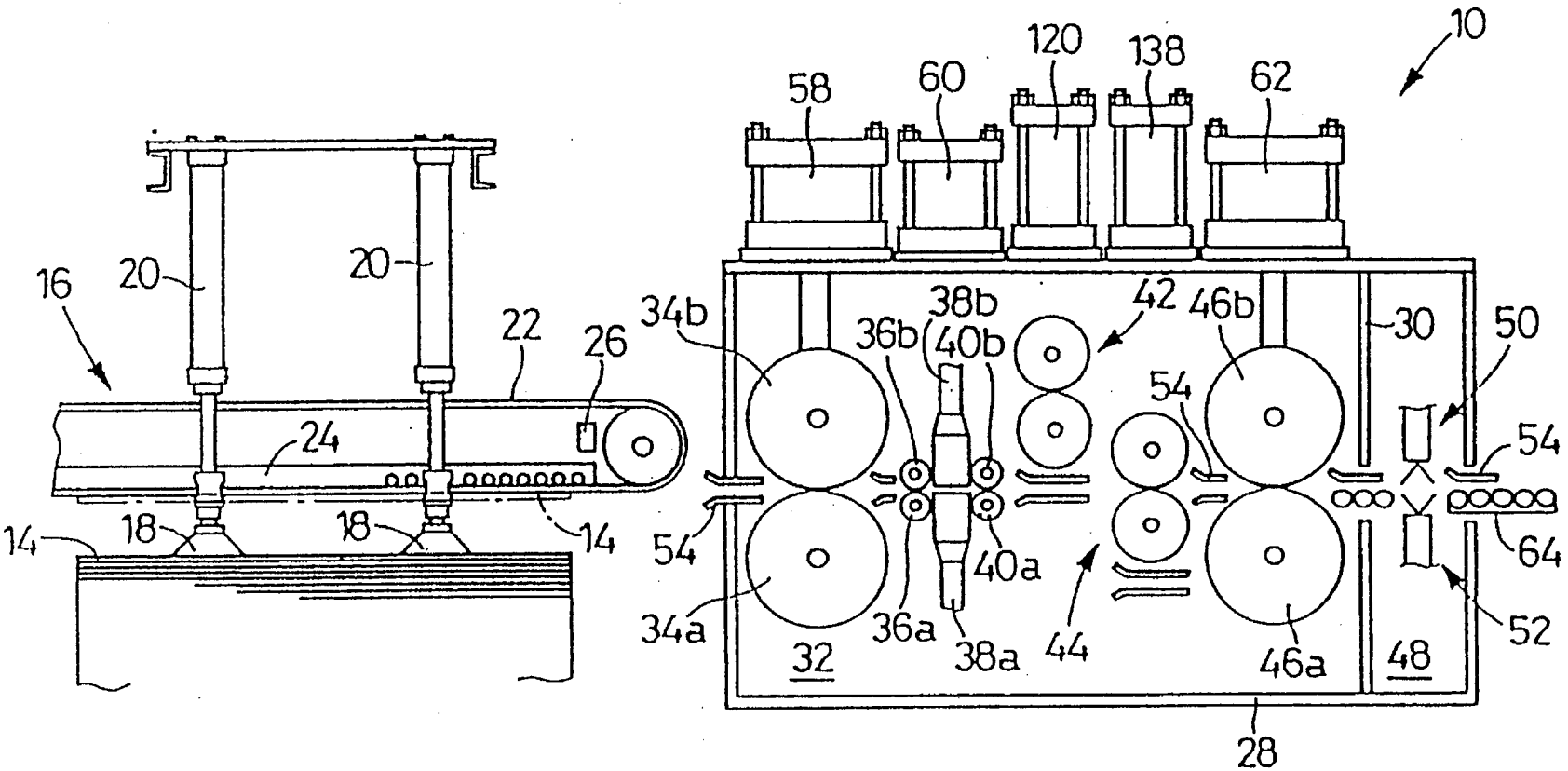
FIG. 1 is a schematic view showing an apparatus for cleaning strips prior to press forming thereof, which is constructed according to one embodiment of the present invention.

Referring first to the schematic view of FIG. 1, there is shown a cleaning apparatus indicated generally at 10. This cleaning apparatus has a control system illustrated in the block diagram of FIG. 2. As shown in FIG. 1, a stack of workpieces in the form of strips or sheets 14 to be loaded onto a pressing system is positioned below a belt feeder 16. The belt feeder 16 includes a plurality of pneumatic cylinders 20 having piston rods which carry respective vacuum suckers 18 at their lower ends. The workpiece strips 14 are lifted and transferred to the belt feeder 16 by the pneumatic cylinders 20, one after another from the stack. The belt feeder 16 has an endless belt 22, and a magnetic chuck 24 which is disposed within the loop of the belt 22 and adjacent the lower span of the belt 22. The magnetic chuck 24 is adapted to generate a magnetic force for attracting each strip 14 onto the lower span of the belt 22. With the strip 14 attracted to the belt 22, the strip 14 is released from the vacuum sucking by the vacuum suckers 18, and the endless belt 22 is rotated to feed the strip 14 rightward (as seen in FIG. 1) into a housing 28 of the cleaning apparatus 10, such that the strip 14 has a substantially horizontal posture.

The belt feeder 16 is provided with a photoelectric tube 26 at its right end, to detect the feeding of the strip 14 into the cleaning apparatus 10. When the rear end of the strip 14 has passed the photoelectric tube 26, the pneumatic cylinders 20 are activated to start an operation to lift the next strip 14 from the stack. In the present example, the strip 14 is prepared by cutting a plated steel blank, and is pressed into an outer panel for a motor vehicle, for example. The strip 14 is not coated with an anti-rust oil but carries some amount of a lubricating oil used on a cutting device by which the strip 14 is cut from the plated steel blank. The lubricating oil remaining on the strip 14 is likely to receive foreign matters such as dust and dirt, and steel particles produced during the cutting.

Although the steel strip 14 in the present example is attractable by the magnetic chuck 24, the chuck 24 may be replaced by other suitable devices where the strip is made of aluminum or other material not attractable by a magnetic force. For example, the belt 22 may be provided with a multiplicity of through-holes through which the strip is sucked onto the belt 22 under a vacuum pressure produced by a vacuum pump.

The housing 28 of the cleaning apparatus 10 has opposite end walls which has an inlet and an outlet, respectively, so that the strip 14 fed from the belt feeder 16 enters the housing 28 through the inlet and leaves the housing 28 through the outlet. The housing 28 also has a partition wall 30, which divides the interior of the housing 28 into two compartments. Within the relatively large compartment 32 on the side of the inlet adjacent the belt feeder 16, there are disposed a pair of de-oiling rolls 34*a*, 34*b*, a pair of pinch rolls 36*a*, 36*b*, a pair of vacuum cleaner heads 38*a*, 38*b*, a pair of pinch rolls 40*a*, 40*b*, a first tacky roll device 42, a second tacky roll device 44, and a pair of pinch rolls 46*a*, 46*b*. Within the relatively small compartment 48 on the side of the outlet of the housing 28, there are disposed an upper and a lower lubricant coating nozzle unit, 50, 52. A strip guide 54 for guiding the strip 14 is provided at each of the following locations: at the inlet of the housing 28; between the de-oiling rolls 34*a*, 34*b* and the pinch rolls 36*a*, 36*b*; between the second tacky roll device 44 and the pinch rolls 46*a*, 46*b*; at the partition plate 30; and at the outlet of the housing 28.

The lower de-oiling roll 34a and the lower pinch rolls 36*a*, 40*a* and 46*a* are supported within the housing 28, rotatably about their horizontal axes, such that the upper ends of the circumference of these rolls lie in a plane substantially parallel to the horizontal plane. These lower rolls 34*a*, 36*a*, 40*a*, 46*a* are rotated clockwise by a common feeding motor 56 (FIG. 2) at the same peripheral speed, through a belt-and-pulley mechanism (not shown). On the other hand, the upper de-oiling roll 34*b* and the upper pinch rolls 36*b*, 40*b* and 46*b* are disposed above the corresponding lower rolls 34*a*, 36*a*, 40*a*, 46*a*, and are movable in the vertical direction by respective pneumatic cylinders 58, 60, 62. Piston rods extend downward from the pneumatic cylinders 58, 60, 62 to force the upper rolls 34*b*, 36*b*, 40*b*, 46*b* against the corresponding lower rolls 34*a*, 36*a*, 40*a*, 46*a*, so that the strip 14 is fed rightward through the nips of these rolls, to a loading station 64 of the pressing system. The operating speed of the feeding motor 56, namely, the feeding speed of the strips 14 is determined depending upon the required feeding distance to the loading station 64, so that the strips 14 are fed to the loading station 64 one after another with a cycle time equal to a cycle time of the pressing system. The feeding speed of the belt feeder 16 is substantially the same as or slightly lower than the feeding speed of the cleaning apparatus 10. In the present embodiment, the de-oiling rolls 34*a*, 34*b*, pinch rolls 36*a*, 36*b*, 40*a*, 40*b*, 46*a*, 46*b* and feeding motor 56 constitute a feeding device for feeding the strip 14 through the apparatus 10 and to the loading station 64.

Figure 2:
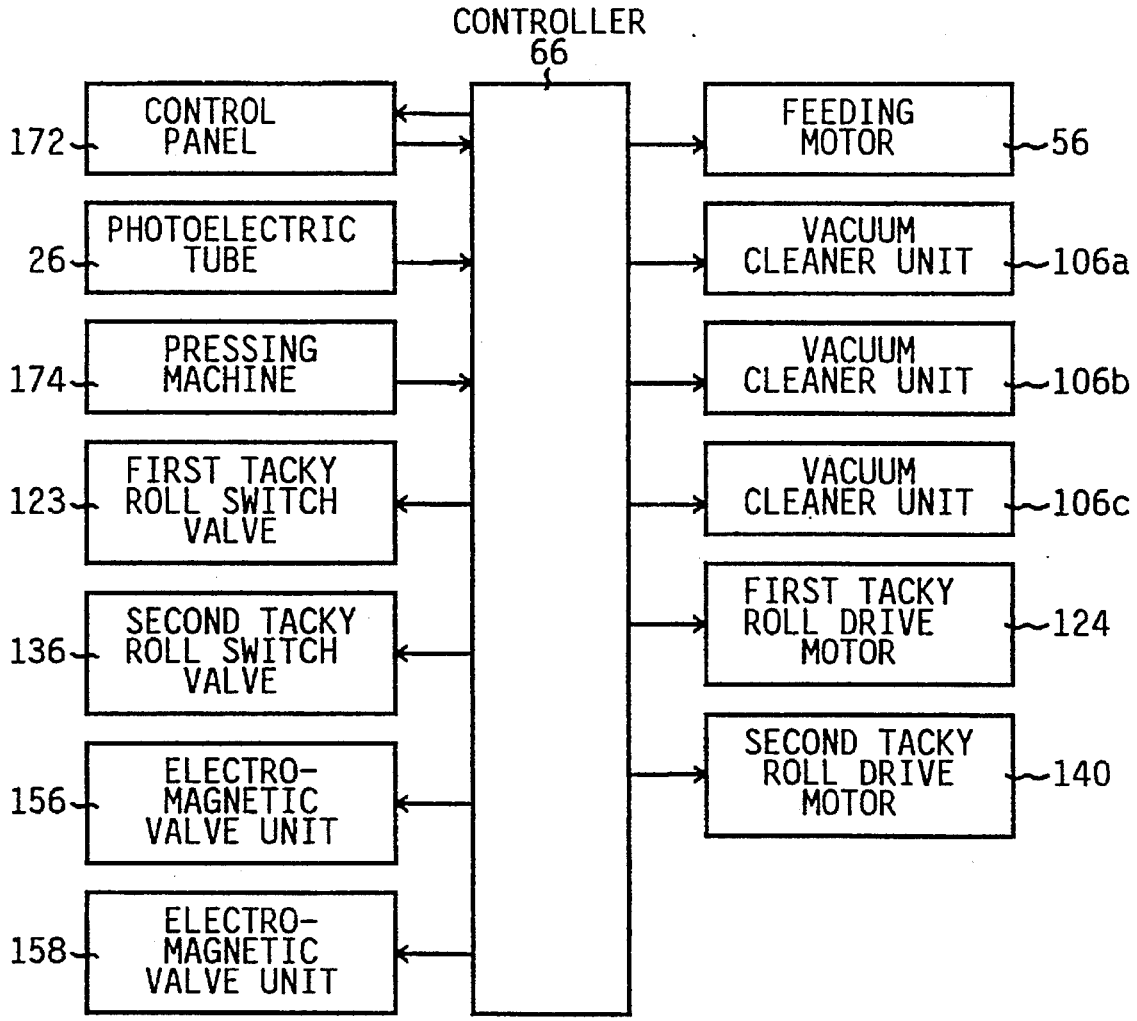
FIG. 2 is a block diagram illustrating a control system of the cleaning apparatus of FIG. 1.

The pneumatic cylinders 58, 60, 62 are switched by respective electromagnetic valves (not shown) provided in an air control circuit, which valves are controlled by a controller 66 of the control system as indicated in the block diagram of FIG. 2. The controller 66 controls the valves so that while the pressing system is in operation, the piston rods of the pneumatic cylinders 58, 60, 62 are held in their lowered position in which the upper rolls 34*b*, 36*b*, 40*b*, 46*b* are pressed against the corresponding lower rolls 34*a*, 36*a*, 40*a*, 46*a*. During the operation of the pressing system, the feeding motor 56 is also activated by the controller 66. The pneumatic cylinders 60 are used to move the upper cleaner head 38*b* in the vertical direction, together with the upper pinch rolls 36*b*, 40*b*.

The de-oiling rolls 34*a*, 34*b* disposed at the most upstream position of the feeding device for the strips 14, that is, at the leftmost position adjacent to the inlet of the housing 28 are formed of an unwoven fabric at their radially outer portion, and are rotated in pressing contact with the lower and upper surfaces of the strip 14, whereby the lubricating oil adhering to the surfaces of the strip 14 is absorbed by the unwoven fabric of the rolls 34*a*, 34*b*, while the strip 14 is fed to the right. The de-oiling rolls 34*a*, 34*b* are kept in the rotating state with their circumferential surfaces in rolling contact with each other even while the strip 14 is absent. When the strip 14 is fed from the belt feeder 16, the leading end portion of the strip 14 is smoothly passed through the nip of the rolls 34*a*, 34*b*. This arrangement is effective to prevent the rolls 34*a*, 34*b* from being marred at their outer circumferential surfaces by the leading end of the strip 14. The pinch rolls 36*a*, 36*b*, 40*a*, 40*b*, 46*a*, 46*b* are provided to merely function to feed the strips 14, and are plated or formed of a suitable material such as polyurethane to protect the strips 14 against any damage due to contact with the rolls.

Figure 3:
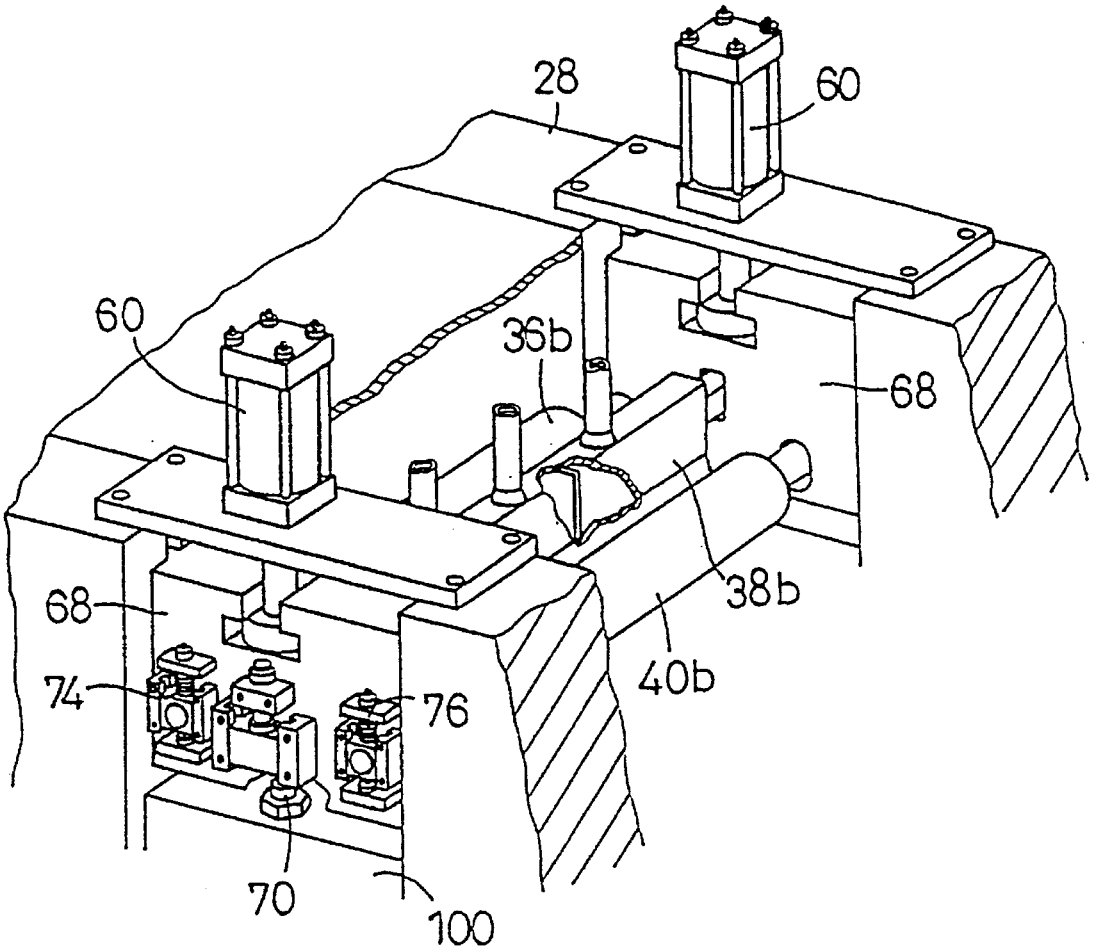
FIG. 3 is a perspective view showing an upper vacuum cleaner head and the related components of the cleaning apparatus of FIG. 1.
Figure 4:
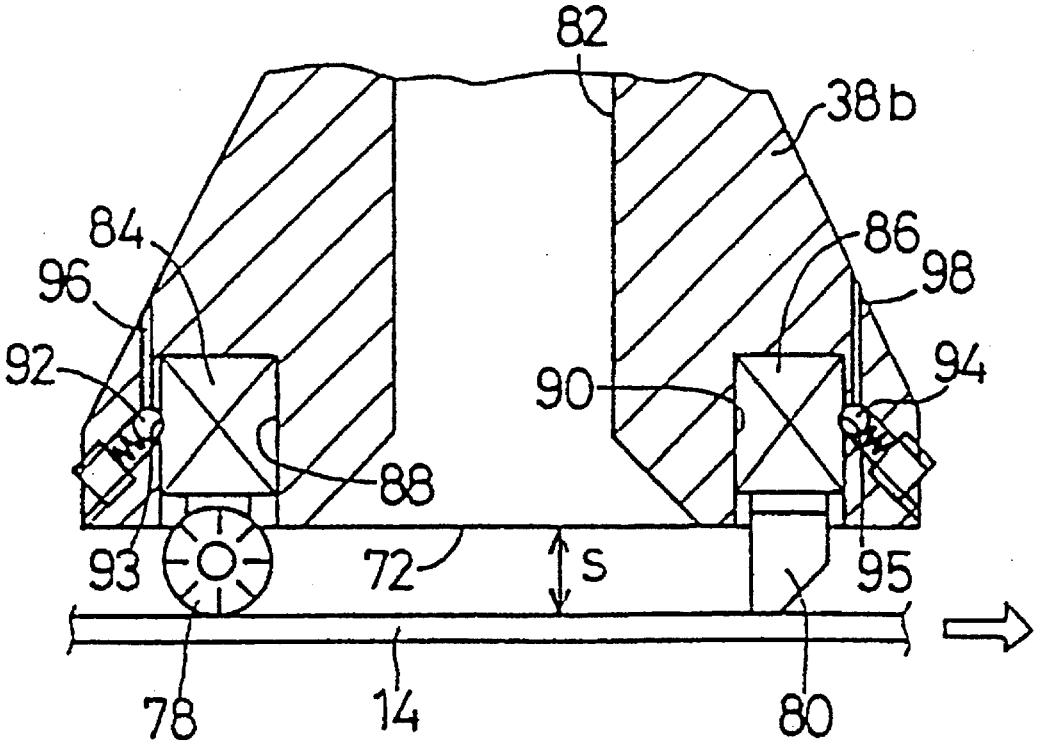
FIG. 4 is an elevational view in cross section of a lower portion of the upper vacuum cleaner head of FIG. 3.

The vacuum cleaner heads 38*a*, 38*b* disposed downstream of the de-oiling rolls 34*a*, 34*b* as seen in the feeding direction of the strips 14 are provided to remove by vacuum any dust and dirt and/or cutting particles which are deposited on the surfaces of the strip 14. As shown in FIGS. 3 and 4, the upper cleaner head 38*b* is supported by a pair of bearing guide blocks 68, together with the upper pinch rolls 36*b*, 40*b*, so that the upper cleaner head 38*b* is movable in the vertical direction by the pneumatic cylinders 60. The lowermost position of the bearing guide blocks 68 is determined by height adjusting screws 70, depending upon the thickness value of the strips 14, such that a clearance S between a lower end face 72 of the upper cleaner head 38*b* and the upper surface of the strip 14 is suitably selected within a range of about 1–2 mm, to assure maximum efficiency of vacuum removal of the foreign matters from the upper surface of the strip 14 by the cleaner head 38*b* fixedly attached to the blocks 68. The upper pinch rolls 36*b*, 40*b* on the opposite sides of the upper cleaner head 38*b* are attached to the bearing guide blocks 68 so that the rolls 36*b*, 40*b* are movable by a small distance in the vertical direction, and are held in the lowermost position under the biasing forces of springs 74, 76, in which the pressure nips are formed with respect to the corresponding lower pinch rolls 36*a*, 40*a*. When the strip 14 is passed through the pressure nips, the upper pinch rolls 36*b*, 40*b* are moved upward against the biasing forces of the springs 74, 76, and are pressed against the upper surface of the strip 14 by the biasing forces of the springs 74, 76. The upper cleaner head 38*b* is maintained at a predetermined constant height irrespective of the presence or absence of the strip 14.

The upper cleaner head 38*b* is equipped with a brush roll 78 and a rubber wiper 80 disposed below the lower end face 72, so that the brush roll 78 and rubber wiper 80 contact the upper surface of the strip 14. The brush roll 78 has a brush made of nylon, for example, and is freely rotatably disposed upstream of a sucking slot 82 as seen in the feeding direction of the strip 14, namely, on the side adjacent to the pinch roll 36*b*. The sucking slot 82 is formed through the cleaner head 38*b* and open in the lower end face 72. As the strip 14 is fed, the brush roll 78 is rotated in contact with the upper surface of the strip 14, whereby the foreign matters deposited on the strip 14 are sprung up toward the lower opening of the sucking slot 82. The rubber wiper 80 is disposed downstream of the sucking slot 82, namely, on the side adjacent to the pinch roll 40*b*, so that the lower tip of the wiper 80 is in contact with the upper surface of the strip 14. For easy replacement of the brush roll 78 and rubber wiper 80 upon contamination thereof, these roll and wiper 78, 80 are attached to the cleaner head 38*b* through mounting blocks 84, 86 removably received in respective recesses 88, 90 formed in the lower end face 72. The blocks 84, 86 have respective grooves 93, 95, and are fixed in the recesses 88, 90 by engagement of respective spring-biased balls 92, 94 with the corresponding grooves 93, 95. The cleaner head 38*b* has access holes 96, 98 through which suitable tools are inserted to push down the balls 92, 94 and thereby move the balls away from the grooves 93, 95, whereby the blocks 84, 86 are allowed to be removed from the recesses 88, 90. Each of the brush roll 78, rubber wiper 80 and blocks 84, 86 consists of a plurality of sections arranged in the direction of width of the strip 14 perpendicular to the feeding direction.

The lower cleaner head 38*a* and the lower pinch rolls 36*a*, 40*a* are fixedly attached to the housing 28 through mounting blocks 100, such that the lower cleaner head 38*a* and the lower pinch rolls 36*a*, 40*a* are opposed to the corresponding upper cleaner head 38*b* and the upper pinch rolls 36*b*, 40*b* which have been described above. The mounting blocks 100 are positioned with respect to the housing 28, so that a clearance between the upper end face of the lower cleaner head 38*a* and the lower surface of the strip 14 is equal to the clearance S described above with respect to the upper cleaner head 38*b*. The lower pinch rolls 36*a*, 40*a* are fixedly attached to the blocks 100, for contact with the lower surface of the strip 14. Like the upper cleaner head 38*b*, the lower cleaner head 38*a* has a brush roll and a rubber wiper on the opposite sides of a sucking slot open in the upper end face. The height adjusting screws 70 indicated above are provided on the upper end faces of the blocks 100.

Figure 5:
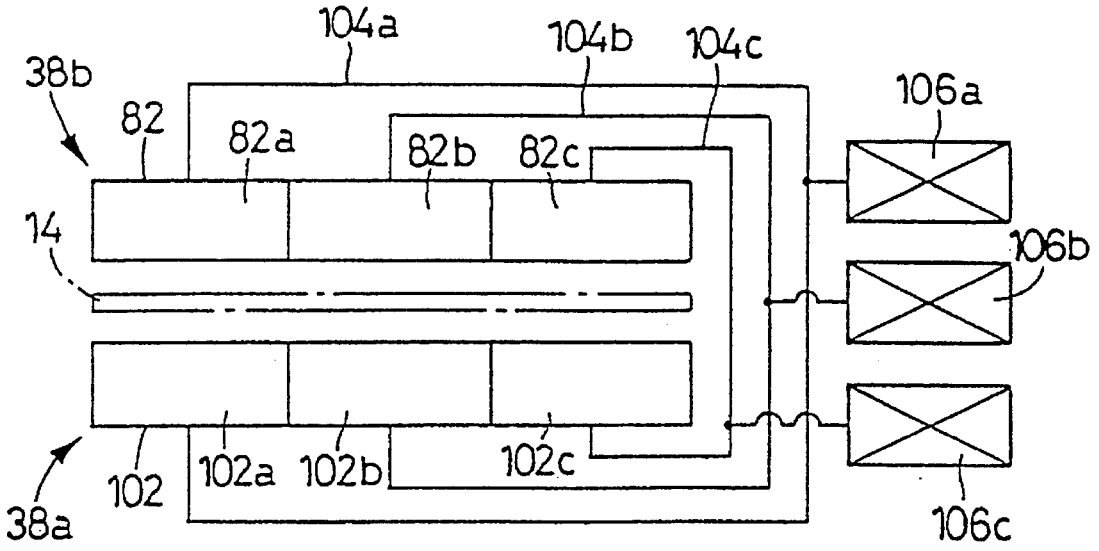
FIG. 5 is a view depicting vacuum suckers of the upper and lower vacuum cleaner heads of the apparatus of FIG. 1, which are connected to respective vacuum cleaner units.

The sucking slot 82 of the upper cleaner head 38*b* is divided by partition plates into three suction ports 82*a*, 82*b*, 82*c* arranged in the direction of width of the strip 14. Similarly, the suction slot 102 of the lower cleaner head 38*a* is divided into three suction ports 102*a*, 102*b*, 102*c*, as indicated in FIG. 5. The suction ports 82*a* and 102*a* communicate with each other through a vacuum conduit 104*a*, which is connected to a vacuum cleaner unit 106*a*. The suction ports 82*b* and 102*b* communicate with each other through a vacuum conduit 104*b*, which is connected to a vacuum cleaner unit 106*b*. Similarly, the suction ports 82*c* and 102*c* communicate with each other through a vacuum conduit 104*c*, which is connected to a vacuum cleaner unit 106*c*. Each vacuum cleaner unit 106*a*, 106*b*, 106*c* includes a vacuum pump and a filter, and these cleaner units are selectively activated by the controller 66 independently of each other, so as to selectively place the suction ports 82*a*–82*c*, 102*a*–102*c* under the vacuum condition, for covering the width of the strip 14 of the specific kind. The vacuum cleaner unit or units 106 selected depending upon the kind of the strip 14 is/are held in the activated state irrespective of the presence or absence of the strip 14 at the vacuum cleaner heads 38*a*, 38*b*, as long as the pressing system is in operation. In the present embodiment, the cleaner heads 38*a*, 38*b* and the cleaner units 106*a*, 106*b*, 106*c* constitute a vacuum strip cleaning device.

Figure 6:
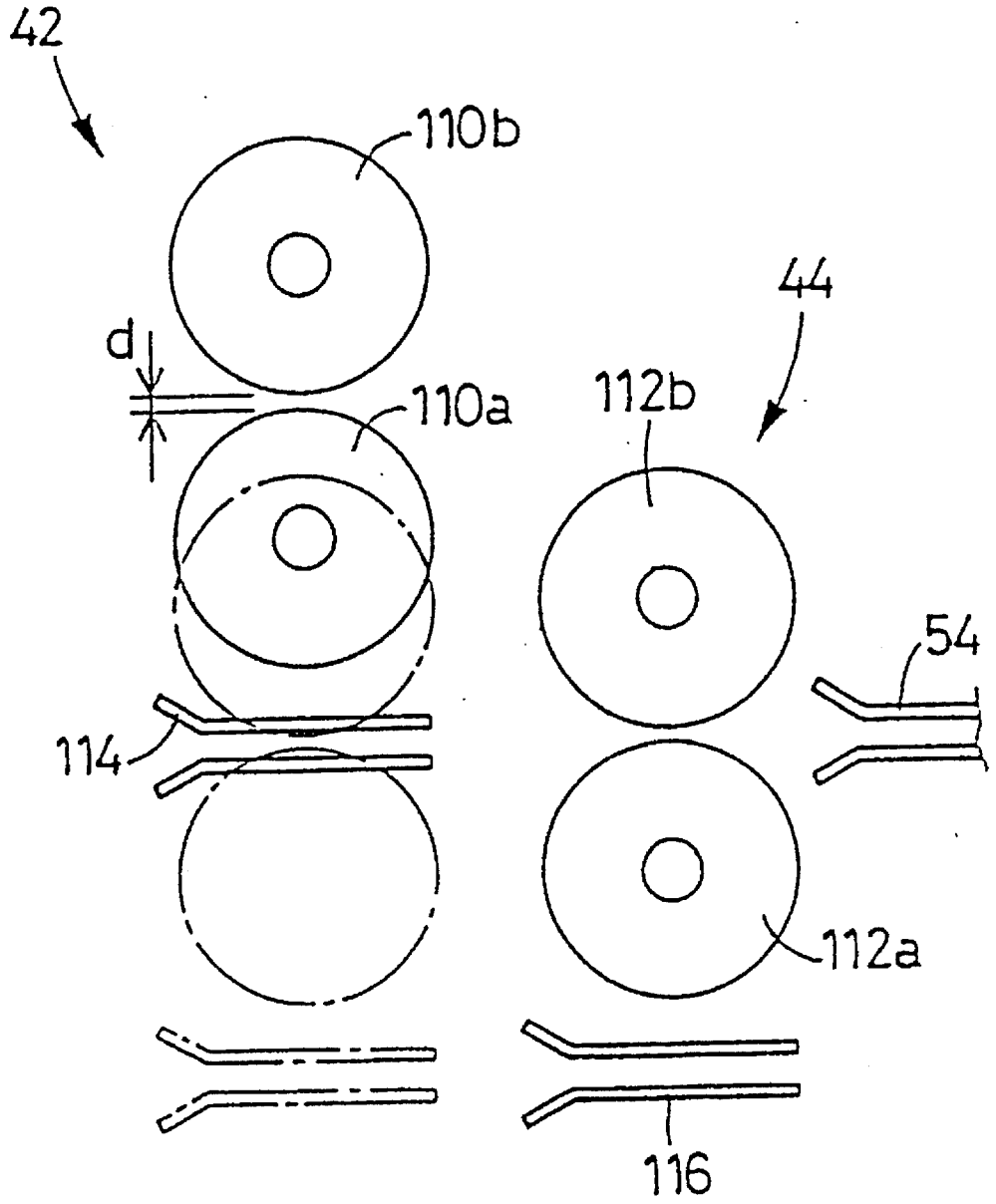
FIG. 6 is a view illustrating principal parts of two tacky roll devices used in the apparatus of FIG. 1.
Figure 7:
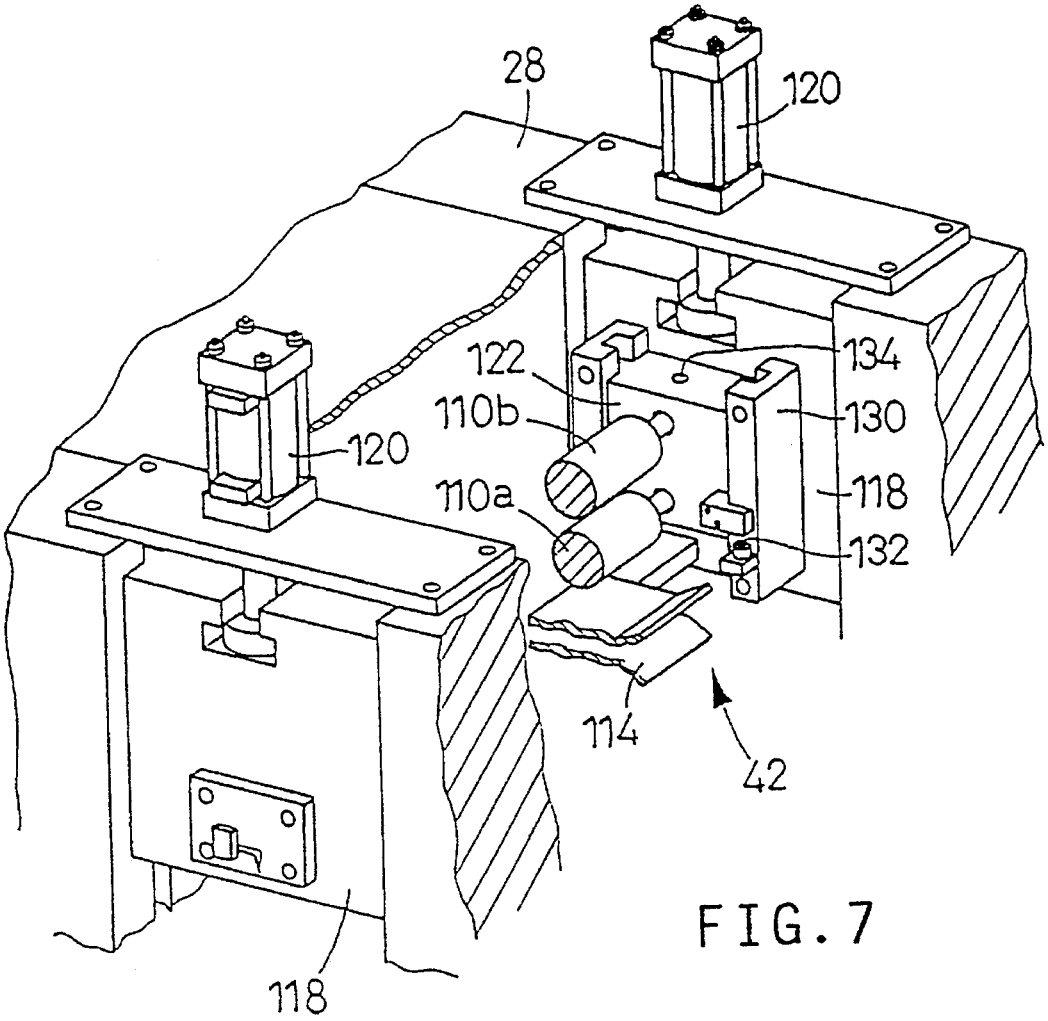
FIG. 7 is a perspective view of one of the two tacky roll devices of FIG. 6.

Each of the first and second tacky roll devices 42, 44 disposed downstream of the cleaner heads 38*a*, 38*b* in the feeding direction of the strip 14, i.e., disposed to the right of the cleaner heads 38*a*, 38*b* as seen in FIG. 1 has a pair of tacky rolls 110*a* and 110*b*, or 112*a* and 112*b*, and a guide 114 or 116, as shown in FIG. 6. Each of these tacky rolls 110*a*, 110*b*, 112*a*, 112*b* consists of a metallic tube, and a ground layer of a tacky synthetic rubber baked on the outer circumferential surface. The tacky synthetic rubber layer has a thickness of about 10 mm, and a spring hardness of about 10–20 degrees according to the Japanese Industrial Standard (JIS). As shown in FIG. 7, the first tacky roll device 42 is movable in the vertical direction by a pair of pneumatic cylinders 120 through a pair of elevator blocks 118. The guide 114 is fixed to the lower ends of the elevator blocks 118, while the pair of tacky rolls 110*a*, 110*b* are attached to the elevator blocks 118 through bearing blocks 122. The pneumatic cylinders 120 are controlled by a first tacky roll switch valve 123 (FIG. 2) in an air circuit (not shown), which is switched by the controller 66, so as to move the elevator blocks 118. The guide 114 is positioned relative to the elevator blocks 118 so that the height of the guide 114 is substantially aligned with the feed path of the strip 14 when the elevator blocks 118 are placed in the uppermost position. It is noted that the perspective view of FIG. 7 is a view taken from the upstream side in the feeding direction of the strip 14, that is, the strip 14 is fed from the right side of the view.

Figure 8:
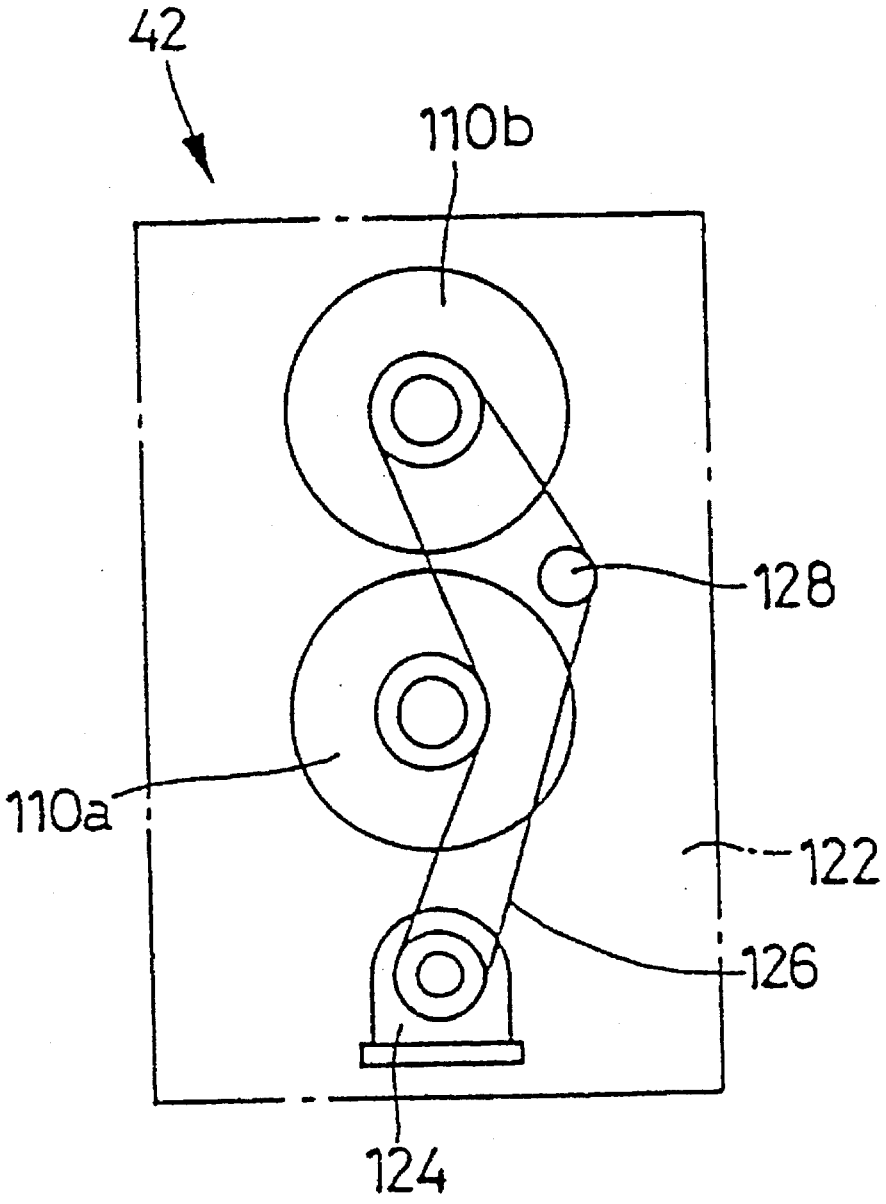
FIG. 8 is a view showing a mechanism for driving the tacky roll device of FIG. 7.

The tacky rolls 110*a*, 110*b* are supported by the bearing blocks 122, rotatably about their axes, such that the two rolls 110*a*, 110*b* are spaced apart from each other by a distance equal to a gap "d" (FIG. 6) which is about 0.2 mm smaller than the thickness of the strip 14. If the thickness of the strip 14 is about 0.7–0.8 mm, for instance, the gap "d" is about 0.5–0.6 mm. The vertical position of the gap "d" between the two tacky rolls 110*a*, 110*b* is aligned with the feed path of the strip 14 when the elevator blocks 118 are placed in the lowermost position, that is, the operating position. In this position, the strip 14 is passed through the gap "d", with the tacky rolls 110*a*, 110*b* pressed against the lower and upper surfaces of the strip 14, such that the radially outer portions of the rolls 110*a*, 11*b* are slightly elastically compressed. As the strip 14 is fed, the tacky rolls 110*a*, 110*b* are rotated in pressing rolling contact with the strip 14, whereby the foreign matters adhering to the surfaces of the strip 14 are transferred to the surfaces of the tacky rolls 110*a*, 110*b* due to the tacky condition of the latter. As shown in FIG. 8, the tacky rolls 110*a*, 110*b* are rotated in the opposite directions, by a first tacky roll drive motor 124 mounted on one of the bearing blocks 122, through a belt 126 which connect a pulley of the motor 124 and pulleys on the shafts of the tacky rolls 110*a*, 110*b*. The peripheral speed of the rolls 110*a*, 110*b* is determined to be substantially equal to the feeding speed of the strip 14, so as to prevent the leading end of the strip 14 from marring or damaging the outer surfaces of the tacky rolls 110*a*, 110*b*. The tension of the belt 126 is suitably adjusted by a tensioning roll 128.

The bearing blocks 122 are slidably guided by respective guide members 130 which are fixed to the respective elevator blocks 118. This arrangement permits the bearing blocks 122 to be pulled upwards from the guide members 130. The height position of the bearing blocks 122 relative to the elevator blocks 118 is determined by height adjusting screws 132. Each bearing block 122 has a tapped hole 134 formed in its upper end face. When the tacky rolls 110*a*, 110*b* are contaminated on their circumferential surfaces and their forces of tackiness or adhesion are lowered, the contaminated tacky rolls 110*a*, 110*b* are removed from the first tacky roll device 42, together with the bearing blocks 122, by screwing suitable lifting bolts into the tapped holes 134. The removed tacky rolls 110*a*, 110*b* are cleaned on their outer surfaces by a suitable solvent or liquid or replaced with new ones.

The second tacky roll device 44 is identical in construction with the first tacky roll device 42 described above. The tacky rolls 112*a*, 112*b* of the second tacky roll device 44 are vertically moved by a pair of pneumatic cylinders 138 (FIG. 1) which are controlled by a second tacky roll switch valve 136 (FIG. 2), which is switched by the controller 66. The tacky rolls 112*a*, 112*b* are rotated by a second tacky roll drive motor 140 (FIG. 2) in the feeding direction of the strip 14. The two tacky roll devices 42, 44 are provided in the present cleaning apparatus 10, so that one of the two devices 42, 44 is operable while the contaminated tacky rolls 110*a*, 110*b*, 112*a*, 112*b* of the other device 42, 44 are in the process of cleaning or replacement, without interruption of the cleaning operation of the apparatus 10 and the pressing operation of the pressing system. In this respect, it is noted that FIG. 1 shows the second tacky roll device 44 placed in the operative position for removing the foreign matters from the strip 14. It will be understood that the lowermost and uppermost positions of the tacky roll devices 42, 44 moved by the pneumatic cylinders 120, 138 are the operative and inoperative positions, respectively. The first and second tacky roll drive motors 124, 140 are selectively activated by the controller 66, depending upon the the tacky roll device 42, 44 which is placed in the operative position. In the condition of FIG. 1, only the second tacky roll drive motor 140 is operated. The thus selected one of the two drive motors 124, 140 is kept operated during the operation of the pressing system.

Figure 9:
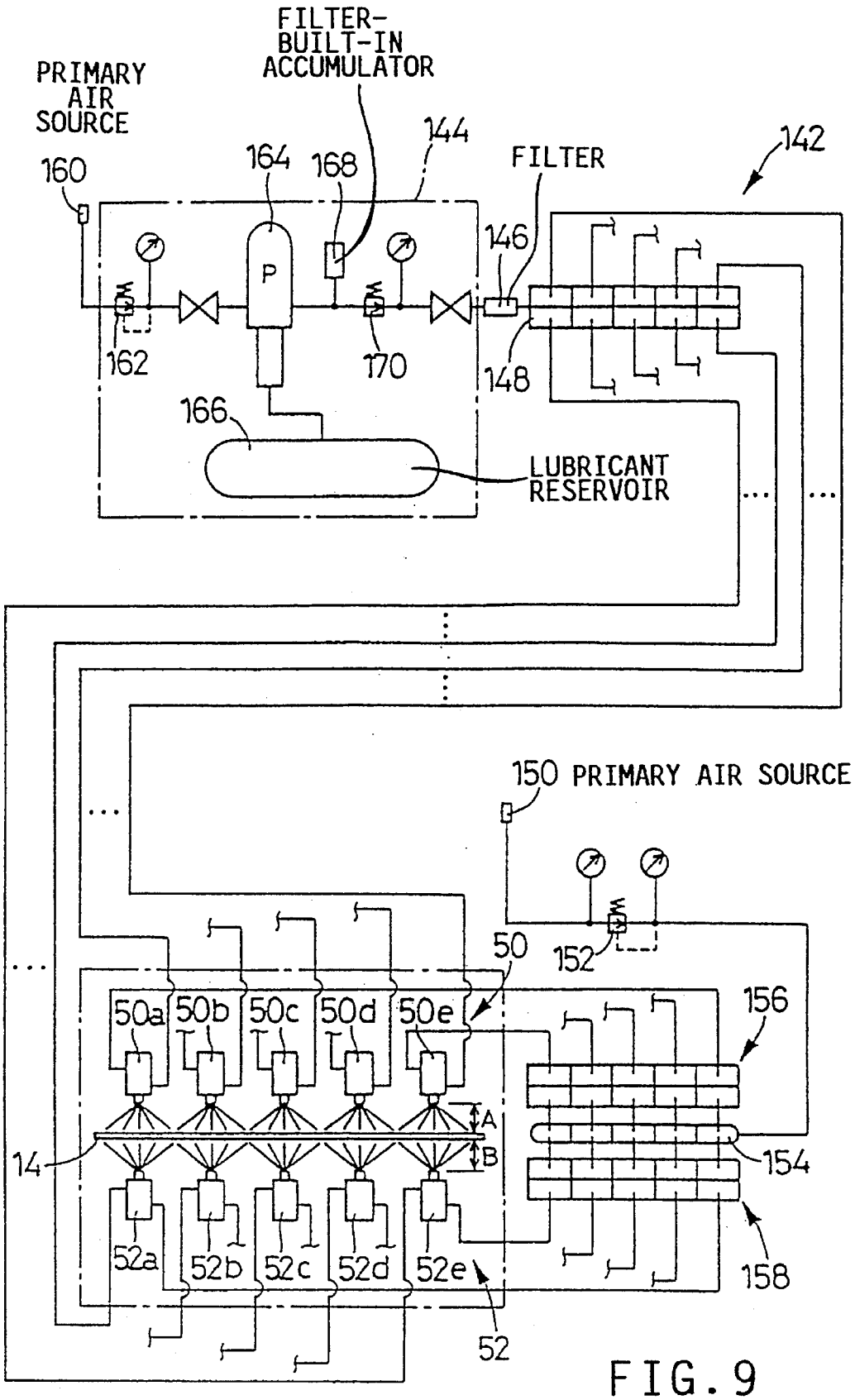
FIG. 9 is a diagram illustrating a lubricant coating device provided in the apparatus of FIG. 1.

The upper and lower lubricant coating nozzle units 50, 52 disposed in the second compartment 48 of the housing 28 constitute a part of a lubricant coating device 142 illustrated in FIG. 9. Each of the nozzle units 50, 52 has an array of five spray nozzles 50*a*–50*e*, 52*a*–52*e*, which are arranged in the direction of width of the strip 14 perpendicular to the feeding direction. A pressurized lubricant is supplied from a plunger pump unit 144 to the spray nozzles 50*a*–50*e*, 52*a*–52*e*, through a filter 146 and a branching manifold 148. Further, compressed air is supplied from a primary air source 150 to these spray nozzles 50*a*–50*e*, 52*a*–52*e*, through a regulator 152, a branching manifold 154, and respective electromagnetic valve units 156, 158. The spray nozzles 50*a*–50*e*, 52*a*–52*e* have respective spool valves which are opened by the compressed air, to thereby spray the lubricant over the upper and lower surfaces of the strip 14. The plunger pump unit 144 includes a high-pressure pump 164 which receives compressed air from a primary air source 160 through a regulator 162, so that the lubricant is pumped up from a lubricant reservoir 166 by the pump 164, and the pressurized lubricant is fed to the nozzle units 50, 52. The pump unit 144 also includes a filter-built-in accumulator 168 for assuring a high rate of flow of the lubricant and absorbing a surge pressure, and a pressure regulating valve 170 for controlling the pressure of the lubricant. The amount of the lubricant sprayed from the nozzles 50*a*–50*e*, 52*a*–52*e* and the particle size of the sprayed lubricant are determined by the pressure of the lubricant as controlled by the regulating valve 170. The pressure of the lubricant is adjusted in view of the desired thickness of the lubricant films to be formed on the strip 14. Distance "A" and "B" between the spray nozzles 50*a*–50*e*, 52*a*–52*e* and the upper and lower surfaces of the strip 14 are suitably determined depending upon the lubricant pressure, so that the areas covered by the sprays from the adjacent nozzles 50*a*–50*e*, 52*a*–52*e* slightly overlap each other.

Figure 10:
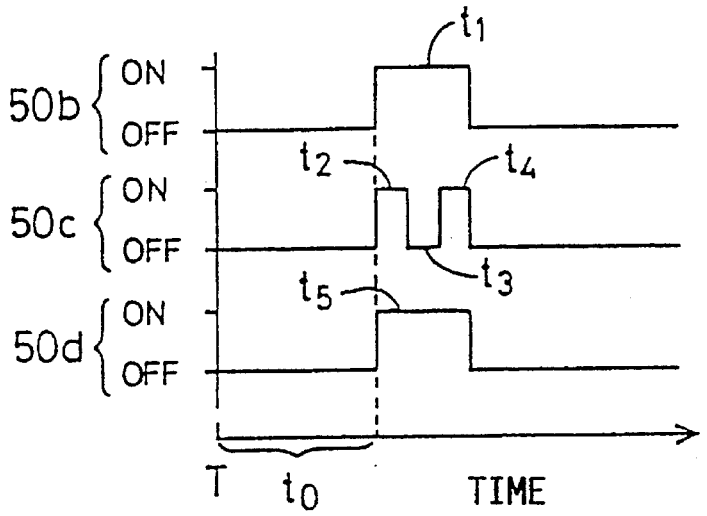
FIG. 10 is a time chart explaining opening and closing control of spray nozzles of the lubricant coating device of FIG. 9, for applying a lubricant to a workpiece strip as shown in FIG. 11.
Figure 11:
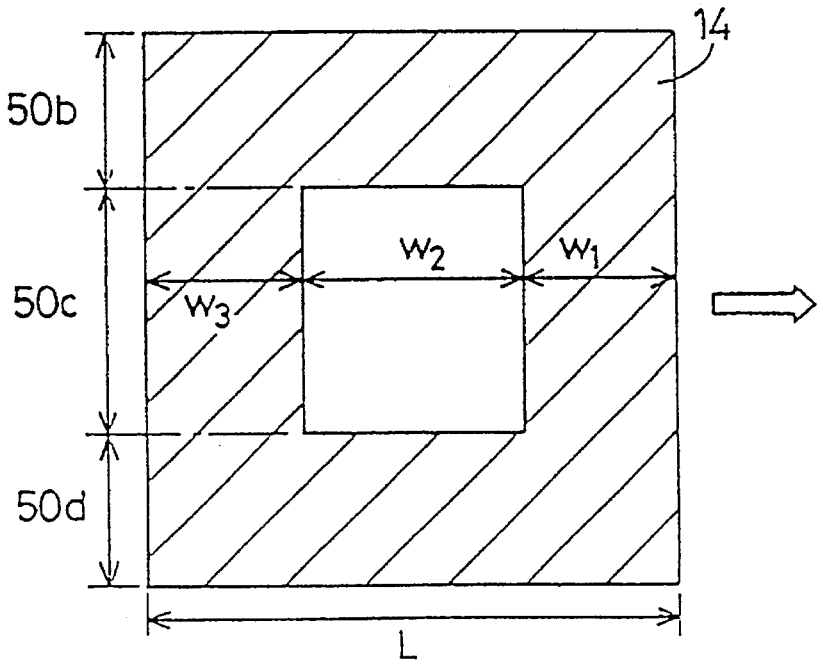
FIG. 11 is a view showing the workpiece strip coated by a lubricant by the coating device of FIG. 9, when spray nozzles of the device are opened and closed as indicated in the timing chart of FIG. 10.

Each of the electromagnetic valve units 156, 158 for the upper and lower lubricant coating nozzle units 50, 52 has five electromagnetic shut-off valves which are individually controlled by the controller 66 so as to selectively open the corresponding spray nozzles 50*a*–50*e*, 52*a*–52*e*, depending upon the area of the strip 14 over which the lubricant is sprayed. If the spray nozzles 50*b*, 50*c* and 50*d* are opened and closed as indicated in FIG. 10, the lubricant is sprayed over the area of the upper surface of the strip 14, as indicated by hatched lines in FIG. 11. Time durations $t_1$ and $t_5$ for which the spray nozzles 50*b* and 50*d* are open is determined by a length "L" and the feeding speed of the strip 14. Time durations $t_2$ and $t_4$ for which the spray nozzle 50*c* is open are determined by the feeding speed of the strip 14 and dimensions $w_1$ and $w_3$ over which the lubricant is sprayed as indicated in. FIG. 11, while a time duration $t_3$ for which the spray nozzle 50*c* is closed is determined by the feeding speed of the strip 14 and a dimension $w_2$ over which the lubricant is not sprayed as indicated in FIG. 11. The moment at which the spray nozzles 50*b*, 50*c* and 50*d* are opened is determined based on a time T from the moment at which the leading end of the strip 14 is detected by the above-indicated photoelectric tube 26. A time period $t_0$ preceding the time durations $t_1$, $t_2$ and $t_5$ is determined by the feeding speed of the strip 14 and a distance between the photoelectric tube 26 and the nozzle units 50, 52. It is noted that the strip 14 as shown in FIG. 11 has a width dimension smaller than that of the strip 14 as indicated in FIG. 9 which corresponds to all the five spray nozzles 50*a*–50*e*. That is, the strip 14 as shown in FIG. 11 can be coated with the lubricant over its entire width by only the intermediate three spray nozzles 50*b*, 50*c* and 50*d*. It is also noted that since there is a time lag between a moment at which the electromagnetic valves of the valve units 156, 158 are opened and closed and a moment at which the corresponding spray nozzles 50*a*–50*e*, 52*a*–52*e* are opened and closed, it is desirable to determine the time durations $t_0$–$t_5$ by experiments.

The controller 66 of FIG. 2 incorporates a central processing unit (CPU), a random-access memory (RAM), a read-only memory (ROM) and input and output interface circuits. The CPU processes various signals according to control program stored in the ROM while utilizing a temporary data storage function of the RAM, for controlling the feeding motor 56, vacuum cleaner units 106*a*, 106*b*, 106*c*, tacky roll drive motors 124, 140, tacky roll switch valves 123, 136, electromagnetic valve units 156, 158 for the lubricant coating nozzle units 50, 52, and switch valves for the pneumatic cylinders 58, 60, 62. To the controller 66, there are connected a touch-type operator's control panel 172, and a pressing machine 174 of the pressing system. The control panel 172 has switches capable of functioning as indicators and selectors, for indicating operating states and errors or abnormality of various portions of the cleaning apparatus 10, for selectively rendering operative the vacuum cleaner units 106*a*, 106*b*, 106*c*, the tacky roll devices 42, 44, and the lubricant spray nozzles 50*a*–50*e*, 52*a*–52*e*, and for setting the various parameters such as the time durations for which the spray nozzles 50*a*–50*e*, 52*a*–52*e* are opened and closed. The controller 66 is adapted to receive from the photoelectric tube 26 a signal indicating that the leading end of the strip 14 has passed the tube 26, and also receive from the pressing machine 174 a signal indicative of a kind of a die installed on the machine 174, namely, a part number which identifies the product to be prepared from the strip 14.

The time durations $t_0$, etc. indicated above are measured by a timer which counts the number of clock pulses generated by a quartz oscillator or resonator.

Figure 12:
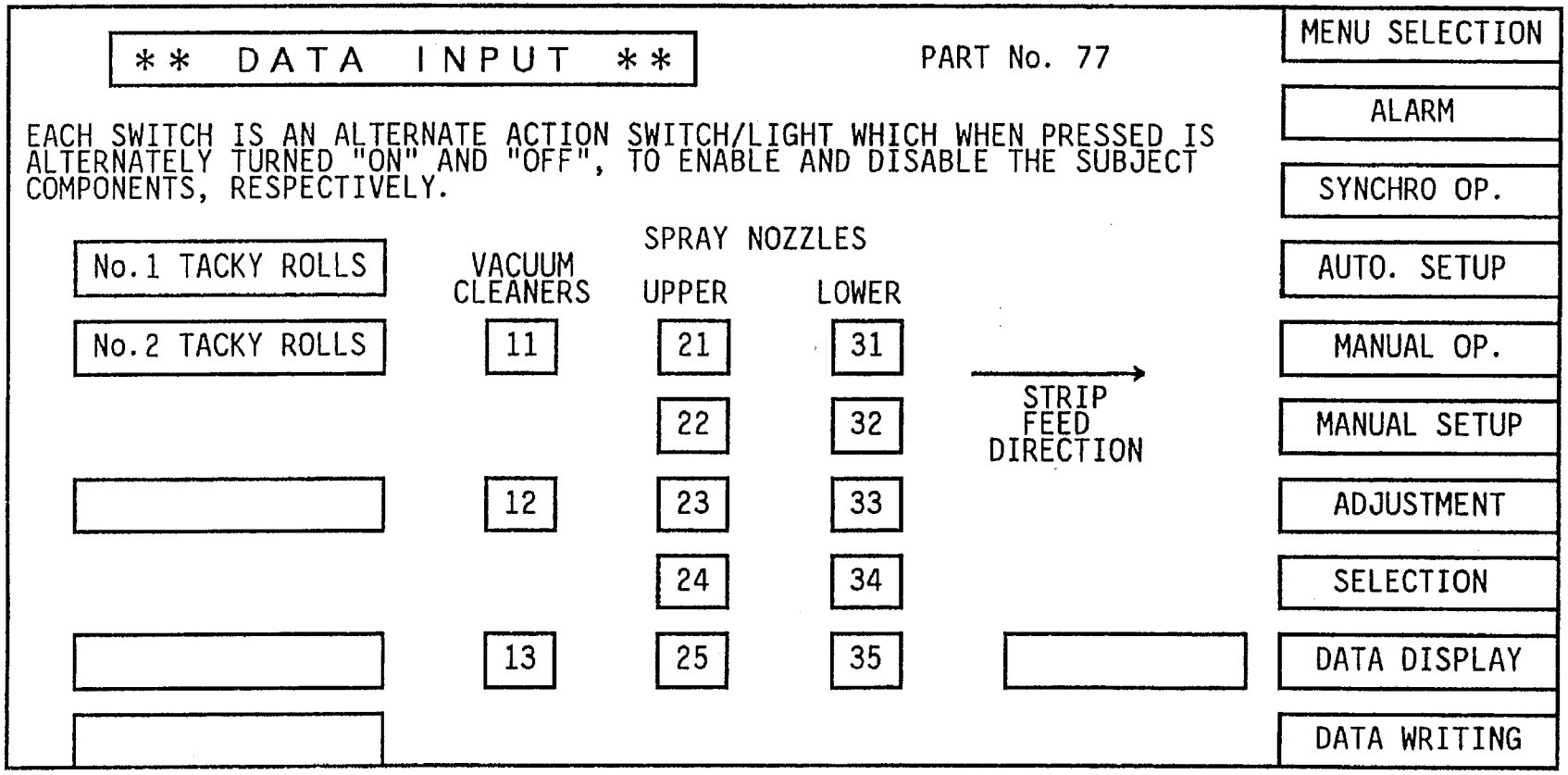
FIG. 12 is a view indicating a screen image provided on a touch-type control panel provided in the apparatus of FIG. 1, for selectively enabling upper and lower tacky roll devices, etc., depending upon the kind of the workpiece strip.

FIG. 12 indicates an example of a screen image provided on the control panel 172 in a SELECTION mode, namely, when a switch/light portion "SELECTION" in the rightmost column on the control panel 172 is pressed and illuminated. In this SELECTION mode, the first tacky roll device 42 or the second tacky roll device 44 can be selected by pressing an appropriate switch/light portion "NO. 1 TACKY ROLLS" OR "NO. 2 TACKY ROLLS" on the control panel 172. For selecting the vacuum cleaner units 106*a*, 106*b* and 106*c*, appropriate switch/light portions "11", "12" and "13" on the control panel 172 are pressed. For selecting the upper and lower lubricant spray nozzles 50*a*–50*e* and 52*a*–52*e*, appropriate switch/light portions "21" through "25" and "31" through "35" are pressed. Each time the switch/light portions indicated above are pressed, they are alternately turned on and off to render operative or inoperative the corresponding components. The currently operative components are indicated by the illuminated switch/light portions. The thus selected components are registered in the RAM of the controller 66, in relation to the part number indicated at an upper right portion of the screen.

FIG. 13 shows an example of a screen image provided on the control panel 172 in a DATA SETTING mode, namely, when a switch/light portion "ADJUSTMENT" in the rightmost column on the panel 172 is pressed and illuminated. In this DATA SETTING mode, the time duration for which the spray nozzles 50*a*–50*e* and 52*a*–52*e* can be set as desired. The labels "NOZZLES 21, 31", NOZZLES 23, 32" etc. under the "ITEMS TO BE SET" in the leftmost column on the control panel 172 correspond to the spray nozzles as identified under the labels "SPRAY NOZZLES" on the screen image of FIG. 12. The labels "1ST ON", "OFF" and "2ND ON" to the right of the nozzle identification labels respectively indicate the time duration for which the appropriate nozzles are initially open, the time duration for which the nozzles are closed, and the time duration for which the nozzles are open after the closure. The item that can be currently set is shifted in the vertical direction by pressing keys "▽" and "Δ" provided below a ten-key section on the control panel 172. For each selected item, a numerical value representative of a time duration is entered through appropriate numeral keys in the ten-key section. By pressing a switch/light portion "WRITE", the entered numerical value is set as the CURRENT VALUE. Described in detail referring to the example of FIG. 10, the time $t_1$ is set for the item "NOZZLES 22, 32 1ST ON" which corresponds to the spray nozzle 50*b*, and the times $t_2$, $t_3$ and $t_4$ are set for the items "NOZZLES 23, 33 1ST ON", "NOZZLES 23, 33 OFF" and "NOZZLES 23, 33 2ND ON" which correspond to the spray nozzle 50*c*. Further, the time $t_5$ is set for the item "NOZZLES 24, 34 1ST ON" which corresponds to the spray nozzle 50*d*. For the other items, zero "0" is set for all the four digits of the numerical value, as "0.000". In determining the final time durations to be set as the CURRENT VALUES, it is recommended to test-operate the cleaning apparatus 10 with tentatively determined time durations, and check if the desired area on the strip 14 is coated with the lubricant. Optimum values to be set as the CURRENT VALUES can be determined according to the test result. After the time durations have been set as the CURRENT VALUES for all the items, a switch/light portion "SET CURRENT VALUE" is pressed and illuminated, whereby the CURRENT VALUES are set as SET VALUES, which are effective to the spray nozzles 50*a*–50*e*, 52*a*–52*e*. Then, a switch/light portion "WRITE" is pressed to store the SET VALUES in the RAM of the controller 66 in relation to the PART NO. 77. On the control panel 172, the presently effective time durations are indicated as the SET VALUES, which are equal to the CURRENT VALUES immediately after the switch/light portion "SET CURRENT VALUE" is pressed. The initial SET VALUE for each item is "0.000". Usually, the time durations are set for both the upper coating device 50 and the lower coating device 52. However, the individual spray nozzles 50*a*–50*e*, 52*a*–52*e* to be used are selectable in the SELECTION mode of FIG. 12 with the switch/light portion "selection" turned ON. Therefore, for instance, only the upper spray nozzles 50*a*–50*e* or the lower spray nozzles 52*a*–52*e* may be selected to coat only the upper or lower surface of the strip. The time duration $t_0$ indicated above by reference to FIG. 10 is set independently of the time durations for the individual spray nozzles.

In operation of the cleaning apparatus 10, the controller 66 reads the data entered in the SELECTION and DATA SETTING modes and stored in the RAM, according to the PART NO. received from the pressing machine 174 (FIG. 2). Described in detail, the selected vacuum cleaner units 106*a*, 106*b*, 106*c* are activated to suck up the foreign matters from the surfaces of the strip 14. Further, the switch valves 123 and 136 are controlled to place the selected tacky roll device 42, 44 in the lowermost or operative position, and place the non-selected tacky roll device 42, 44 in the uppermost or inoperative position, and the appropriate first or second tacky roll drive motor 124, 140 which corresponds to the selected tacky roll device 42, 44 is activated, so that the foreign matters are removed from the surfaces of the strip 14 by the corresponding tacky rolls 110*a* and 110*b*, or 112*a* and 112*b*. For the lubricant spray nozzles 50*a*–50*e*, 52*a*–52*e*, the electromagnetic valves of the electromagnetic valve units 156, 158 are suitably opened and closed so that the lubricant is sprayed from the selected spray nozzles 50*a*–50*e*, 52*a*–52*e*, for the time durations set in the DATA SETTING mode of FIG. 13, whereby the desired area of the strip 14 is coated with the lubricant.

Figure 44:
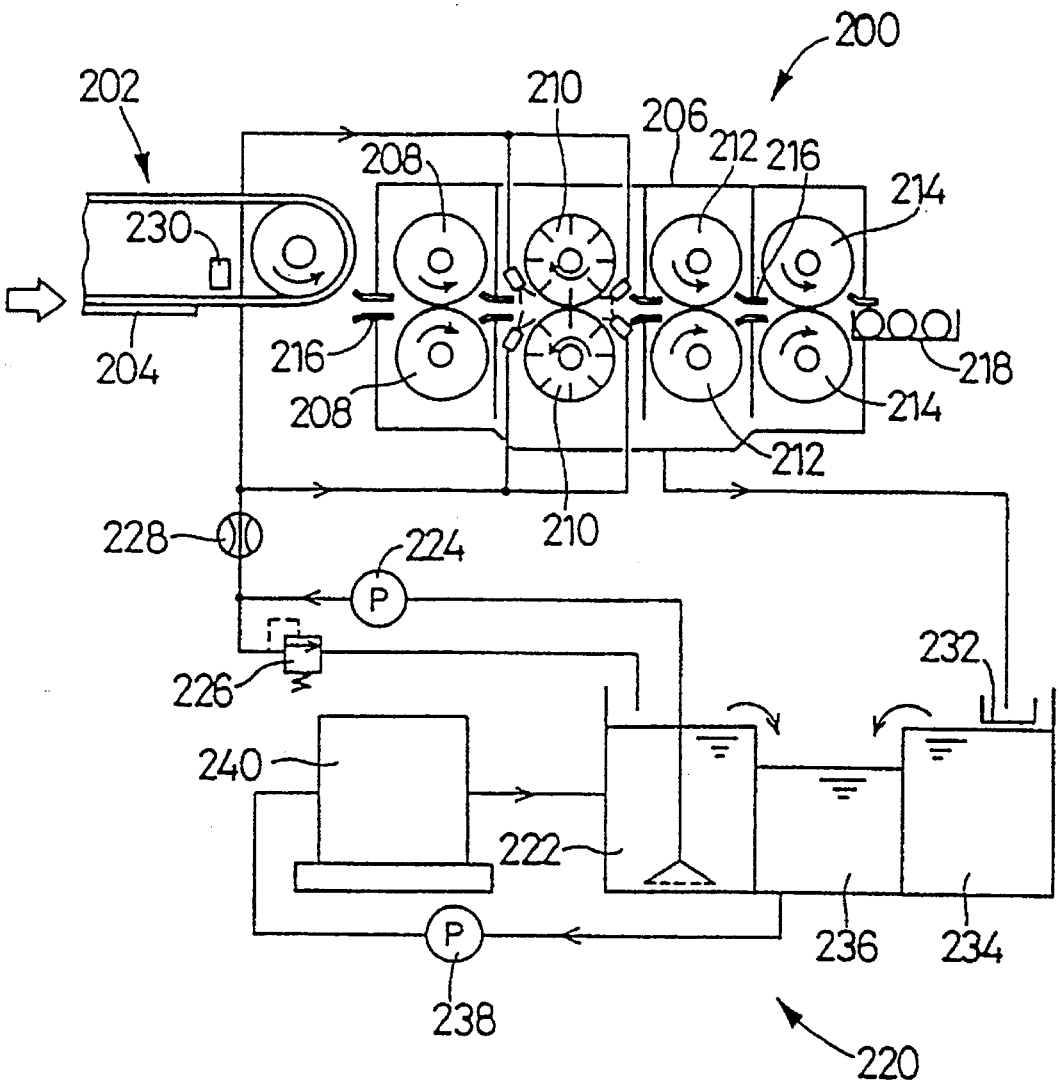
FIG. 44 PRIOR ART
FIG. 44 is a schematic view showing an example of a known apparatus for cleaning strips.

As described above, the cleaning apparatus 10 constructed according to the present embodiment of the invention is adapted such that the oil adhering to the strip 14 is first absorbed by the de-oiling rolls 34*a*, 34*b*, and the foreign matters deposited on the strip 14 are then removed by suction by the vacuum cleaner units 106*a*, 106*b*, 106*c* and by contact of the strip 14 with the tacky rolls 110*a*, 110*b*, 112*a*, 112*b* of the tacky roll devices 42, 44. Unlike the conventional cleaning apparatus of FIG. 44 using a washing oil, the present cleaning apparatus 10 does not use such a washing oil, whereby the operating environment of the present apparatus is considerably improved. Further, the present apparatus 10 does not require a reservoir and a filtering device for the washing oil, whereby the apparatus is made small-sized and compact and the required installation space is accordingly reduced. Moreover, the present cleaning apparatus 10 which does not use brush rolls is capable of effectively cleaning the workpiece, without scratching or otherwise damaging the workpiece, even when the workpiece is made of a soft material such as aluminum.

In the present embodiment, the lubricant used to cut the blank into the strips 14 is removed from the strips 14 before the strips 14 are cleaned by the vacuum cleaner units 106 and the tacky roll devices 42, 44. This arrangement permits more effective removal of the foreign matters from the strips, than the conventional apparatus adapted to brush the workpiece while applying a washing oil. In the absence of the lubricant or washing oil upon removal of the foreign matters, the vacuum cleaner units 106 and the tacky roll devices 42, 44 provide a sufficient high cleaning effect even when the feeding speed of the strip 14 is relatively high. The absence of the oil reduces a possibility that the dirt once removed from the strip is transferred back to the cleaned strip during passage through the apparatus. In addition, the removal of the foreign matters using the vacuum cleaner units 106 and the tacky roll devices 42, 44 rather than brush rolls further reduces the possibility of transfer of the foreign matters back to the cleaned workpiece strip 14. Further, the foreign matters removed by the vacuum cleaner units 106 and the tacky roll devices 42, 44 may be readily analyzed for eliminating the source of the foreign matters deposited on the workpiece.

It is also appreciated that the tacky roll devices 42, 44 are assigned to remove such foreign matters that cannot be or have not been removed by the vacuum cleaner units 106, whereby the amount of the foreign matters to be removed by the tacky roll devices 42, 44 is considerably smaller, and the expected service life of the tacky rolls 110*a*, 110*b*, 112*a*, 112*b* is relatively long, leading to a prolonged interval of replacement or cleaning of the tacky rolls. Moreover, the use of the two tacky roll devices 42, 44 for alternate use permits the contaminated tacky rolls 110*a*, 110*b*, 112*a*, 112*b* to be cleaned or replaced with new ones during operation of the pressing system, whereby the operating efficiency of the pressing system is improved.

It is noted that if the strips 14 as cleaned were sent to the pressing machine 174 for a drawing or other press forming operation, the products obtained from the strips 14 would be likely to have defects such as fracture due to an insufficient amount of slip between the strips 14 and the punch and die. In view of this problem, the present cleaning apparatus 10 is equipped at its downstream end with the lubricant coating device 142 for applying a lubricant to a selected area of the strip 14 such as an area which contacts a pressure pad (blank holder pad) provided on the pressing machine. The lubricant applied to the strip prevents defects on the products obtained from the workpiece strip. The lubricant coating device 142 having the spray nozzles 50*a*–50*e*, 52*a*–52*e* is capable of selecting the area of the strip to which the lubricant is applied, so that only the desired area is coated with the lubricant. This arrangement reduces a possibility that the cleaned strip absorbs the foreign matters during its transfer to the pressing machine 174. The conventional cleaning apparatus leaves an oil film over the entire area of the workpiece strip.

In the present embodiment, the selection of the vacuum cleaner units 106*a*, 106*b*, 106*c*, tacky roll devices 42, 44 and spray nozzles 50*a*–50*e*, 52*a*–52*e* and the setting of the lubricant spray times can be easily effected through the single, compact operator's control panel 172, rather than two or more exclusive setting and indicator devices conventionally used for the individual components of the cleaning apparatus.

While the first embodiment of the present invention has been described above in detail, the embodiment may be suitably modified as described below.

In the above embodiment, only one pair of de-oiling rolls 34*a*, 34*b* is provided to absorb the lubricant remaining on the strip 14. If the workpiece is coated with an anti-rust oil, two or more pairs of de-oiling rolls may be provided as needed. Further, the de-oiling rolls may have suction passages formed through their core portion, for vacuum-discharging the oil absorbed in the outer unwoven fabric portion. Alternatively, a suitable blower is provided upstream of the de-oiling rolls, to blow off the oil.

While the de-oiling roll 34*a* is driven by the feeding motor 56, the roll 34*a* need not be driven. In this case, the roll 34*a* is rotated by contact of the strip 14 fed by the pinch rolls 36*a*, 40*a*. Further, the roll 34*a* may be driven by an exclusive drive motor only while the roll 34*a* is in contact with the leading portion of the strip 14.

In the above embodiment, the vacuum cleaner heads 38*a*, 38*b* are provided with the brush roll 78 and the rubber wiper 80. However, these brush roll 78 and rubber wiper 80 are not essential, and may be replaced by a magnet disposed adjacent to the opening of the suction slot 82, 102, so that the metallic particles are attracted to the magnet. Further, the brush roll 78 may be positively driven by a motor, to wipe the foreign matters toward the opening of the suction slot 82, 102. To improve the vacuum cleaning effect, two or more pairs of vacuum cleaner heads may be provided. Where the amount of foreign matters deposited on the strips 14 is relatively small, the vacuum cleaning device including the cleaner heads 38*a*, 38*b* may be eliminated.

Although each of the suction slots 82, 102 of the cleaner heads 38*a*, 38*b* is divided into three sections, that is, three suction ports 82*a*–82*c*, 102*a*–102*c* which are mutually independently connected to the respective vacuum cleaner units 106*a*, 106*b*, 106*c*, the suction slot 82, 102 may be divided into a larger number of suction ports depending upon the width dimension of the strips 14 of different kinds. If the width dimension of the strips 14 is constant, the suction slot 82, 102 need not be divided into sections. It is also possible to connect all the suction ports 82*a*–82*c*, 102*a*–102*c* to a single vacuum cleaner unit, and provide respective switch valves in respective conduits connecting the suction ports to the vacuum cleaner unit, so that the individual suction ports are rendered operative and inoperative by opening and closing the respective switch valves.

In the above embodiment, the two tacky roll devices 42, 44 are provided so that only one of these two devices is placed in the operative position. However, the two devices 42, 44 may be operated simultaneously to remove the foreign matters. In this case, it is desirable to use three or more tacky roll devices including the devices 42, 44, so that the contaminated tacky roll device may be cleaned or replaced without interruption of the cleaning operation. Further, three or more tacky roll devices may be operated simultaneously to remove the foreign matters from the strip 14.

Although the tacky rolls 110*a*, 110*b*, 112*a*, 112*b* of the tacky roll devices 42, 44 are positively driven by the respective drive motors 124, 140, these tacky rolls may be idler rolls negatively rotated in rolling contact with the strip 14 being fed. The tacky rolls may be positively driven by the motors 124, 140 only while the rolls are in contact with the leading portion of the strip 14.

While the tacky rolls 110*a*, 110*b* are not movable relative to the bearing blocks 122, the upper tacky roll 110*b* may be vertically movable relative to the bearing blocks 122, provided the upper tacky roll 110*b* placed in its lower position does not contact the lower tacky roll 110*a*. In this case, like the pinch rolls 36*b*, 40*b*, the upper tacky roll 110*b* is normally held in its lower position under a biasing force of a spring, and is movable to the upper position against the biasing force of the spring. A similar arrangement is applicable to the upper tacky roll 112*b*.

The tacky roll devices 42, 44 are provided with the planar guides 114, 116 so that the guide 114 or 116 is used to guide the strip 14 when the corresponding tacky roll device 42, 44 is placed in its inoperative or uppermost position. However, the guides 114, 116 may be replaced by a pair of rotatably supported guide rolls through which the strip 14 is passed.

In the cleaning apparatus 10 of the above embodiment is equipped with the lubricant coating device 142. However, this coating device 142 may be eliminated depending upon the kind of the pressing operation performed on the strip 14. It is also possible to provide the punch-and-die assembly of the pressing machine 174 with a lubricating device for applying a lubricant to a desired portion of the strip 14 such as a portion which contacts the pressure pad of the machine 174. The number of the spray nozzles of the nozzle units 50, 52 of the lubricant coating device 142 is not limited to five but may be changed as needed.

In the above embodiment, the spray nozzles 50*a*–50*e*, 52*a*–52*e* are opened and closed on the basis of the moment at which the leading end of the strip 14 is detected by the photoelectric tube 26 provided on the belt feeder 16. However, the photoelectric tube 26 may be disposed within the housing 28 or replaced by other detecting means such as a proximity switch.

The above embodiment is adapted such that the lower pinch roll 46*a* is rotated at a constant speed. Where the lubricant coating device 142 is not provided, in particular, the pinch roll 46*a* may be driven by an exclusive motor such that the feeding speed of the strip 14 after the trailing end of the strip 14 has left the second tacky roll device 44 is increased to shorten the overall cleaning time for the strip 14. In this case, the trailing end of the strip 14 may be detected by a photoelectric tube or other suitable means disposed between the tacky roll device 44 and the pinch roll 46*a*.

Referring next to FIGS. 14–17, there will be described a second embodiment of this invention. In the interest of brevity and simplification, the same reference numerals as used in the first embodiment will be used in this second embodiment to identify the corresponding components.

Figure 14:
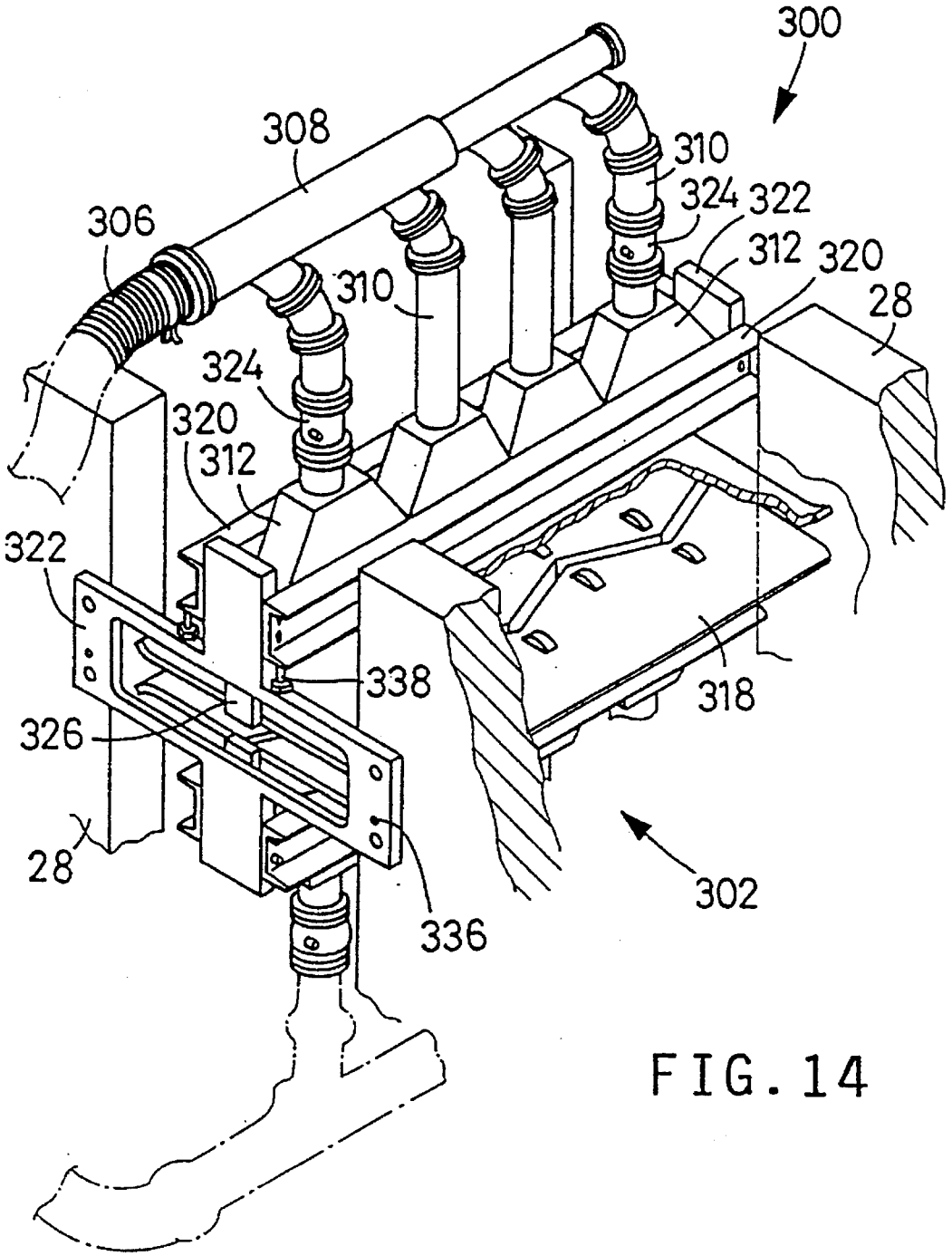
FIG. 14 is a perspective view showing upper and lower vacuum cleaner heads of a vacuum strip cleaning device used in the cleaning apparatus according to another embodiment of this invention.
Figure 15:
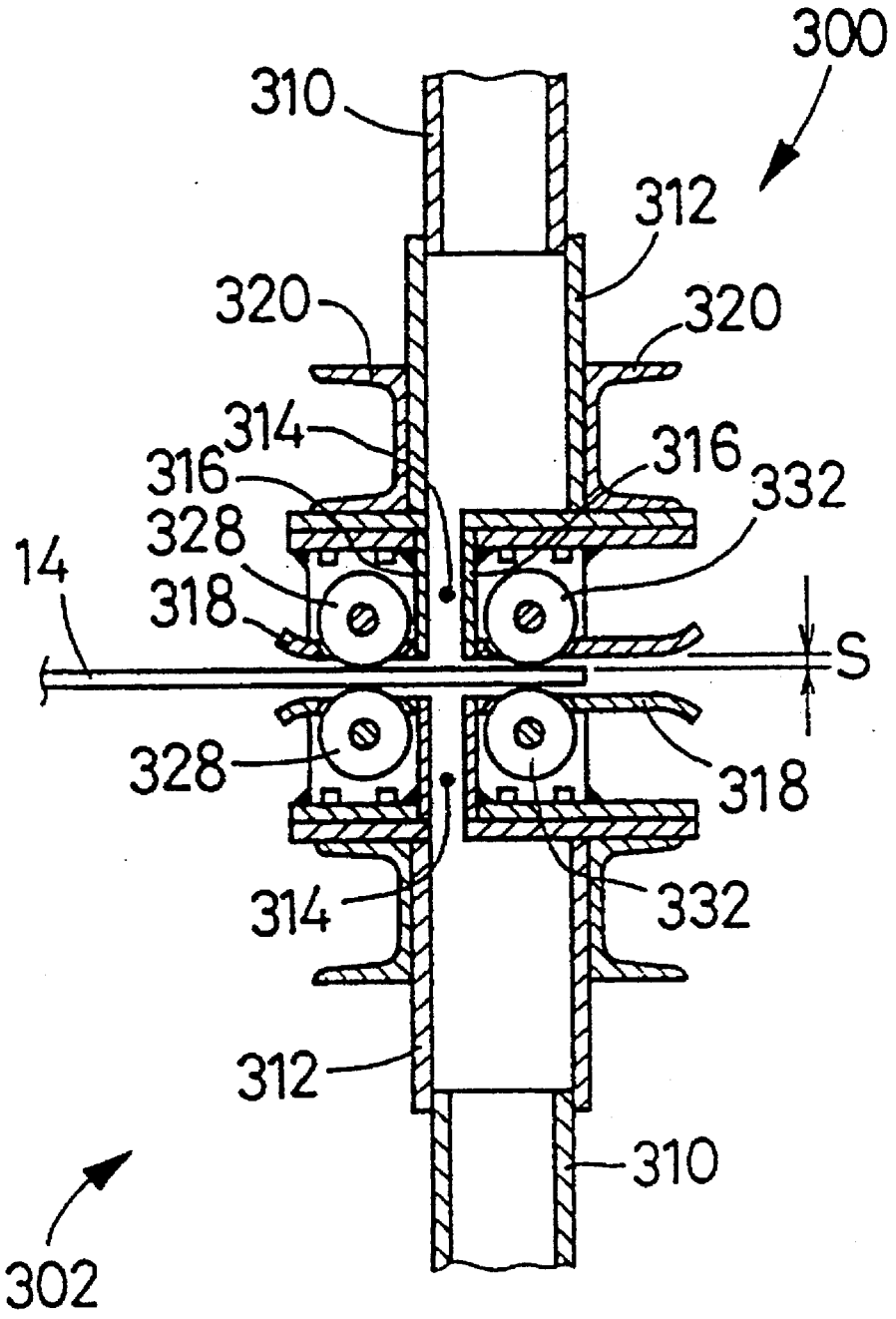
FIG. 15 is an elevational view in cross section of the vacuum cleaner heads of FIG. 14 including respective suction ports.
Figure 16:
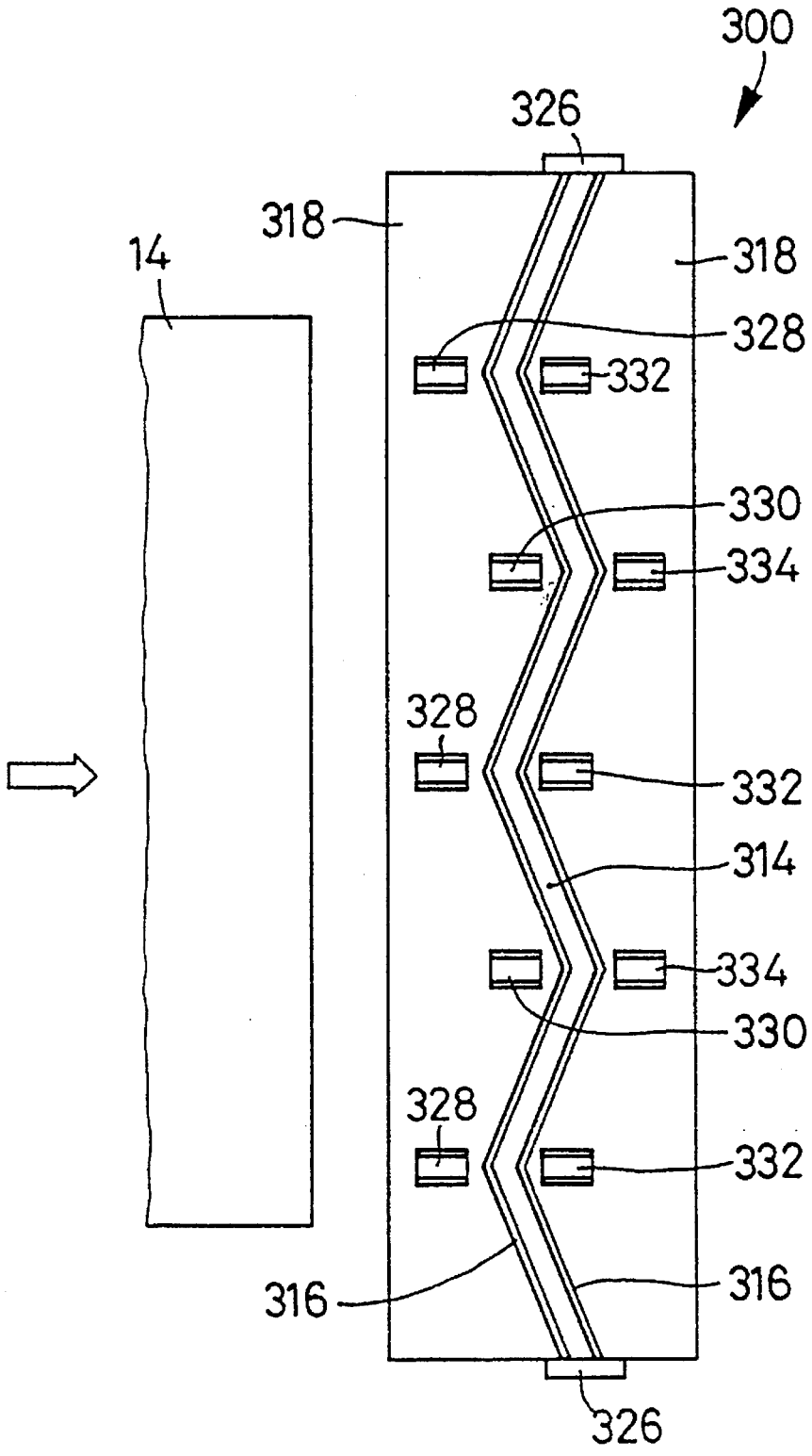
FIG. 16 is a bottom plan view showing the suction port of the upper vacuum cleaner head of FIG. 14.
Figure 17:
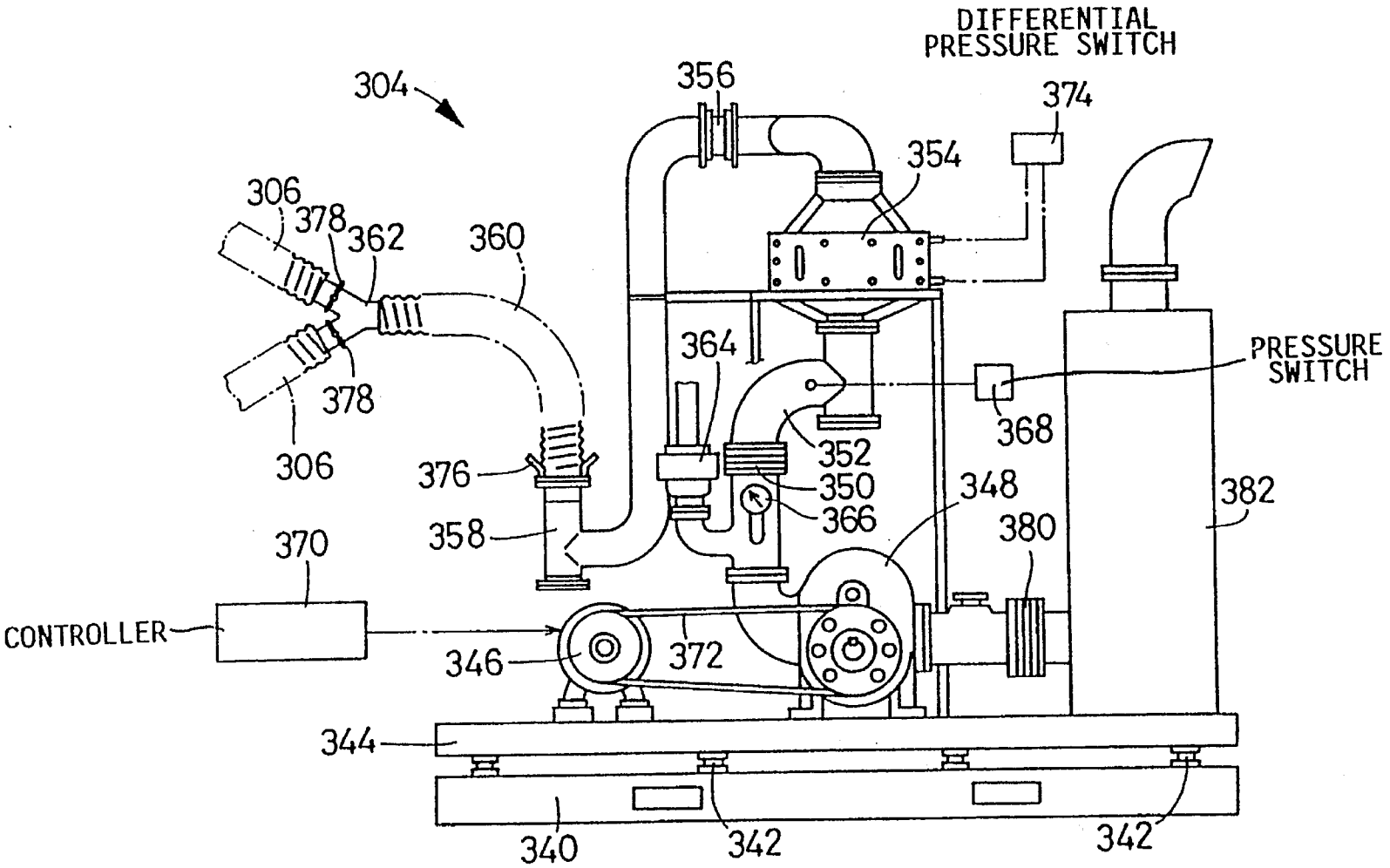
FIG. 17 is a front elevational view showing a vacuum cleaner unit connected to the vacuum cleaner heads of FIG. 14.

The cleaning apparatus according to the second embodiment uses a modified vacuum strip cleaning device as shown in FIGS. 14–17, which includes upper and lower vacuum cleaner heads 300, 302 as illustrated in the perspective view of FIG. 14, and a vacuum cleaner unit 304 illustrated in the front elevational view of FIG. 17. FIG. 15 is an elevational view in vertical cross of the upper and lower vacuum cleaner heads 300, 302, while FIG. 16 is a bottom plan view of the upper cleaner unit 300. The pinch rolls 36*a*, 36*b*, 40*a*, 40*b* are disposed separately from the cleaner heads 300, 302, within the housing 28, for feeding the strip 14 through the housing 28 at a predetermined speed. The upper and lower cleaner heads 300, 302 are identical in construction with each other and disposed symmetrically with respect to the feed path of the strip 14. In this respect, only the upper cleaner head 300 will be described in detail, and detailed description of the lower cleaner head 302 is omitted, in favor of the assignment of the same reference numerals as used for the upper cleaner head 300, to the corresponding major components of the lower cleaner head 302.

The cleaner head 300 includes: a main conduit 308 connected to the vacuum cleaner unit 304 through a pressure-resistant hose 306; four hoods 312 connected to the main conduit 308 through respective four branch conduits 310; a pair of plates 316 secured to the hoods 312 and forming a suction slot 314; and a pair of guide plates 318 secured to the respective plates 316. The four hoods 312 are arranged in a row and fixed to a pair of channeled members 320 which are secured to the housing 28 through respective brackets 322, such that the row of the hoods 312 is perpendicular to the feeding direction of the strip 14, namely, parallel to the leading edge of the strip 14. The branch conduits 310 connected to the two outer hoods 312 are provided with respective ball valves 324, so that the two outer conduits 310 are closed by the ball valves 324 when the width dimension of the strip 14 is relatively small. The ball valves 324 may be either manually operated, or automatically controlled by actuators such as pneumatic cylinders according to a signal from the controller 66. It is noted that the perspective view of FIG. 14 is taken from the upstream side of the apparatus as seen in the feeding direction of the strip 14, which is fed from the right lower portion toward the upper left portion of the view.

The pair of plates 316 which form the suction slot 314 extends generally in the direction perpendicular to the feeding direction of the strip 14, so as to cover the length of the row of the four hoods 312. As shown in FIG. 16, the plates 316 are bent in a regularly zigzag or triangular wave form so that the suction slot 314 has a similar form having three concave or recess portions and two convex or ridge portions as seen in a plane parallel to the surfaces of the strip 14. These alternate recess and ridge portions are concave and convex as seen in the feeding direction of the strip 14 indicated by arrow in FIG. 16. Each convex portion is located between the adjacent concave portions, as seen in the direction perpendicular to the feeding direction of the strip 14. The opposite lateral ends of the suction slot 314 are closed by a pair of side plates 326. The guide plates 318 are secured to the lower ends of the plates 316 such that the guide plates 318 extend in the substantially horizontal direction, that is, substantially in parallel with the strip 14. The strip 14 fed by and from the pinch rolls 36*a*, 36*b* is passed between and guided by the guide plates 318 of the upper and lower cleaner heads 300, 302. The guide plates 318 are plated to prevent damaging of the strip 14.

Between the guide plates 318 and the row of the hoods 312, there are disposed four parallel rows of guide rolls 328, 330, 332, 334, which are parallel to the direction of width of the strip 14. More specifically, the cleaner head 300 has first and second rows of guide rolls 328, 330 on the upstream side of the suction slot 314, and third and fourth rows of guide rolls 332, 334 on the downstream side of the suction slot 314, as indicated in FIG. 16. The guide rolls 328, 330, 332, 334 are partially received in respective apertures formed through the guide plates 318, such that a portion of each guide roll projects by a given distance "S" from the lower surface of the guide plates 318 through the apertures, as shown in FIG. 15. The guide rolls 328 and 332 of the first and third rows are disposed near the concave portions of the suction slot 314, while the guide rolls 330 and 334 of the second and fourth rows are disposed near the convex portions of the suction slot 314. All the guide rolls 328, 330, 332, 334 are supported rotatably about their axes perpendicular to the feeding direction of the strip 14, so that the guide rolls of the upper and lower cleaner heads 300, 302 cooperate to guide the strip 14 therebetween while being rotated in rolling contact with the strip 14, so as to prevent deflection of the strip 14 due to suction by the suction slot 314, thereby assuring high straightness in the feeding direction, even when only the upper or lower cleaner head 300, 302 is used.

It is noted that the zigzag suction slot 314 prevents the leading edge of the strip 14 from reaching the suction slot 14 at one time over the entire length. In other words, the leading edge of the strip 14 first reaches the concave portions of the zigzag suction slot 314, then passes the intermediate portions between the concave and convex portions of the slot 314, and finally reaches the convex portions (rightmost portions as seen in FIG. 16) of the slot 314. It is also noted that the guide rolls 330 and 332 of the second and third rows are positioned between the adjacent local portions of the suction slot 314 as seen in the width direction of the strip 14. More specifically, each of the guide rolls 330 is located between the adjacent concave portions of the suction slot 314, as seen in the direction of width of the strip 14, while each of the guide rolls 332 is located between the adjacent convex portions of the suction slot 314. Thus, the guide rolls 330, 332 are located within the distance of concavity or convexity of the concave and convex portions of the suction slot 314 as measured in the feeding direction of the strip 14. This arrangement is effective to prevent the strip 14, particularly, the leading end portion of the strip 14 from being sucked toward the suction slot 314. When the leading edge of the strip 14 reaches the bent portions of the slot 314 adjacent the guide rolls 332 of the third row, for example, the guide rolls 330 Of the second row which have already contacted the leading end portion of the strip 14 will act to prevent the leading end portion of the strip 14 from being sucked toward the suction slot 314. Similarly, when the leading edge of the strip 14 reaches the bent portions (convex portions) of the slot 314 adjacent the guide rolls 334 of the fourth row, the guide rolls 332 of the third row will function to prevent the leading end portion of the strip 14 from being sucked toward the suction slot 314.

The amount of projection of the guide rolls 328, 330, 332, 334 from the guide plates 318, that is, the clearance "S" between the guide plates 318 and the strip 14 as indicated in FIG. 15 is suitably selected within a range of about 0.5–0.7 mm, for instance, so as to allow an adequate amount of flow of the ambient air through the clearance "S" for permitting the cleaner head 300 to effect a sufficient degree of suction for removing the foreign matters from the strip 14. This clearance "S" in this second embodiment is smaller than that in the first embodiment, that is, about 1–2 mm, because the present vacuum cleaner head 300 is not provided with the brush roll 78 and rubber wiper 80. To protect the strip 14 from being marred by the guide rolls 328, 330, 332, 334, these rolls are plated or formed of a relatively soft material such as polyurethane.

The upper and lower cleaner heads 300, 302 are supported by the housing 28 through the common pair of brackets 322 to which are fixed the opposite ends of the channeled members 320. The brackets 322 are positioned by knock pins 336 relative to the housing 28 such that the upper ends of the guide rolls 328, 330, 332, 334 of the lower cleaner head 302 are substantially aligned with the height of the lower surface of the strip 14 fed by the pinch rolls 36*a*, .36*b*, 40*a*, 40*b*, etc. The brackets 322 are fastened to the housing 28 by a plurality of screws. The lower cleaner head 302 is fixed to the brackets 322 so as to allow leveling of the head 302, while the upper cleaner head 300 is attached to the brackets 322 through the channeled members 320, which have elongate holes which permit the upper cleaner head 300 to be suitably positioned in the vertical direction. The brackets 322 have height adjusting screws 338 which are used for leveling and height adjustment of the upper cleaner head 300. The height of the upper cleaner head 300 is adjusted depending upon the thickness of the strip 14, so that the guide rolls 328, 330, 332, 334 of the head 300 contact the upper surface of the strip 14. Each bracket 322 has the two height adjusting screws 338 which are spaced apart from each other in the feeding direction of the strip 14 and which are adjusted independently of each other. When the cleaner heads 300, 302 are removed from the housing 28 to clean the interior of these heads, the screws connecting the brackets 322 to the housing 28 are removed, and the heads 300, 302 can be easily removed owing to the flexible property of the pressure-resistant hoses 306 which connect the cleaner heads 300, 302 to the vacuum cleaner unit 304.

The vacuum cleaner unit 304 shown in FIG. 17 is mounted on a second base 344 which rests on a first base 340 through a plurality of elastic dampers 342. The cleaner unit 304 includes a blower 348 driven by a motor 346. The suction side of the blower 348 is connected to a pressure-resistant hose 360 through a flexible joint 350, a conduit 352, a filter 354, a check valve 356, and a conduit 358. To one end of the pressure-resistant hose 360, there is connected a Y-joint 362 to which are connected the pressure-resistant hoses 306, which in turn are connected to the conduits 308 of the upper and lower cleaner heads 300, 302. The exhaust side of the blower 348 is connected through a flexible joint 380 to a silencer or muffler 382 for damping the exhaust air noise.

The blower 348 is provided with a vacuum safety valve 364 and a pressure gage 366. A pressure switch 368 is connected through a soft tube to the conduit 352, to measure the pressure (reduced pressure) in the conduit 352. The pressure switch 368 generates an alarm signal if the pressure in the conduit 352 is 500 $mmH_2O$ or lower, or if the pressure is 3000 $mmH_2O$ or higher. The alarm signal if generated is applied to a controller 370. If the pressure in the conduit 352 is 500 $mmH_2O$ or lower, a belt 372 connecting the blower 348 to the motor 346 is considered to be broken or otherwise defective. If the pressure is 3000 $mmH_2O$ or higher, the suction line between the conduit 352 and the cleaner heads 300, 302 is considered to be plugged or closed somewhere. The controller 370 turns off the motor 346 upon receiving the alarm signal from the pressure switch 368. The controller 370 incorporates a microcomputer adapted to control the motor 346 according to a stored program.

The filter 354 is provided to remove comparatively fine particles of dust or dirt and oily components contained in the air stream from the cleaner heads 300, 302. To detect clogging of the filter 354, a differential pressure switch 374 is connected across the filter 354. The differential pressure switch 374 applies an alarm signal to the controller 370 if the differential pressure across the filter 354 exceeds a predetermined threshold, for example, 80 $mmH_2O$. The threshold value is selectable within a range of 0–200 $mmH_2O$, for instance. In this case, too, the controller 370 turns off the motor 346. In the present example, the initial differential pressure of the new filter 354 detected by the switch 374 is about 5 $mmH_2O$.

The check valve 356 is provided to prevent a flow of the air in the direction from the filter 354 toward the cleaner heads 300, 302. The conduit 358 is used to facilitate disconnection of the pressure-resistant hose 360 from the vacuum cleaner unit 304. The conduit 358 is equipped with a clamp 376 which is easily operated to effect connection between the conduit 358 and the hose 360. The Y-joint 362 is equipped with two flow regulating plate dampers 378 corresponding to the two pressure-resistant hoses 306. The dampers 378 are adjusted to regulate the suction pressures of the upper and lower cleaner heads 300, 302 independently of each other, depending upon the width dimension of the strip 14 to be cleaned. Where appropriate, one of the dampers 378 is fully closed so that only the upper or lower cleaner head 300, 302 is used to clean only the upper or lower surface of the strip 14 in the present embodiment, the dampers 378 are manually operated. However, the dampers 378 are automatically controlled by means of ball valves, for example, by the controller 370.

Like the controller 66 used in the first embodiment, the controller 370 used in the present second embodiment is adapted to receive various signals such as those from the photoelectric tube 26 and the pressing machine 174, and holds the blower motor 346 as well as the feeding motor 56 in the operated state as long as the cleaning apparatus is in operation, so that the strip 14 fed between the upper and lower cleaner heads 300, 302 is cleaned to remove the foreign matters from the surfaces of the strip 14, under suction through the suction slots 314. Since the vacuum cleaner unit 304 is held on with the blower 348, etc. operating at a relatively elevated temperature, the cleaner unit 304 is installed at a suitable location, and is provided with a suitable protective cover as needed, to protect the user against contact with the high-temperature components.

In the present second embodiment of FIGS. 14–17, the suction slot 314 of each cleaner head 300, 302 has a zigzag or triangular wave form having the concave and convex portions as seen in the feeding direction of the strip 14. In addition, the cleaner heads 300, 302 have the guide rolls 328, 330, 332, 334 which cooperate to hold the strip 14 spaced apart from the guide plates 318, i.e., from the openings of the suction slots 314, by the predetermined distance "S". The guide rolls 328, 330, 332, 334 include the rolls 330, 332 each of which is located between the adjacent local portions (concave and convex portions) of the suction slots 314, as seen in the direction of width of the strip 14. In other words, the guide rolls 330, 332 are located within the distance of concavity or convexity of the concave and convex portions of the zigzag slots 314 as measured in the feeding direction of the strip 14. This arrangement prevents the strip 14 from being deflected toward the openings of the suction slots 314 by suction forces by the cleaner unit 304, thereby effectively avoiding interference of the strip 14 with the plates 316 and/or guide plates 318, and/or deterioration of the function of the cleaner heads 300, 302 of removing the foreign matters from the strip 14 by suction through the suction slots 314. In the absence of the guide rolls 328, 330, 332, 334, in particular, the rolls 330, 332, the strip 14 in the form of a very thin strip or a soft strip such as an aluminum strip would be deflected toward the suction slots 314 due to the suction forces, in particular when only the upper or lower cleaner head 300, 302 is used. This tendency may cause the leading end of the strip 14 to interfere with the lower edge of the downstream one of the two plates 316 which define the slot 314, or may cause the intermediate portions of the strip 14 to be fed in sliding contact with the guide plates 318. In these cases, the strip 14 may be deformed at its leading end portion or scratched or otherwise marred at its intermediate portion. Further, the absence of the guide rolls reduces the clearance "S" between the cleaner heads 300, 302 and the upper and lower surfaces of the strip 14, whereby the amount of the ambient air introduced into the suction slots 314 would be reduced, leading to reduced air flow through the suction slots 314 and accordingly lowered function of the cleaner heads 300, 302 of removing the foreign matters from the strip 14. In fact, however, the cleaner heads 300, 302 is equipped with the guide rolls including the rolls 330, 332 disposed within the distance of concavity or convexity of the concave and convex portions of the suction slots 314 as measured in the feeding direction of the strip 14, so that the strip 14 is suitably guided while being spaced from the lower open ends of the slots 314 by the predetermined clearance "S". Thus, the present vacuum strip cleaning device 300, 302, 304 is free from the problems indicated above.

Since the present second embodiment-is free from the interference between the strip 14 and the cleaner heads 300, 302, the suction capacity of the vacuum cleaner unit 304 can be increased as compared with the vacuum cleaner units 106 used in the first embodiment. As a result, the cleaning capacity of the present vacuum cleaning device 300, 302, 304 can be improved, and the contamination of the downstream pinch rolls 40*a*, 40*b* can therefore be reduced. Further, the amount of the foreign matters to be removed by the first and second tacky roll devices 42, 44 can be reduced, whereby the expected life of the tacky rolls 110*a*, 110*b*, 112*a*, 112*b* during which they exhibit the intended cleaning effect can be accordingly prolonged. As explained above, the guide rolls 328, 330, 332, 334 are effective to assure a sufficient cleaning effect without deflection of the strip 14 toward the suction slot 314, even when only one of the upper and lower cleaner heads 300, 302 is used to remove the foreign matters from only the upper or lower surfaces of the strip 14.

Since the strip 14 is guided by the guide rolls 328, 330, 332, 334, the vacuum cleaner unit 304 is simply turned off when it is not necessary to operate the cleaner heads 300, 302 (to clean the strip 14 by vacuum). In other words, the second embodiment does not require the cleaner heads to be moved away from each other, as in the first embodiment wherein the cleaner heads 38*a*, 38*b* are moved away from each other to avoid the contact of the brush rolls 78 and rubber wipers 80 with the strip 14.

When the workpiece is in the form of a steel coil strip, the coil strip tends to be easily sucked toward the suction slot of the cleaner head if the suction force is increased. The present cleaner heads 300, 302, however, are capable of effectively removing the foreign matters from the coil strip without damaging thereof even with a relative large suction force acting on the strip.

While each cleaner head 300, 302 used in the second embodiment described above uses a total of four rows of guide rolls 328, 330, 332, 334 on the opposite sides of the suction slot 314, the cleaner head 300, 302 may use only the second and third rows of guide rolls 330, 332 or only the second row of guide rolls 330, each of these rolls 330, 332 being located between the adjacent concave portions of the suction slot 314 in the direction of width of the strip 14. Although the first row consists of the two guide rolls 330 while the third row consists of the three guide rolls 332, each of these rows may consist of only one guide roll 330, 332. The suction slot 314 need not have a zigzag or triangular wave form as seen in the plane parallel to the strip 14, and may have a sine-wave form having concave and convex portions as shown in FIG. 19.

It is also possible that additional cleaner heads other than the cleaner heads 300, 302 are provided such that the suction slots of the additional cleaner heads are open so as to face the outer circumferential surfaces of the pinch rolls 36*a*, 36*b* and 40*a*, 40*b* disposed on the opposite sides of the cleaner heads 300, 302. These additional cleaner heads are connected to the vacuum cleaner unit 304 through suitable switching means for selectively connecting the cleaner heads 300, 302 and the additional cleaner heads to the vacuum cleaner unit 304. When the cleaner heads 300, 302 are not used, the switching means is operated to connect the additional cleaner heads to the cleaner unit 304, so as to remove the foreign matters deposited on the outer circumferential surfaces of the pinch rolls 34*a*, 34*b*, 40*a*, 40*b*.

In the second embodiment, the suction slot 314 of each cleaner head 300, 302 is formed so as to extend generally in the direction perpendicular to the feeding direction of the strip 14. However, the suction slot may extend in a direction inclined at a desired angle with respect to the direction of width of the strip 14, for example, in a direction parallel to the leading edge of the strip 14 which is inclined at a given angle with respect to the direction of width. Further, the configuration or form of the suction slot as seen in the plane parallel to the strip 14 may be suitably modified provided that the form has alternate concave and convex portions as seen in the feeding direction of the strip 14.

Figure 18:
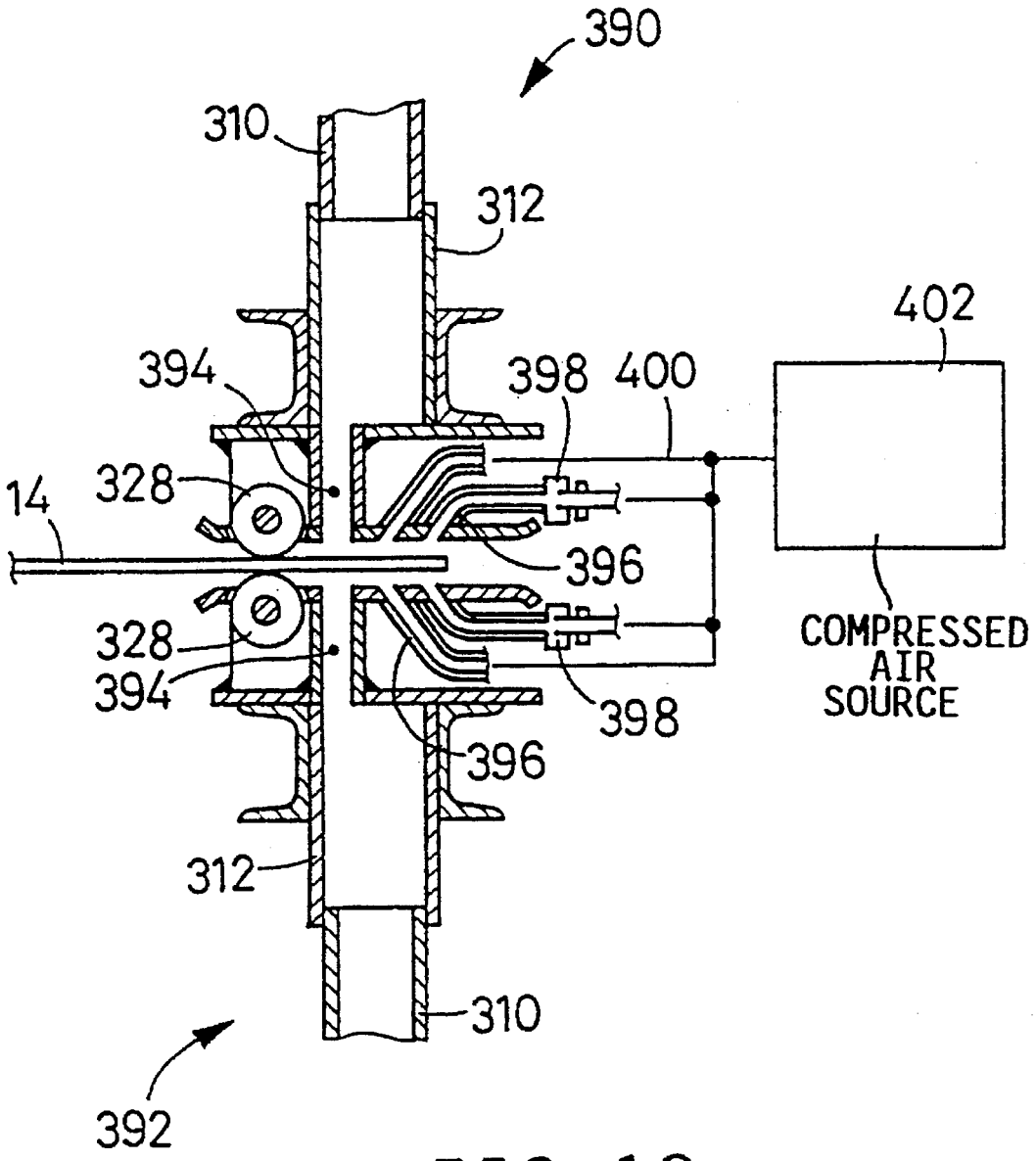
FIG. 18 is an elevational view in cross section of vacuum cleaner heads of a modified vacuum strip cleaning device used in a further embodiment of the present invention.
Figure 19:
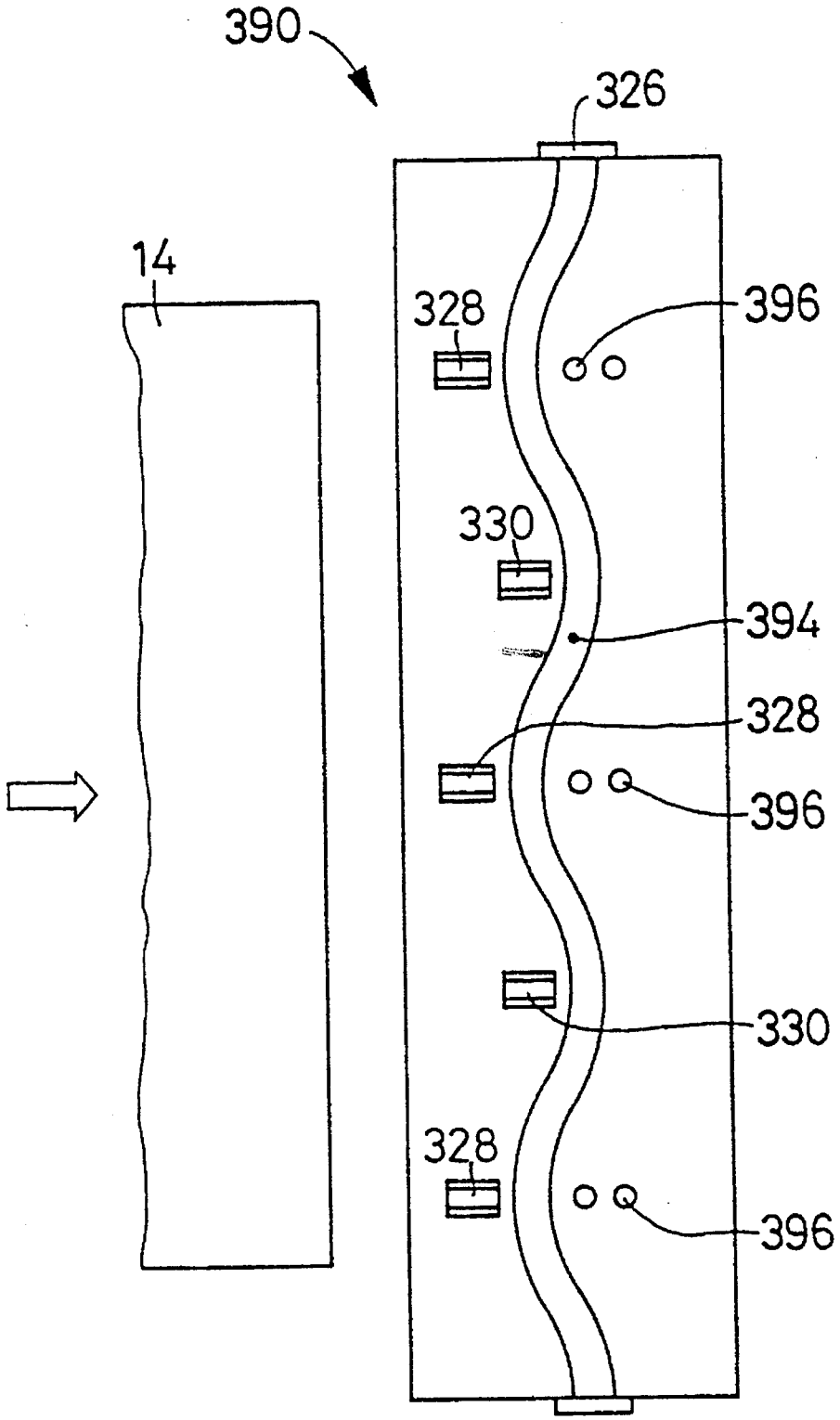
FIG. 19 is a bottom plan view showing the suction port of the upper vacuum cleaner head of FIG. 18.

Referring next to FIGS. 18 and 19, which correspond to FIGS. 15 and 16, there will be described a third embodiment of this invention using a vacuum strip cleaning device which is modified from that of the second embodiment of FIGS. 14–17. The vacuum strip cleaning device used in the present third embodiment includes upper and lower cleaner heads 390, 392 similar to the cleaner heads 300, 302 of the second embodiment, except for their end portions adjacent the feed path of the strip 14. That is, each cleaner head 390, 392 has a suction slot 394 which has a sine-wave form having alternate arcuate concave and convex portions, as seen in the plane parallel to the strip 14 and as seen in the feeding direction of the strip 14, as shown in FIG. 19. Further, the cleaner head 390, 392 has only two rows of guide rolls 328, 330 disposed on the upstream side of the suction slot 394, and three pairs of air nozzles 396 are disposed on the downstream side of the suction slot 394, in place of the guide rolls 332 provided in the second embodiment. These three pairs of air nozzles 396 are disposed adjacent to the three concave portions of the suction slot 394, and correspond to the guide rolls 328, 330. Each air nozzle 396 is adapted to apply a compressed air stream to the strip 14, such that the compressed air stream is against the feeding direction of the strip 14. The angle of the air stream path relative to the downstream portion of the strip 14 is selectable within a range of about 5–30 degrees. The applied compressed air stream acts to blow the foreign matters such as dust and dirt and oily substances deposited on the corresponding surface of the strip 14, toward the opening of the suction slot 394. The angle of the air stream path is adjusted so that the air stream is effectively sucked into the suction slot 394, together with the foreign matters removed thereby. However, the air nozzles 396 is fixedly oriented so that the path of the air stream provided by each nozzle 396 has a predetermined constant angle relative to the feed path of the strip 14. The individual air nozzles 396 are connected to a compressed air source 402 through respective couplings 398 and plastic tubes 400, so that compressed air is supplied from the source 402 to the air nozzles 396. The air nozzles 396 are easily disconnected from the plastic tubes 400 by simple manipulation of the couplings 398. The compressed air source 402 may be an blower or compressor with a flow regulator, and is activated to feed the compressed air to the air nozzles 396 only while the strip 14 is passed between the upper and lower cleaner heads 390, 392. The operation of the compressed air source 402 is controlled on the basis of a signal generated by a photoelectric tube, proximity switch or other detector means, which is adapted to detect the passage of the leading end of the strip 14 past the pinch rolls **36*a*, 36*b*, or the passage of the trailing end of the strip 14 past the pinch rolls 40*a*, 40*b*. The compressed air source 402 and the air nozzles 396** constitute a principal portion of an air blower device.

In the cleaner heads 390, 392 according to the third embodiment, the guide rolls 328, 330 disposed on the upstream side of the suction slots 394 function to guide and position the strip 14, while the air nozzles 396 disposed on the downstream side of the suction slots 394 serve to blow compressed air streams against the surfaces of the strip 14. Therefore, the strip 14 is prevented from being sucked toward the openings of the suction slots 394 under suction by the vacuum cleaner unit 304, whereby the strip 14 is protected against deformation or damage due to interference with the cleaner heads 390, 392, while at the same time the reduction in the vacuum cleaning effect of the heads 390, 392 is suitably avoided. Thus, the cleaner heads 390, 392 have the same advantages as the cleaner heads 300, 302 of the second embodiment. Further, the compressed air streams applied to the strip 14 increase the vacuum cleaning effect to remove the dirt and dust, oily substances and other foreign matters from the surfaces of the strip. Since the foreign matters separated from the strip 14 by the applied air steam are sucked into the suction slots 394, the operating environment of the cleaning apparatus will not be contaminated.

In the third embodiment described above, the air nozzles 396 are disposed on the downstream side of the sine-wave suction slots 394 and adjacent the concave portions of the slots 394. Where the suction slots are formed substantially straight in parallel with the leading edge of the strip 14, that is, extend in the direction perpendicular to the feeding direction of the strip 14, the air nozzles 396 may be open in the suction slots 394, at positions adjacent the openings of the slots 394, so that the compressed air is blown toward the strip 14 through the slots 394. It is also possible that the air nozzles are disposed on the upstream side of the suction slots 394 while the guide rolls are disposed on the downstream side of the slots 394. Further, each pair of air nozzles 396 may be replaced by a single air nozzle 396. The discrete air nozzles 396 may be replaced by a single-nozzle tube which is disposed along the suction slot 394 and which has an air nozzle in the form of a straight slit covering the entire width of the strip 14.

While the above third embodiment uses the couplings 398 for selecting the air nozzles 396 to be connected to the plastic tubes 400, depending upon the width dimension of the strip 14, the couplings 398 may be replaced by switch valves which are opened and closed to connect the desired air nozzles 396 to the compressed air source 402. In this case, the switch valves may be automatically controlled according to the kind of the strip 14 which has a specific width dimension.

Figure 20:
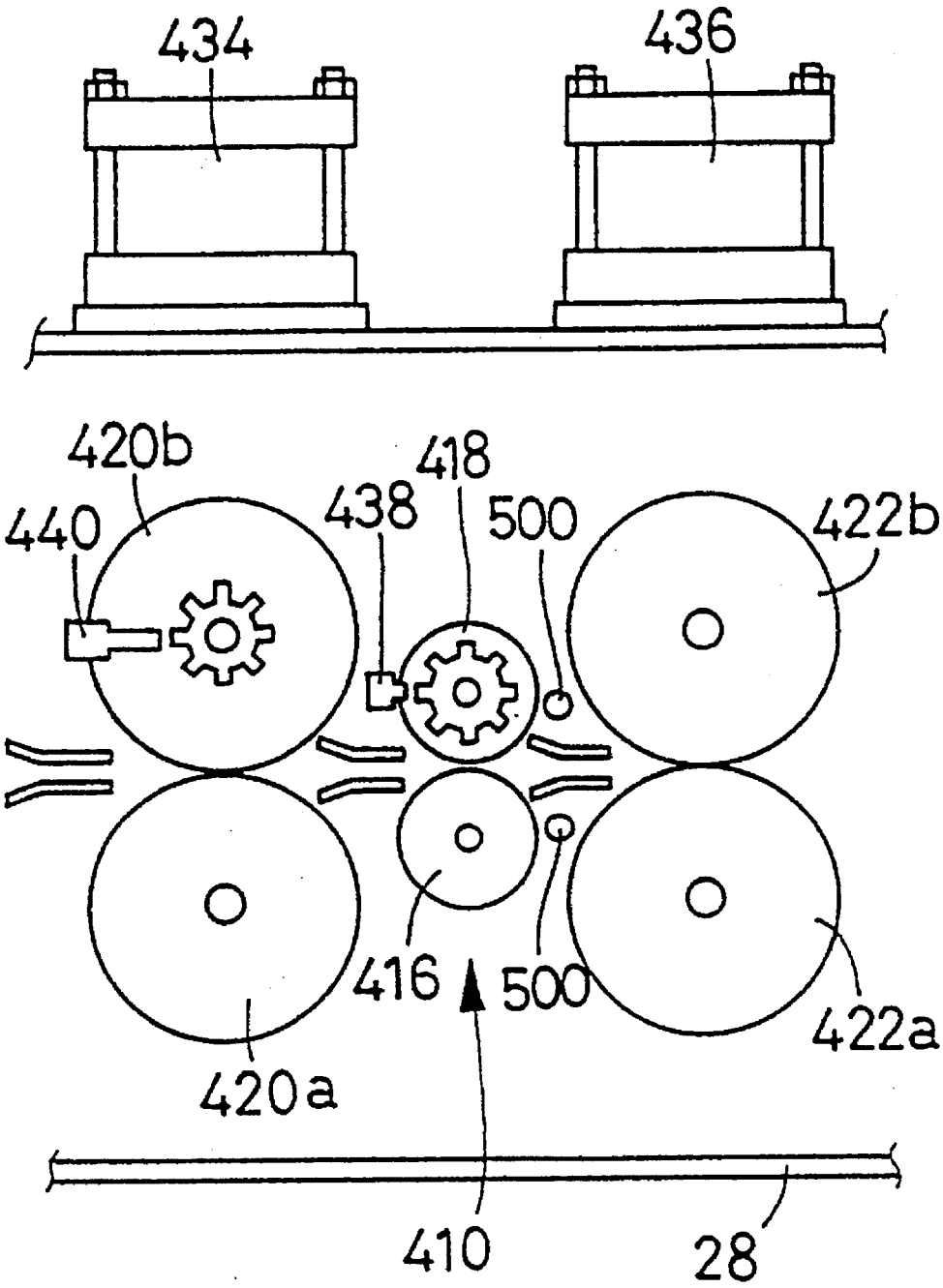
FIG. 20 is a schematic view showing a modified form of tacky roll devices used in a still further embodiment of this invention.
Figure 21:
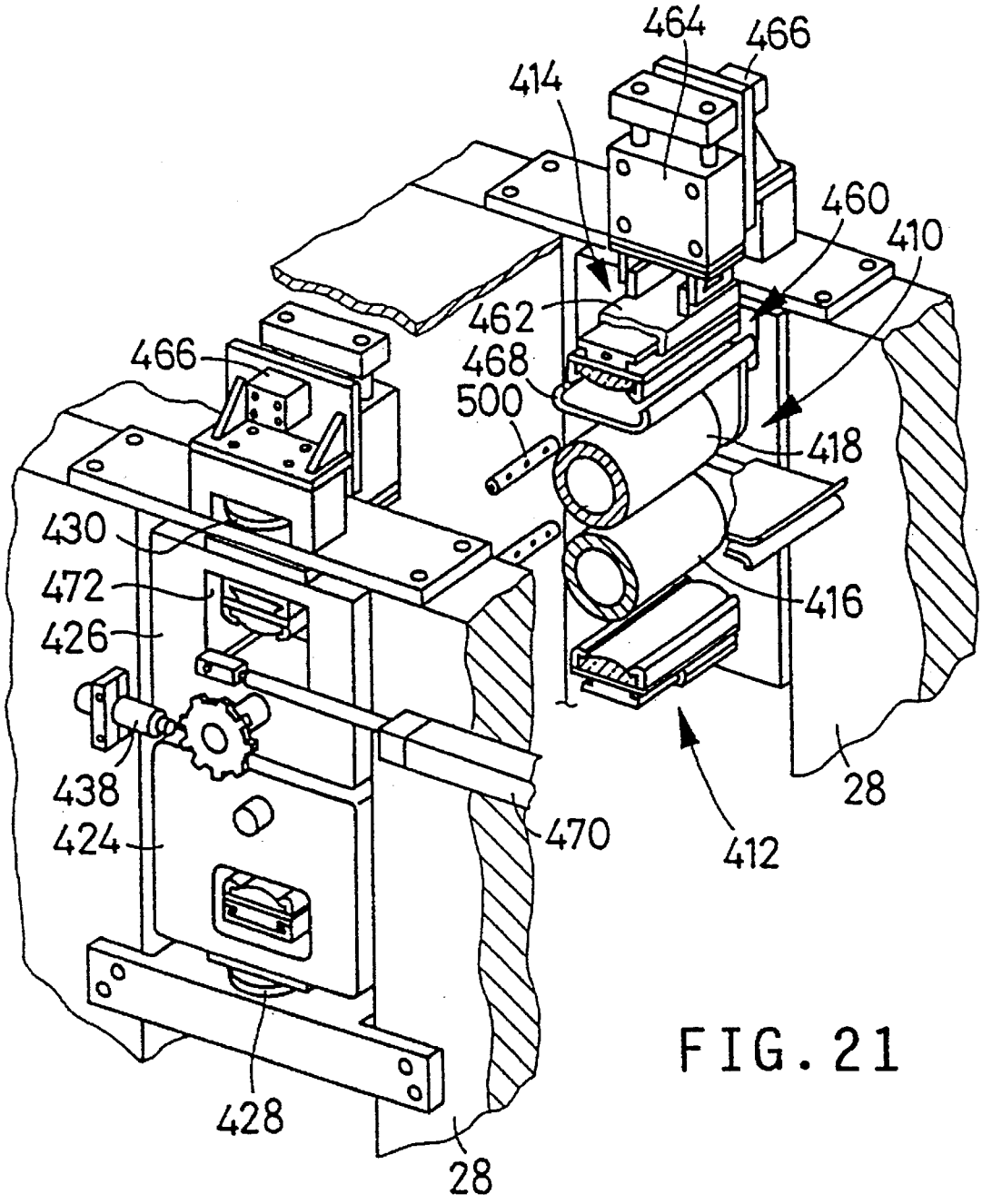
FIG. 21 is a perspective view of the tacky roll devices of FIG. 20.

Next, a fourth embodiment of the present invention will be described by reference to FIGS. 20–28. This embodiment has a modified tacky roll device 410 as shown in the schematic view of FIG. 20, together with neighboring components. The tacky roll device 410 is also shown in the perspective view of FIG. 21 taken from the upstream side as seen in the feeding direction of the strip 14. The perspective view of FIG. 21 also shows a pair of roll cleaning devices 412, 414 which will be described. The tacky roll device 410 includes a pair of tacky rolls 416 and 418, which are rotatably supported in the housing 28 such that there is a predetermined small clearance which is smaller than the thickness of the strip 14 by about 0.2 mm between the two tacky rolls 416, 418. The lower and upper tacky rolls 416, 418 are adapted to contact the corresponding lower and upper surfaces of the strip 14 when the strip 14 is fed by pinch rolls **420*a*, 420*b*, 422*a*, 422*b* in the rightward direction as seen in FIG. 20. As a result of rolling contact of the tacky rolls 416, 418 with the surfaces of the strip 14, the foreign matters on the strip 14 are transferred to the tacky rolls 416, 418. The tacky rolls 416, 418 are supported by the housing 28 through bearing blocks 424, 426**, such that the tacky rolls 416, 418 are movable in the vertical direction. The height of the tacky rolls 416, 418 can be adjusted by moving the bearing blocks 424, 426 by rotating height adjusting dials 428, 430, which are connected to respective feedscrews associated with the bearing blocks 424, 426. The lower pinch rolls 420*a*, 422*a* are rotated synchronously by the feeding motor 56 (described with respect to the first embodiment), via a belt 432 (FIG. 22), to feed the strip 14 at a predetermined constant speed. On the other hand, the upper pinch rolls 420*b*, 422*b* are pressed against the lower pinch rolls 420*a*, 422*a* by respective pneumatic cylinders 434, 436. The upper tacky roll 418 and the upper pinch roll 420*b* have respective gears fixed to one end of their shafts. The rotating speeds Nn and Np of these rolls 418, 420*b* are detected by respective speed sensors 438, 440, which generate pulses as the above-indicated gears are rotated with the rolls 418, 420*b*. The speed sensors 438, 440 may consist of proximity or photoelectric switches capable of detecting the teeth of the gears, or alternatively other speed detecting devices such as rotary encoders. In the present fourth embodiment, the motor 56 and pinch rolls 420*a*, 420*b*, 422*a*, 422*b* constitute a major portion of a feeding device for feeding the strip 14.

Figure 22:
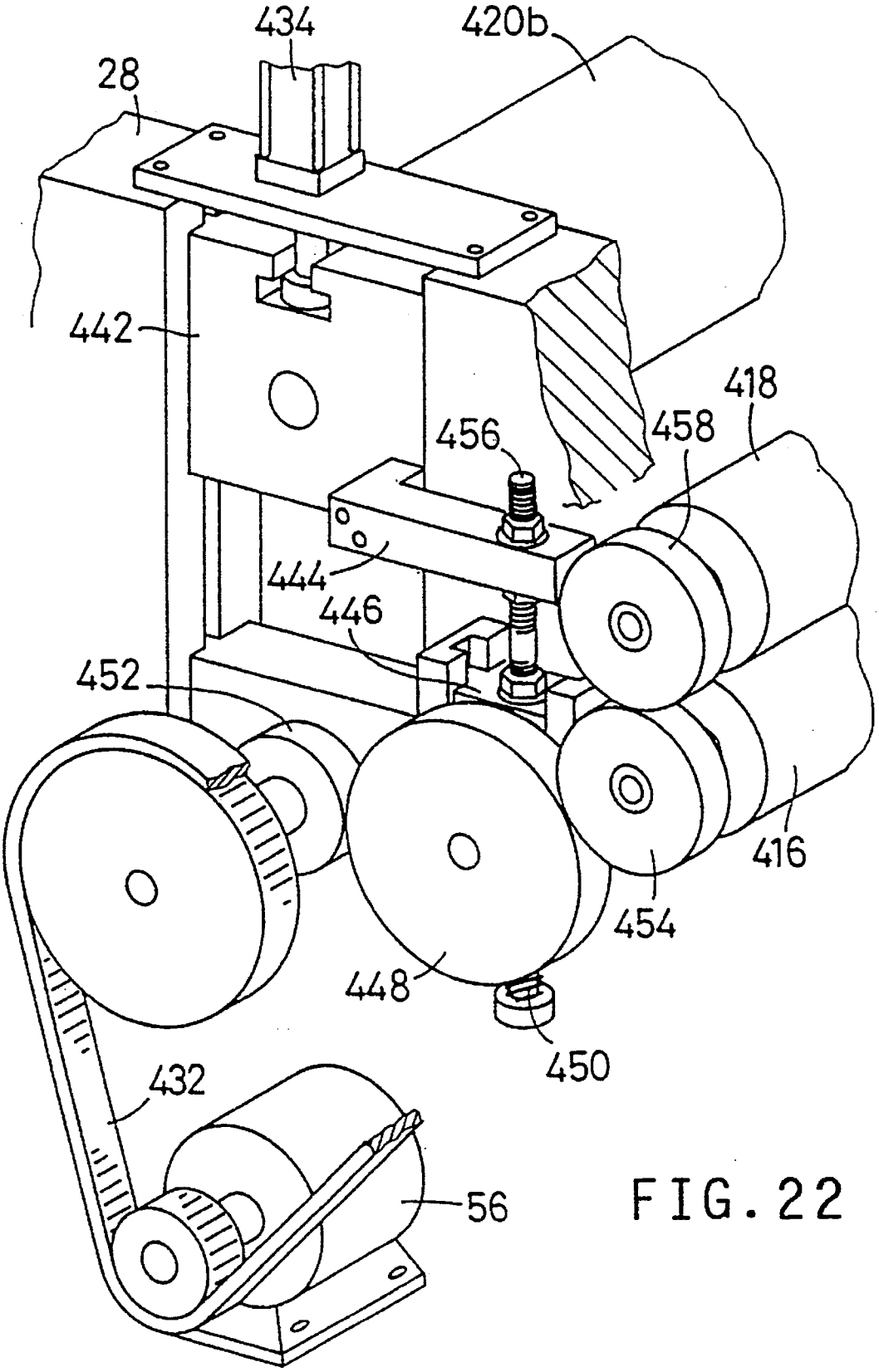
FIG. 22 is a perspective view illustrating a power transmission line for rotating the tacky rolls of the devices of FIG. 20.

As shown in FIG. 22, the upper pinch roll 420*b* is rotatably supported by two bearing blocks 442 which are movable relative to the housing 28 in the vertical direction, by respective pneumatic cylinders 434. To the bearing blocks 442, there are secured two elevator slides 446 through respective brackets 444. Each elevator slide 446 rotatably supports an intermediate roll 448 such that the roll 448 is movable in the vertical direction. The roll 448 is normally placed in its lowermost position under a biasing force of a spring 450. When the bearing blocks 442 are moved to the uppermost position by the pneumatic cylinders 434, each intermediate roll 448 is brought into contact with respective rolls 452, 454 which are fixed to the lower pinch roll 420*a* and lower tacky roll 416, respectively. The intermediate roll 448 is held in contact with the rolls 452, 454 by the biasing force of the spring 450. The height of the elevator slide 446 relative to the bracket 444 is adjusted by a height adjusting screw 456 so that the intermediate roll 448 contacts the rolls 452, 454 within the upward movement of the bearing block 442 by the pneumatic cylinder 434. Consequently, while the upper pinch roll 420*b* is placed in the uppermost position, the lower tacky roll 416 can be rotated by the feeding motor 56. The roll 454 has teeth meshing with the teeth of a roll 458 attached to the shaft of the upper tacky roll 418, so that the upper tacky roll 418 is rotated with the lower tacky roll 416. The intermediate roll 448 and the rolls 452, 454 are formed of polyurethane, or knurled or toothed at their circumferential surfaces, in order to avoid slipping upon mutual contact thereof. It is noted that the perspective view of FIG. 22 is taken from the downstream side of the cleaning apparatus as seen in the feeding direction of the strip 14, which is fed from the upper left portion of FIG. 22.

Referring back to FIG. 21, the upper roll cleaning device 414 is disposed above the upper tacky roll 418, for cleaning the roll 418. This washing device 414 includes a cleaning head 460, a guide plate 462 which supports the cleaning head 460 such that the head 460 is movable in the direction perpendicular to the feeding direction of the strip 14, and two pneumatic cylinders 464 for moving the guide plate 464 in the vertical direction. Each pneumatic cylinder 464 is equipped with a lock cylinder 466 for locking to prevent falling of the upper cleaning device 414 upon air leakage associated with the cylinder 464. When the guide plate 462 is lowered by the pneumatic cylinders 464, the cleaning head 460 is pressed against the outer circumferential surface of the upper tacky roll 418. When the guide plate 462 is elevated, the cleaning head 460 is spaced apart from the upper tacky roll 418. Between the cleaning head 460 and the upper tacky roll 418, there is provided a guard 468 which prevents the foreign matters once transferred from the upper tacky roll 418 to the cleaning head 460, from falling onto the upper tacky roll 418. This guard 468 is movable by two pneumatic cylinders 470, along an upper part of the circumference of the roll 418, between the operating position of FIG. 21 right above the roll 418 and the non-operating position of FIG. 23 to the left of the roll 418 (upstream of the roll 418 in the feeding direction of the strip 14). When the upper cleaning device 414 is operated, the guard 468 is moved to the non-operating position of FIG. 23. The cylinders 464 may be used, in replace of the cylinders 470, to move the guard 468 to the non-operating position of FIG. 23 when the upper cleaning head 460 is lowered by the cylinders 464. The bearing blocks 426 which support the upper tacky roll 418 have apertures 472 through which the cleaning head 460 can be removed from the housing 28, when the contaminated cleaning head 460 is replaced with a new one. This replacement can be achieved even while the tacky rolls 416, 418 are in operation to clean the strip 14. The bearing blocks 426 may be provided with pinions engageable with a mating rack attached to the cleaning head 460, so that the cleaning head 460 is automatically changed.

Figure 23:
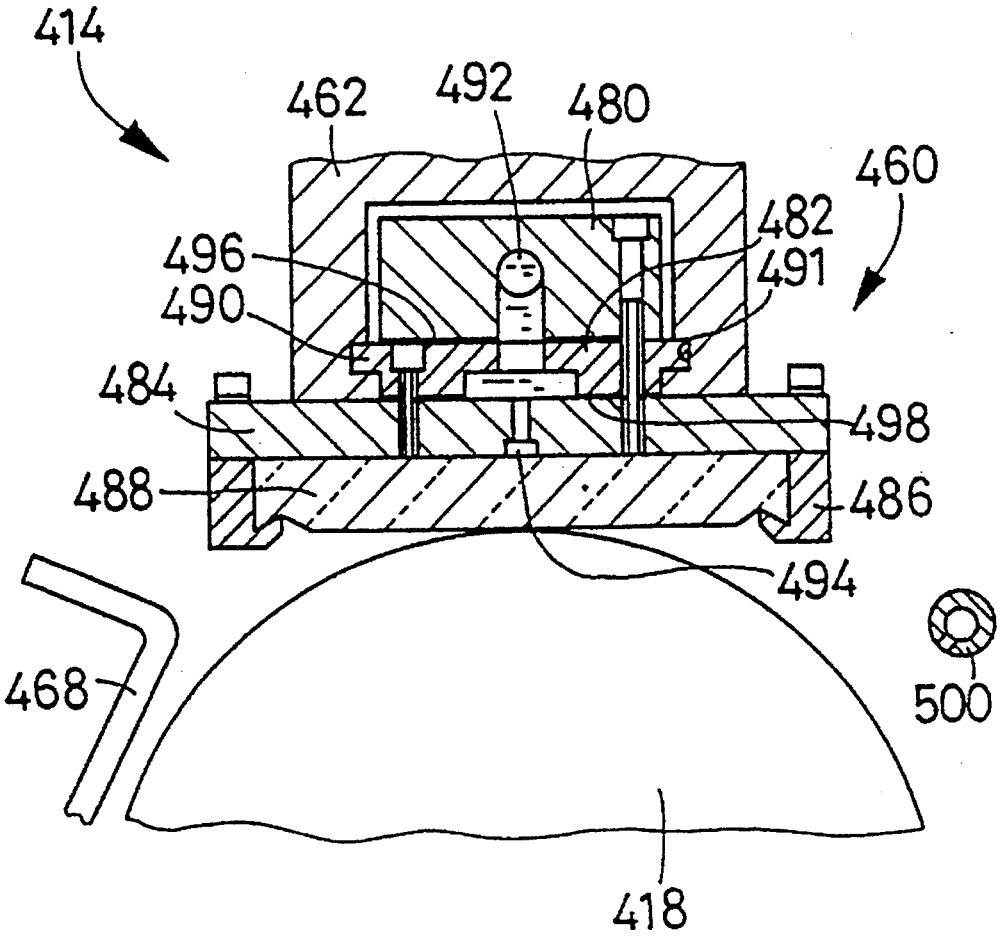
FIG. 23 is an elevational view in cross section showing a cleaning head of a roll cleaning device for the upper tacky roll device shown in FIG. 20.

The cleaning head 460 of the upper cleaning device 414 includes a liquid feed plate 480, an intermediate plate 482 and a base plate 484 which are assembled together by screws. The head 460 further includes a cleaning pad 488 attached to the base plate 484 by a clamp 486. The intermediate plate 482 has lateral flanges 490 which engage respective grooves 491 formed in the guide plate 462, whereby the cleaning head 460 is supported by the guide plate 462 such that the head 460 is movable in the direction perpendicular to the feeding direction of the strip 14. The liquid feed plate 480 has a fluid passage for feeding a suitable cleaning liquid 492 such as a solvent or alcohol. The cleaning liquid 492 from the fluid passage in the plate 480 is delivered to the cleaning pad 488 through a fluid passage formed through the intermediate plate 482, and through a multiplicity of nozzles 494 formed through the thickness of the base plate 484. These nozzles 494 are arranged in a row parallel to the longitudinal direction of the base plate 484. Thus, the cleaning pad 488 is soaked with the cleaning liquid 492 delivered thereto. To prevent leakage of the cleaning liquid 492, sheet packings 496, 498 are interposed between the liquid feed and intermediate plates 480, 482, and between the intermediate and base plates 482, 484, except for the areas in which the fluid passages are formed. The cleaning pad 488 is made of a felt, an unwoven fabric or other fibrous material which is capable of accommodating the cleaning liquid 492. When the upper tacky roll 418 is rotated by the feeding motor 56 via the intermediate rolls 448 while the cleaning pad 488 is forced against the outer circumferential surface of the roll 418 by the pneumatic cylinders 464 as shown in FIG. 23, the oily substance deposited on the tacky roll 418 is decomposed by the cleaning liquid 492, and at the same time the foreign matters on the roll 418 are wiped off by the cleaning pad 488. The feeding motor 56 also functions as drive means for rotating the tacky roll 418. Thus, the cleaning device 414 includes the drive motor 56. Adjacent the upper tacky roll 418, there is provided an elongate air nozzle 500 which extends parallel to the axis of the tacky roll 418, so that the tacky roll 418 is rapidly dried by compressed air blown from the nozzle 500.

Referring back to FIG. 21, the lower cleaning device 412 is for cleaning the lower tacky roll 416 and is disposed below this tacky roll 416. The lower cleaning device 412 is identical in construction with the upper cleaning device, except that the guard 468 is not provided for the lower cleaning device 412. The lower and upper cleaning devices 412, 414 are disposed symmetrical with respect to the tacky roll device 410.

Figure 24:
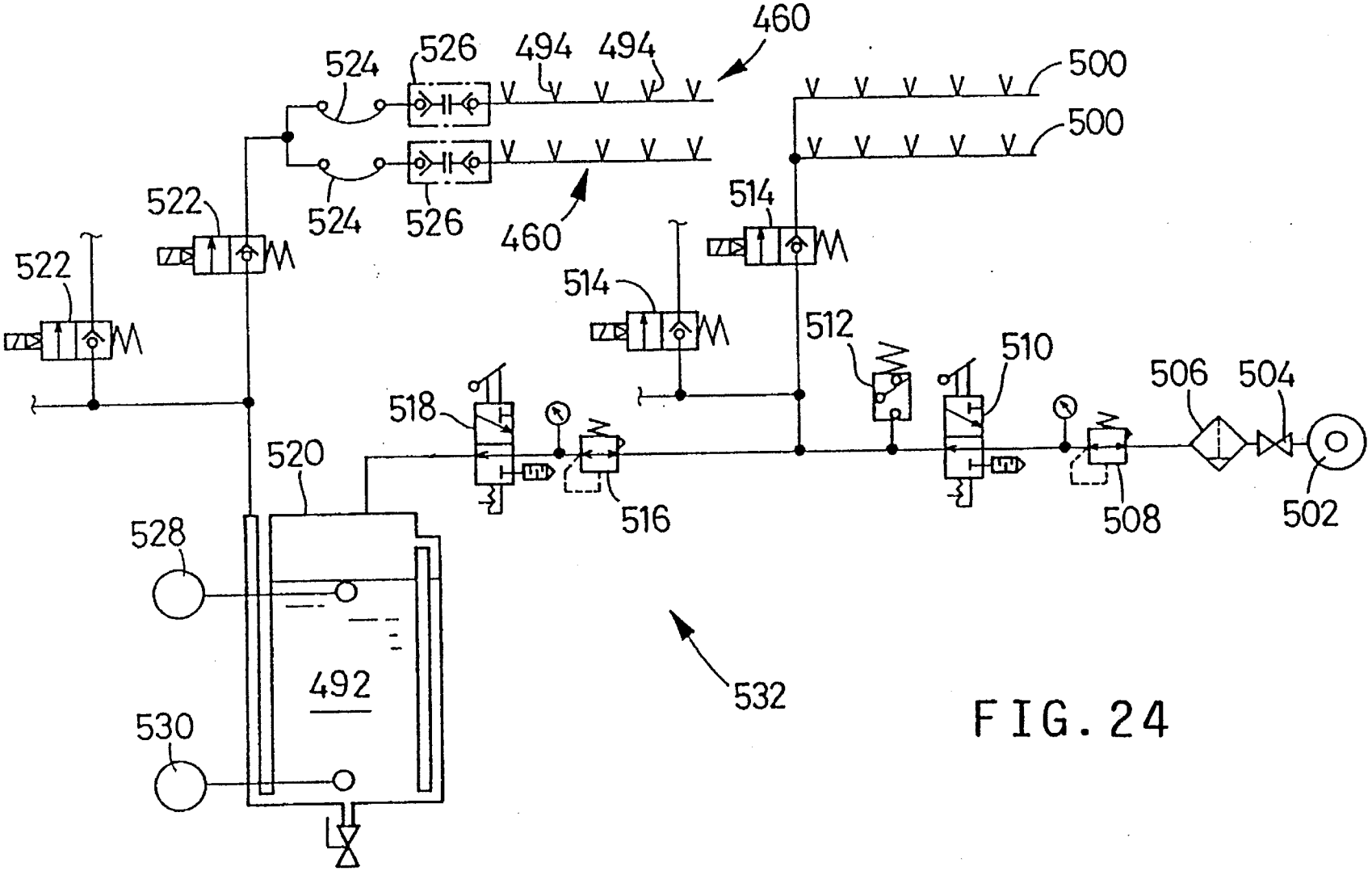
FIG. 24 is a diagram showing liquid and air supply circuits connected to the cleaning heads (one of which is shown in FIG. 23) and air nozzles for the tacky roll devices of FIG. 20.

The cleaning heads 460 and the air nozzles 500 of the cleaning devices 412, 414 are supplied with the cleaning liquid 492 and the compressed air, by a circuit illustrated in FIG. 24. The cleaning liquid 492 is stored in a reservoir 520, while the compressed air is generated by a primary air source 502, which is connected to the air nozzles 500 and the liquid reservoir 520, through a stop valve 504, a filter 506, a regulator 508, a pressure relief valve 510 and a pressure switch 512, and through respective branch lines. The branch line leading to the air nozzles 500 has switch valves 514, while the branch line leading to the reservoir 520 has a regulator 516 and a pressure relief valve 518. With the compressed air having a suitably adjusted pressure applied to the reservoir 520, the cleaning liquid 492 is forced to flow from the reservoir 520 to the upper and lower cleaning heads 460 through a switch valve or valves 522, hoses 524, and couplings 526. In FIG. 24, only a portion of the entire lengths of the cleaning heads 460 and air nozzles 500 is shown, the fluid passages formed in the cleaning heads 460 and air nozzles 500 are divided into a plurality of sections arranged in the direction of width of the strip 14, in view of various width dimensions of the strip 14. The switch valve 514, 522 is provided for each of those sections of the fluid passage, to select the effective length of each cleaning head 460 or air nozzle 500, so that only the contaminated axial portion of the tacky rolls 416, 418 is cleaned. The liquid reservoir 520 is made of a stainless steel (SUS304), and has two level detecting switches 528, 530 which generate signals when the level of the liquid 492 rises above the upper limit or falls below the lower limit. These signal are used to activate an alarm light or buzzer. The couplings 526 are provided to facilitate connection and disconnection of the hoses 524 when the cleaning heads 460 are replaced with new ones. Each coupling 526 incorporates a check valve for preventing leakage of the liquid 492 when the hoses 524 are disconnected from the heads 460. In the present embodiment, the primary air source 502 (which serves to feed the liquid 492 to the heads 460), the reservoir 520 and hoses 524 constitute a principal portion of liquid supply means 532 for supplying the liquid 492 to the cleaning heads 460. The pressure of the cleaning liquid 492 can be regulated by the regulator 516. In the light of a pressure loss due to different lengths of the liquid supply lines, the corresponding switch valves 522 may be provided with respective flow control valves on the side of the reservoir 520. If a solvent is used as the cleaning liquid 492, the packings and seals for the valves, and the rubber hoses are likely to be corroded by the solvent if they are formed of a rubber material. In this case, therefore, it is desirable to use a resin material such as fluorine-contained resin and epoxy resin for such packings, seals and hoses.

Figure 25:
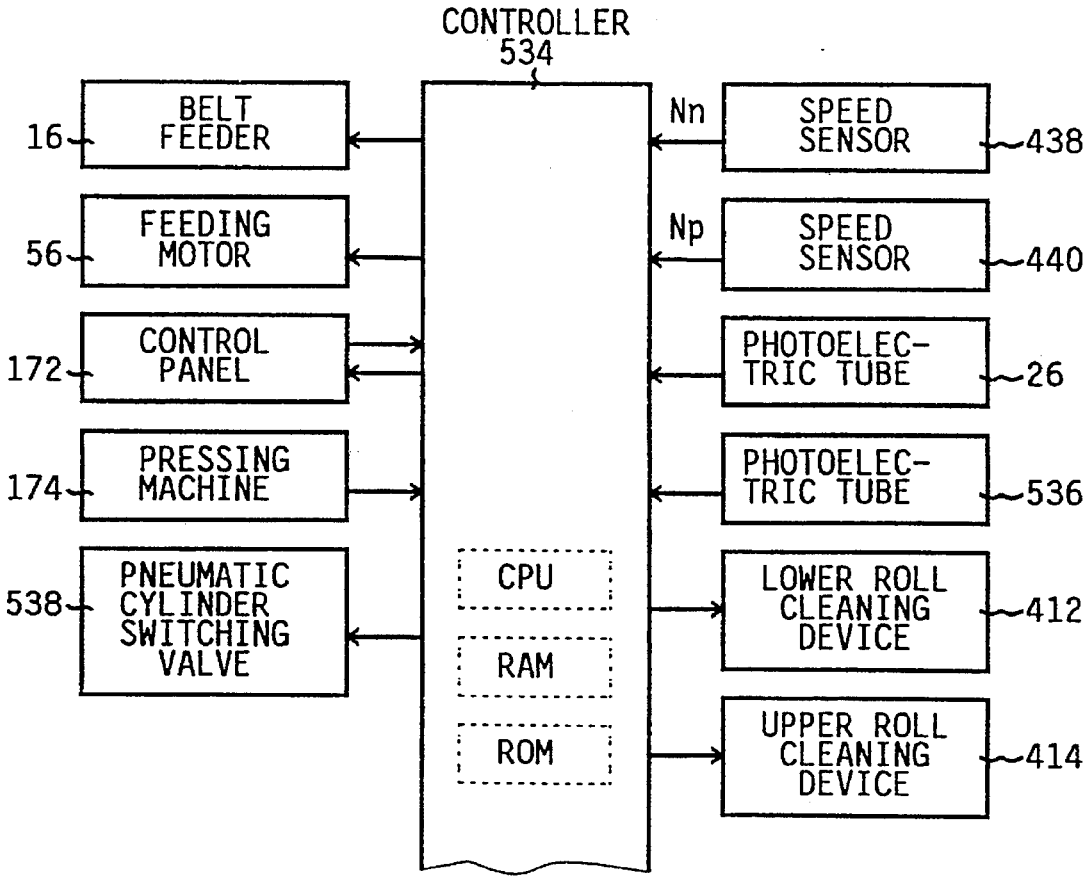
FIG. 25 is a block diagram showing a control system for the tacky roll devices of FIG. 20 including the roll cleaning devices.

The cleaning devices 412, 414 are controlled by a controller 534 as indicated in FIG. 25. Like the controller 66, the controller 534 is assigned to control the cleaning apparatus as a whole. However, there will be described only the operations to diagnose the upper tacky roll 418 for contamination and clean the contaminated tacky rolls 416, 418 by the cleaning device 412, 414. The controller 534 are adapted to receive output signals from the speed sensors 438, 440 and photoelectric tube 26, and also a signal from a photoelectric tube 536 provided on the loading station 64. The signal from the photoelectric tube 536 indicates that the strip 14 has passed the tube 536. The controller 534 operates according to stored control programs, to control the belt feeder 16, feeding motor 56, cleaning devices 412, 414, and switch valves 538 for regulating the pneumatic cylinders 434. The controller 534 receives from the operator's control panel 172 data representative of various settings and parameters, and also receives from the pressing machine 174 a signal indicative of the kind of the strip 14 (namely, the identification number of the product to be manufactured from the strip 14).

Referring to the flow chart of FIG. 26, there will be described a routine to be executed by the controller 534 for diagnosing the tacky rolls 416, 418 for contamination by dust and dirt or oily substances or other foreign matters, and consequent reduction in the tackiness. Initially, step S1 is implemented to determine, on the basis of the signal received from the photoelectric tube 26, whether the workpiece strip 14 has been received from the belt feeder 16 or not. An affirmative decision (YES) is obtained in step S1 if the signal from the photoelectric tube 26 indicates that the leading end of the strip 14 has passed the photoelectric tube 26. In this case, step S2 is implemented to reset a timer Tim-1. Step S2 is followed by step S3 to determine whether the time measured by the timer Tim-1, namely, the time which has elapsed from the moment of detection of the leading end of the strip 14 by the photoelectric tube 26 has exceeded a predetermined time $t_1$ or not. If the time $t_1$ has elapsed, step S4 is implemented to determine whether a rotating speed Nn of the tacky roll 418 is equal to or higher than a predetermined lower limit $\alpha_1$ or not. If an affirmative decision (YES) is obtained in step S4, step S5 is implemented. If a negative decision (NO) is obtained, step S6 is implemented to-determine that the tacky rolls 416, 418 have been contaminated, and activate a suitable alarm means such as an alarm light or buzzer. Step S5 is provided to determine whether the time measured by the timer Tim-1 is equal to a sum of $t_1$ and $t_2$, i.e., the above-indicated time $t_1$ plus an additional time $t_2$. Step S4 is repeated until the time $(t_1+t_2)$ has passed. The rotating speed Nn and the lower limit $\alpha_1$ may be indicated on the operator's control panel 172 or other indicator.

Figure 28:
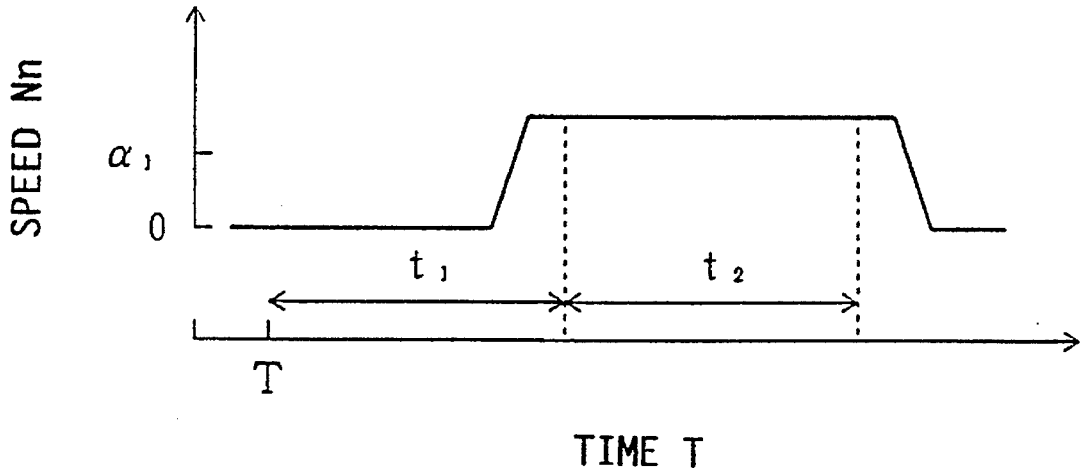
FIG. 28 is a time chart for explaining a relationship between times $t_1$ and $t_2$ used in the routine of FIG. 26, and a change in rotating speed of the tacky rolls.

The time limits $t_1$ and $t_2$ are determined so that step S4 is implemented while the 'strip 14 to be fed by the pinch rolls 420*a*, 420*b*, etc. at a predetermined speed from the belt feeder 16 is passing through the tacky roll device 410 for removing the foreign matters. These time limits $t_1$ and $t_2$ are determined for each kind of the strip 14 (for each part number), by the distance between the photoelectric tube 26 and the tacky roll device 410, and the length dimension and the feeding speed of the strip 14. The determined time limits are entered through the control panel 172 and stored in the RAM of the controller 534. Since the tacky roll 418 is rotated in contact with the strip 14 being fed, the rotating speed Nn is zero until the strip 14 reaches the tacky roll device 410, and increases to a given level when the strip 14 has reached the device 410, as indicated in FIG. 28. The speed Nn is held at that given level until the strip 14 leaves the device 410. In FIG. 28, "T" indicates the time after the photoelectric tube 26 has detected the leading end of the strip 14, that is, the time after the affirmative decision (YES) is obtained in step S1. The lower limit $\alpha_1$ is the rotating speed Nn which is lower than the feeding speed of the strip 14 and below which the tackiness of the tacky rolls 416, 418 are considered to be insufficient for removal of the foreign matters. This time limit $\alpha_1$ is determined, entered through the control panel 172 and stored in the RAM, for each kind of the strip 14. Explained more specifically, the tacky roll 418 is rotated due to its tackiness in contact with the strip 14 being fed, and therefore the reduction in the tackiness due to the foreign matters deposited on the tacky roll 418 causes an increase in the amount of slip of the tacky roll 418 with the strip 14, whereby the rotating speed Nn of the tacky roll 418 is lowered. Thus, the contamination of the tacky rolls 416, 418 can be determined on the basis of the rotating speed Nn, namely, depending upon whether the speed Nn is not higher than the lower limit $\alpha_1$. It will be understood that a portion of the controller 534 assigned to implement steps S1–S6 constitutes means for diagnosing the tacky rolls 416, 418 for contamination. Further, the speed sensor 438 functions as means for detecting the rotating speed Nn of the tacky roll 418.

It is noted that a rotating speed Np of the pinch roll **420*b* detected by the speed sensor 440 may be used to detect any abnormality associated with the feeding of the strip 14, for example, disconnection of the belt 418. The rotating speed Np is not necessary for diagnosing the tacky rolls 416, 418 for contamination, and the speed sensor 440 may be eliminated. However, the detection of the feeding abnormality of the strip 14, which takes place when the speed Np detected by the sensor 440 is lower than a predetermined lower limit, can be conveniently utilized to skip the implementation of step S6 or inhibit the determination of the contamination of the tacky rolls 416, 418** even if the negative decision (NO) is obtained in step S4.

Figure 27:
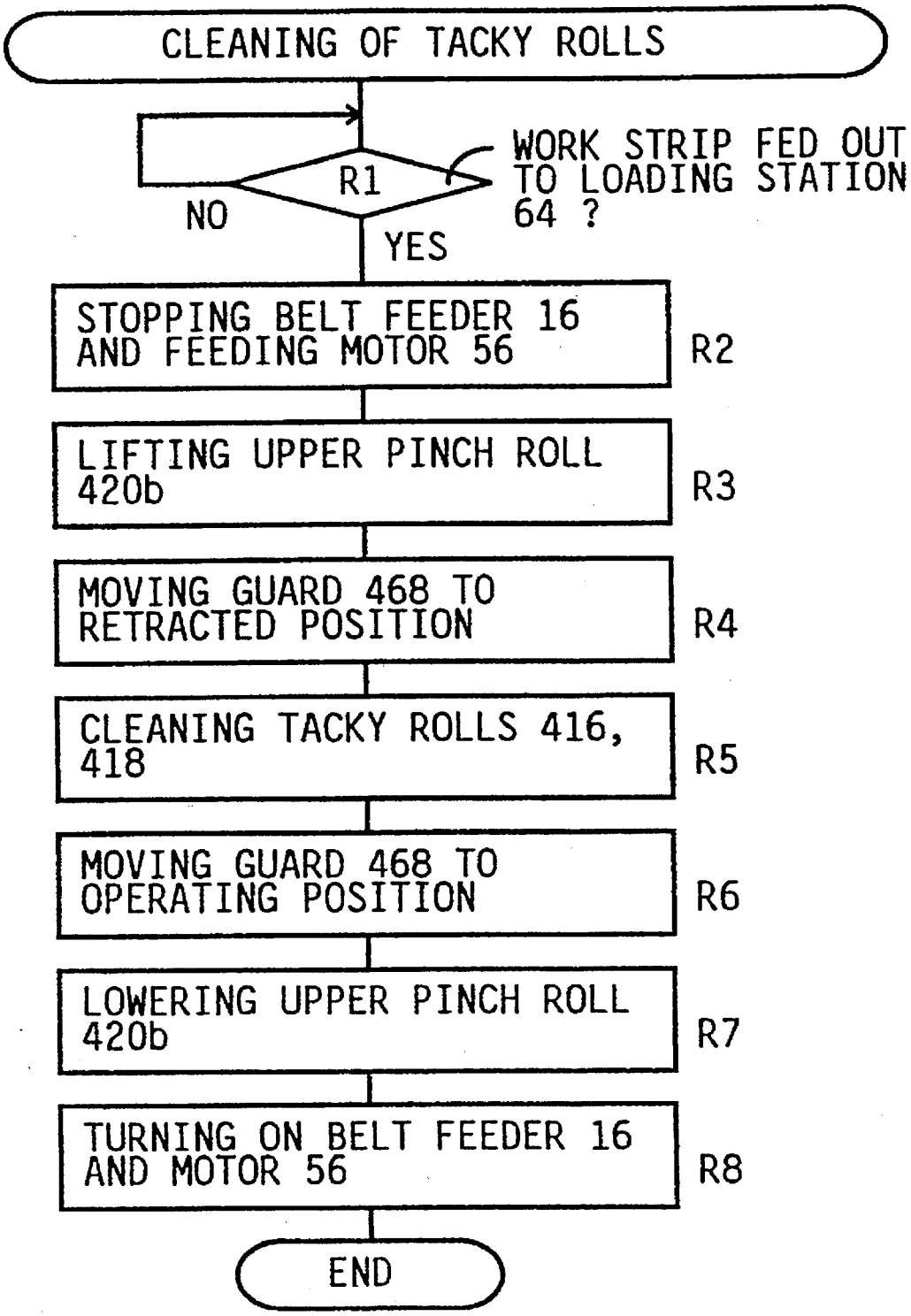
FIG. 27 is a flow chart illustrating details of roll cleaning step S7 of the routine of FIG. 26.

Step S6 is followed by step S7 which is implemented according to a flow chart of FIG. 27, for example, to clean the contaminated tacky rolls 416, 418, by the cleaning devices 412, 414. Although the determination in step S4 is made on the basis of the rotating speed Nn of the upper tacky roll 418, the upper and lower tacky rolls 416, 418 are both cleaned simultaneously if step S6 is implemented, since the contamination of the upper roll 418 indicates similar contamination of the lower tacky roll 416. The rotating speed of the lower tacky roll 416 may be used in place of or in addition to that of the upper tacky roll 418, to effect the determination in step S4.

Referring to the flow chart of FIG. 27, the step S7 of cleaning the tacky rolls 416, 418 is initiated with step R1 to determine, on the basis of the signal received from the photoelectric tube 536, whether the strip 14 has been fed to the loading station 64 of the pressing system, that is, whether the trailing end of the strip 14 has left the cleaning apparatus. If an affirmative decision (YES) is obtained in step R1, the control flow goes to step R2 in which the belt feeder 16 and the feeding motor 56 are turned off. Step R2 is followed by step R3 to operate switching valves 538 (FIG. 25) for thereby activating the pneumatic cylinders 434 to elevate the pinch roll **420*b* and thus inhibit the feeding of the strip 14 by the pinch roll 420*b*, and connect the tacky rolls 416, 418 to the feeding motor 56. Then, step R4 is implemented to activate the pneumatic cylinders 470 for moving the guard 468 to its non-operated position. Step R4 is followed by step R5 in which the tacky rolls 416, 418 are cleaned by the respective upper and lower cleaning devices 412, 414**.

In step R5, the cleaning heads 460 of the two cleaning devices 412, 414 are pressed by the pneumatic cylinders 464, onto the circumferential surfaces of the tacky rolls 416, 418, and the cleaning liquid 492 is supplied by the liquid supply means 532 to the cleaning heads 460, while at the same time the compressed air is supplied to the air nozzles 500. The tacky rolls 416, 418 are rotated by the feeding motor 56 at a relatively low speed, so that the surfaces of the rolls 416, 418 are cleaned by the cleaning heads 460 and air nozzles 500. After the rolls 416, 418 have been cleaned for a predetermined time duration, the motor 56 and the supply of the liquid 492 and the compressed air are stopped, and the cleaning heads 460 of the cleaning devices 412, 414 are moved by the pneumatic cylinders 464 away from the respective tacky rolls 416, 418. The control flow then goes to step R6 to activate the pneumatic cylinders 470 to move the guard 468 back the operating position. Step R6 is followed by step R7 to operate the switching valves 538 so that the pinch roll **420*b* is lowered by the pneumatic cylinders 434, to disconnect the tacky rolls 416, 418 from the motor 56 and force the upper pinch roll 420*b* against the lower pinch roll 420*a*. Then, the belt feeder 16 and the feeding motor 56** are re-started in step R8.

In the present fourth embodiment, the tacky rolls 416, 418 are diagnosed or checked for contamination with the foreign matters, or reduction in the tackiness effective to remove the foreign matters, depending upon whether the rotating speed Nn of the upper tacky roll 418 rotated by the feeding movement of the strip 14 is lower than the lower limit $\alpha_1$ or not. When the contamination is detected, the rolls 416, 418 are cleaned by the cleaning devices 412, 414. Thus, the present arrangement permits the rolls 416, 418 to be cleaned at more appropriate times, than in the case where the cleaning is effected on a regular basis, namely, when a predetermined number of the strips 14 have been cleaned by the rolls 416, 418. In this respect, it is noted that the amount of the foreign matters deposited on the strips 14 is not necessarily constant, and the cleaning of the tacky rolls 416, 418 on a regular basis may result in premature cleaning of the rolls 416, 418 before their contamination or loss of their function to remove the foreign matters, or late cleaning thereof after their contamination. The present arrangement assures cleaning of the tacky rolls 416, 418 when their function to remove the foreign matters has just been lost, that is, when their cleaning is necessary. Consequently, the cleaning apparatus equipped with the present roll cleaning devices 412, 414 and the controller 534 maintains a good condition for cleaning the strips 14, without the foreign matters being transferred from the tacky rolls 416, 418 back to the strips 14, whereby the pressing machine 174 always receives the strip 14 with high cleanliness, and the strip 14 can be press-formed into desired articles with high quality.

Further, since the cleaning devices 412, 414 are integrally incorporated in the cleaning apparatus, the tacky rolls 416, 418 can be easily and efficiently cleaned without removal from the apparatus. In particular, the rolls 416, 418 are automatically diagnosed for contamination, and are automatically cleaned upon detection of the contamination, whereby the work load on the user is reduced. Moreover, the utilization of the feeding motor 56 to rotate the tacky rolls 416, 418 for cleaning thereof makes it possible to simplify the cleaning apparatus.

Figure 26:
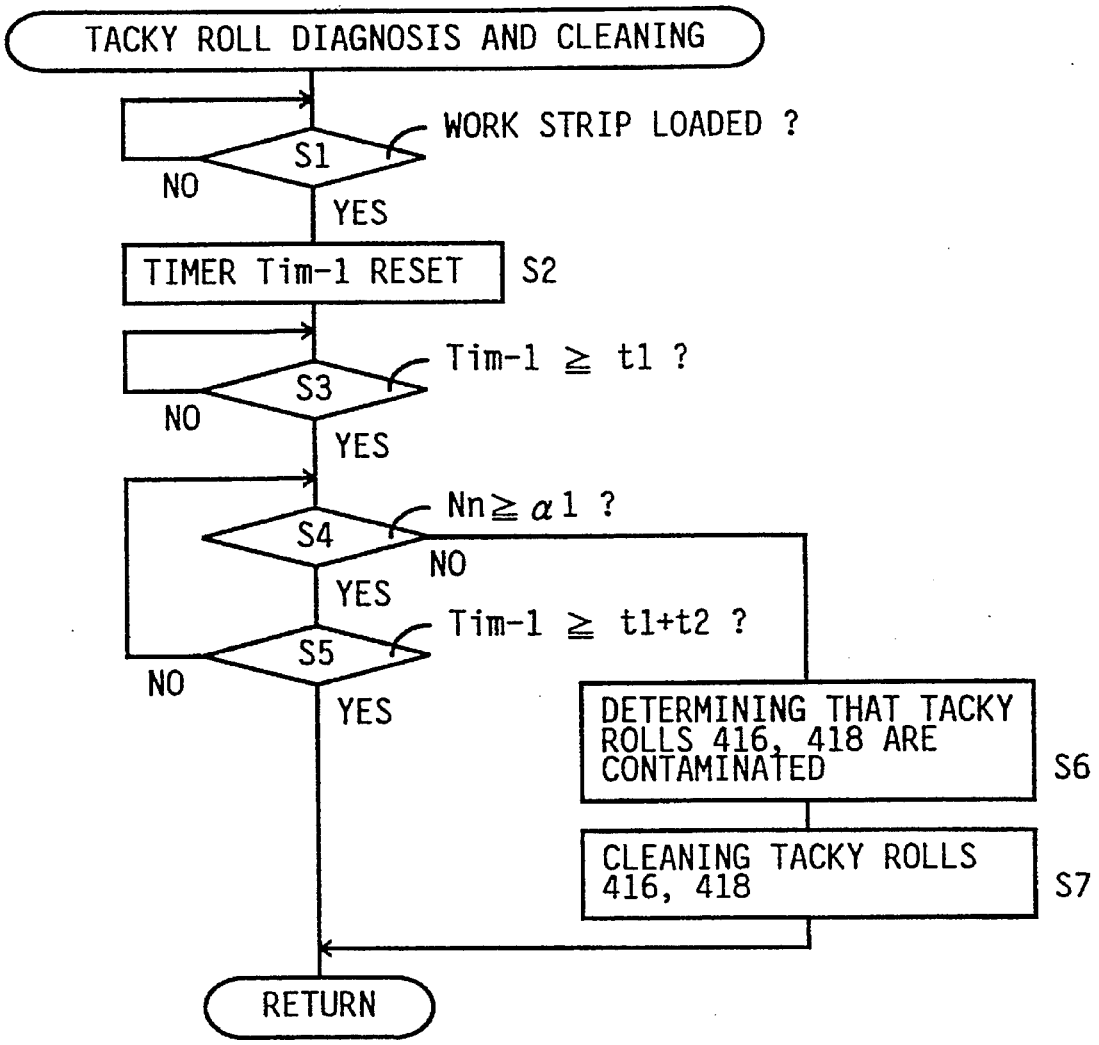
FIG. 26 is a flow chart illustrating a routine executed by a controller of FIG. 25, for diagnosing the tacky rolls for contamination.

Although the illustrated embodiment of FIG. 26 is adapted to determine in step S6 the contamination of the tacky rolls 416, 418 when the negative decision (NO) is obtained for the first time in step S4, it is possible to suitably change the condition in which step S6 is implemented. For instance, step S6 is implemented when the negative decision (NO) in step S4 is obtained a predetermined number of times, namely, for a predetermined number of the strips 14. Further, two or more different threshold values for the rotating speed Nn may be provided so as to detect the gradual contamination of the tacky rolls 416, 418 and indicate the degree of contamination in steps.

While the embodiment of FIG. 26 is adapted to effect the diagnosis of the rolls 416, 418 on the basis of the rotating speed Nn of the roll 418 as compared with the threshold $\alpha_1$, the diagnosis may be based on a difference between the rotating speed Nn of the roll 418 and a rotating speed Np of the upper pinch roll 420*b*, as compared with a predetermined upper limit, with a difference in the diameter of the rolls 418, 420*b* taken into consideration. Further, the lower limit $\alpha_1$ for the rotating speed Nn of the tacky roll 418 rotated by the feeding movement of the strip 14 may be changed with the length dimension of the strip 14.

The routine of FIG. 26 need not be executed for each cleaning cycle or for each strip 14, and may be modified to be executed each time a predetermined number of the strips 14 have passed the cleaning devices 412, 414.

Figure 29:
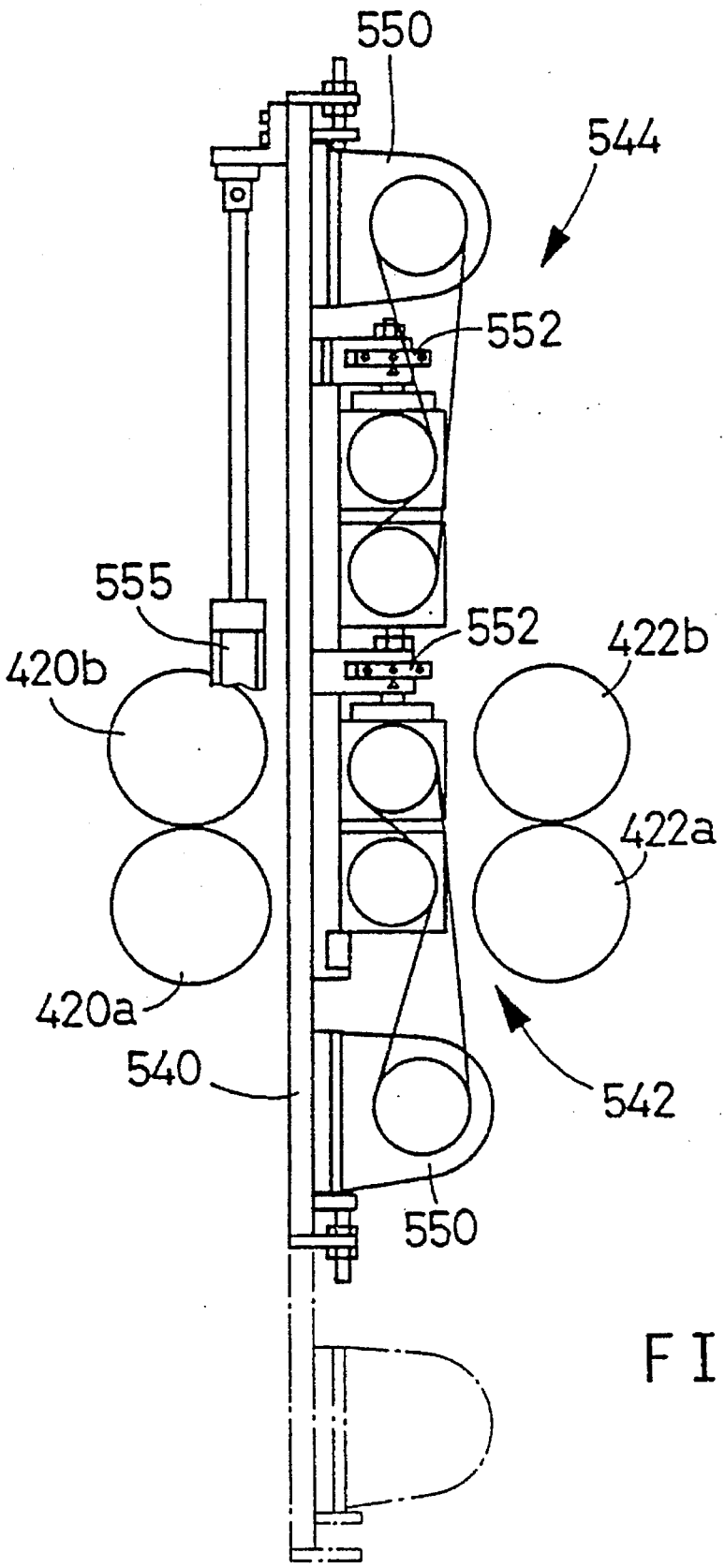
FIG. 29 is a schematic front elevational view of a further modified of the tacky roll device used in a yet further embodiment of the present invention.
Figure 30:
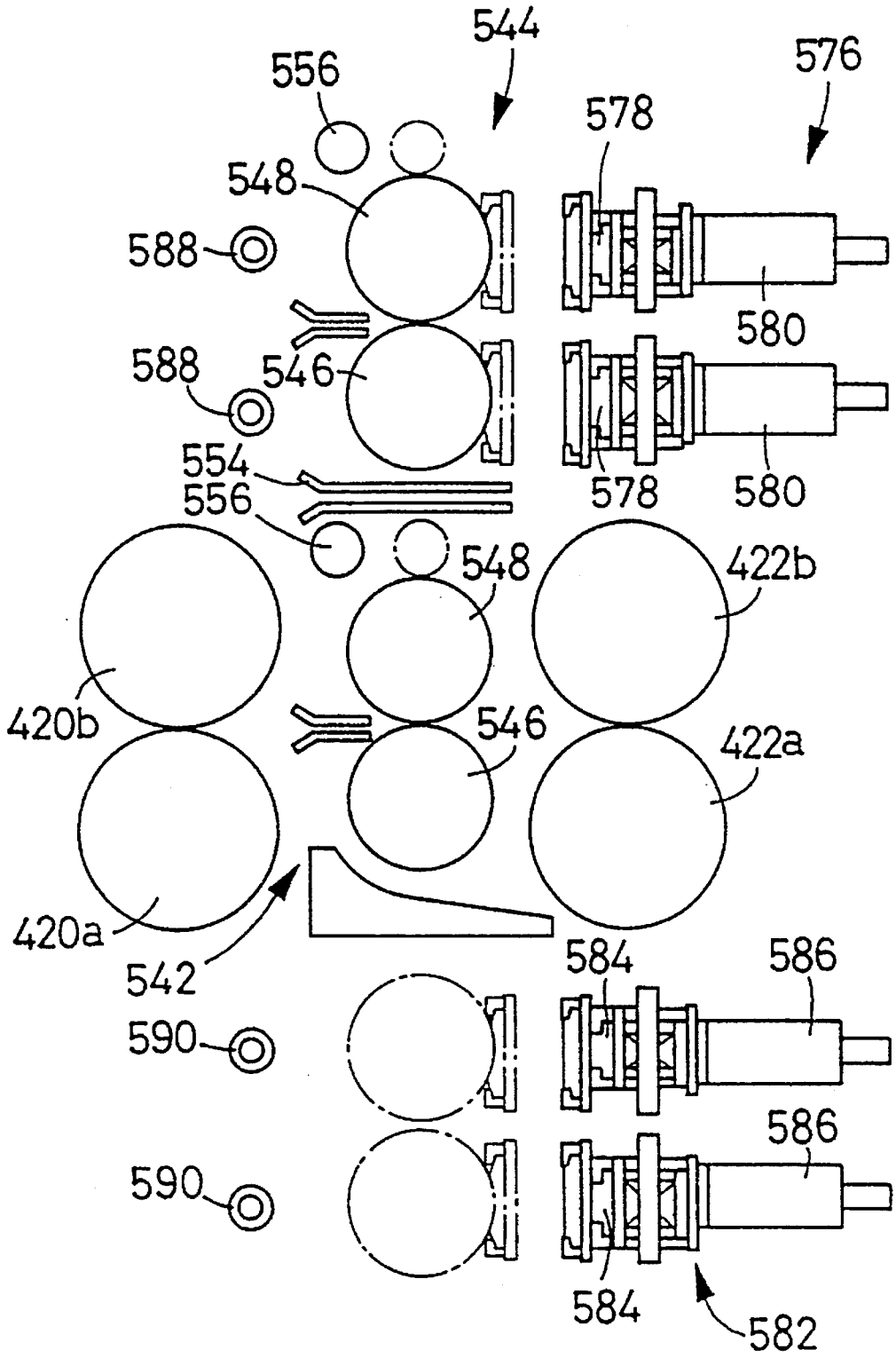
FIG. 30 is a view indicating a positional relationship between tacky rolls of the device of FIG. 29 and roll cleaning devices.
Figure 31:
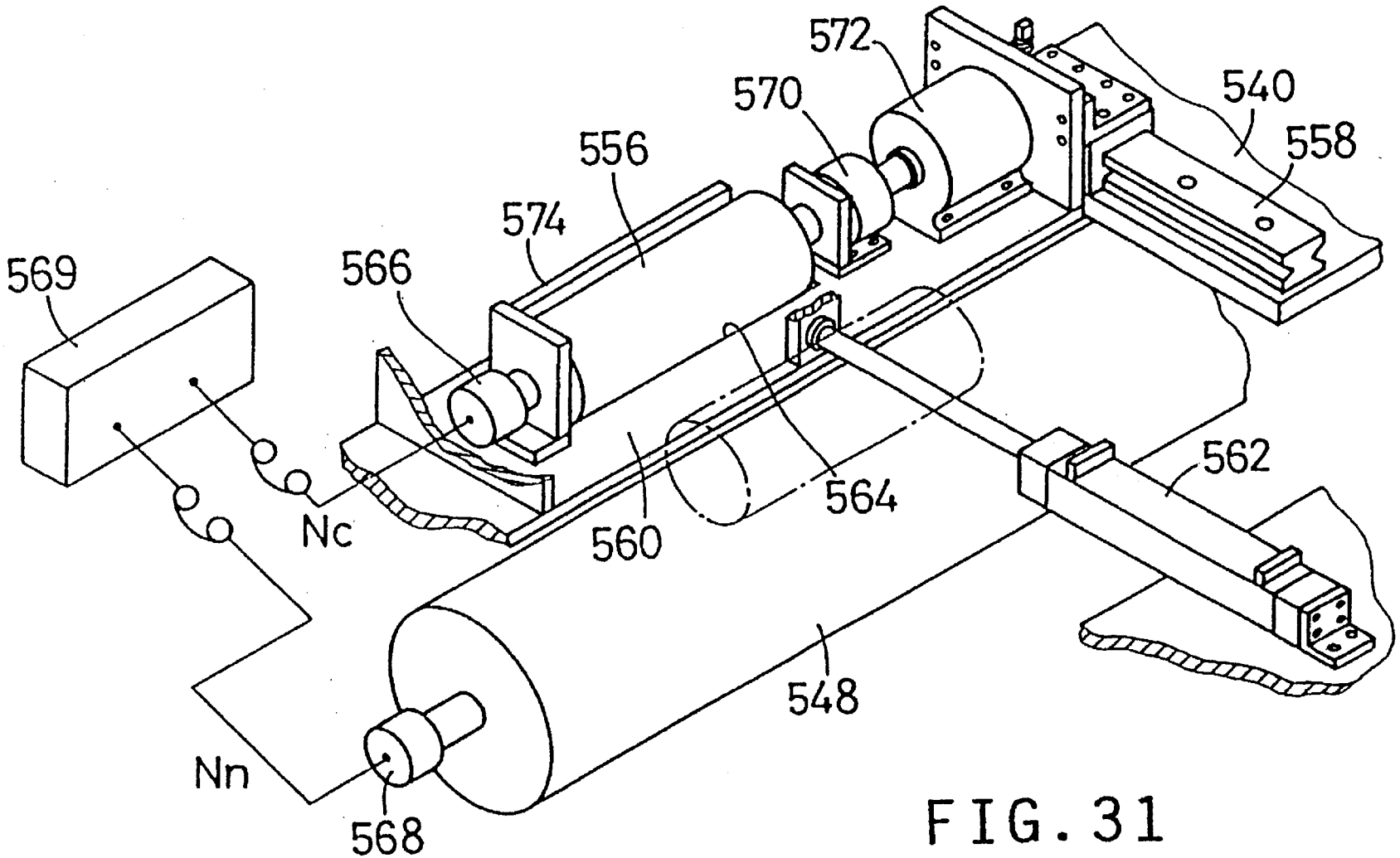
FIG. 31 is a perspective view showing a monitoring roll provided in the tacky roll device of FIG. 29.
Figure 32:
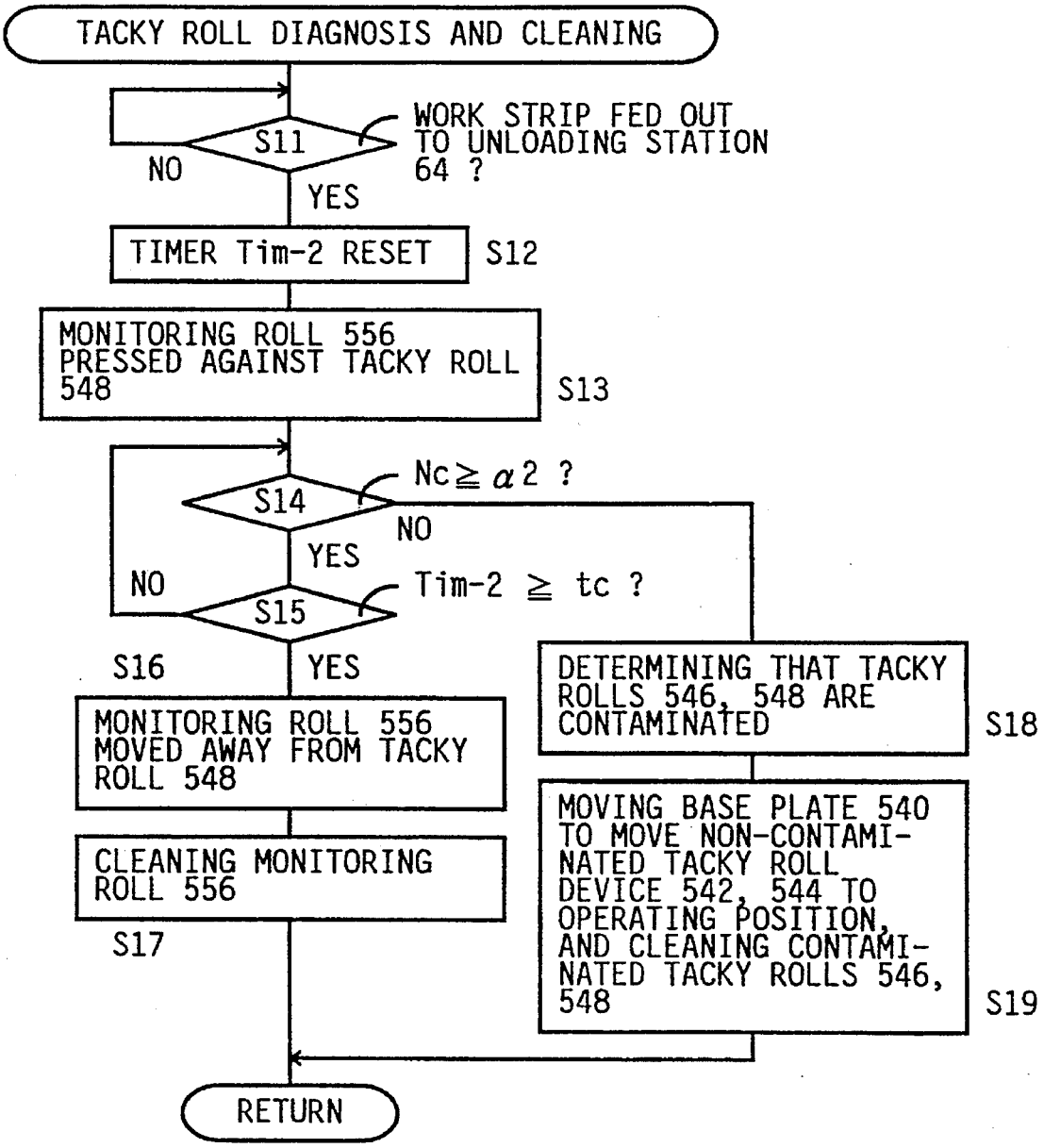
FIG. 32 is a flow chart illustrating a routine for diagnosing the tacky rolls of the device of FIG. 29 for contamination.

Referring to FIGS. 29–32, there will be described a fifth embodiment of this invention which has two tacky roll devices 542, 544, and corresponding two cleaning devices 582 and 576. As shown in FIG. 29, the tacky roll devices 542, 544 are disposed on a base plate 540 which is movable relative to the housing 28 in the vertical direction. These two tacky roll devices 542, 544 have completely the same construction, and each of these roll devices 542, 544 has a pair of tacky rolls 546, 548, a drive motor 550 for rotating the tacky rolls 546, 548, and an adjusting dial 552 for adjusting a gap between the tacky rolls 546, 548, as shown in FIG. 30. The tacky rolls 546, 548 are rotated to pass the strip 14 therebetween at the speed equal to the speed of feeding by the feeding device, which includes the feeding motor 56 and pinch rolls 420*a*, 420*b*, 422*a*, 422*b* as in the fourth embodiment. Between the lower and upper roll devices 542, 544, there is provided a guide 554 for guiding the strip 14. Each adjusting dial 552 is connected to a feedscrew for vertically moving the upper tacky roll 548 of each tacky device 542, 544 such that each one revolution of the dial 552 causes a vertical movement of about 1–2 mm of the tacky roll 548. The dial 552 has graduations in the form of holes formed in its outer circumferential surface, such that the holes are equally spaced apart from each other in the rotating direction of the dial 552 (at an angular spacing of 36°). The holes are adapted to receive a suitable tool for rotating the dial 552 for fine adjustment of the gap between the upper and lower tacky rolls 546, 548, so that these tacky rolls 546, 548 contact the lower and upper surfaces of the strip 14. The gap between the tacky rolls 546, 548 may be automatically adjusted by rotating the dials 552 by an electric motor, depending upon the specific thickness of the strip 14 to be cleaned. The base plate 540 is moved in the vertical direction by a pair of pneumatic cylinders 555, to one of upper, lower and intermediate positions. In the upper position of the base plate 540, the lower tacky roll device 542 is placed in the operating or cleaning position whose height is aligned with the feed path of the strip 14, while the upper tacky roll device 544 is placed in the non-operating position at which the tacky rolls 546, 548 of the upper tacky roll device 544 are cleaned by the upper cleaning device 576. In the lower position of the base plate 540, on the other hand, the upper tacky roll device 544 is placed in the operating or cleaning position, while the lower tacky roll device 542 is placed in the non-operating position for cleaning their rolls 546, 548 by the lower cleaning device 582. When the base plate 540 is in the intermediate position, the guide 554 is aligned with the feed path of the strip 14, for guiding the strip 14 fed by the feeding device. The pneumatic cylinders 555 are operated to place the base plate 540 in the selected one of the three positions, and have mechanical locks to prevent falling of the base plate 540 by gravity. FIGS. 29 and 30 show in solid line the tacky roll devices 542, 544 when the base plate 540 is in the upper position. The guide 554 may be replaced by polyurethane rolls for guiding the strip 14.

Above each of the tacky roll devices 542, 544, there is disposed a monitoring roll 556 made from an aluminum tube or other light-weight tubular member whose outer circumferential surface is ground. As is apparent from FIG. 31, the monitoring roll 556 is attached to a slide member 560 which is supported by the base plate 540 such that the slide member 560 is movable in the horizontal direction via a pair of guide rails 558. The monitoring roll 556 is rotatable about an axis parallel to the axis of the tacky roll 548. With the slide member 560 moved by a pneumatic cylinder 562, the monitoring roll 556 is movable between the operating position for contact with the tacky roll 548, and the non-operating position apart from the tacky roll 548. The slide member 560 has a cutout 564 through which the monitoring roll 556 projects downward for contact with the tacky roll 548 when the roll 556 is in the operating position. The amount of interference between the monitoring roll 556 and the tacky roll 548 is substantially the same as that between the tacky roll 548 and the strip 14, for example, in the neighborhood of 0.1 mm. The monitoring roll 556 in the operating position is rotated in pressing contact with the tacky roll 548. Since the weight of the monitoring roll 556 is relatively small, only a small load acts on the tacky roll 548. The monitoring roll 556 has a length smaller than that of the tacky roll 548, and is positioned for contact with an almost middle portion of the entire length of the tacky roll 548, which contacts the strip 14 irrespective of the varying width dimension of the strip 14. A rotary encoder 566 is provided at one axial end of the monitoring roll 556, for detecting a rotating speed Nc of the monitoring roll 556. Similarly, a rotary encoder 568 is provided at the corresponding axial end of the tacky roll 548, for detecting a rotating speed Nn of the tacky roll 548. These encoders 566, 568 apply signals indicative of these speeds Nc, Nn to a controller 569.

The monitoring roll 556 is connected through a one-way clutch 570 to the output shaft of a drive motor 572, so that the roll 556 can be rotated in the same direction as the direction in which the roll 556 is rotated in contact with the tacky roll 548. Adjacent the monitoring roll 556, there is disposed a cleaning head 574 which is forced against the monitoring roll 556 by a suitable pneumatic cylinder (not shown), so that the outer circumferential surface of the monitoring roll 556 is cleaned by the cleaning head 574 while the roll 556 is rotated by the motor 572. The provision of the one-way clutch 570 permits the monitoring roll 556 to be easily rotated in contact with the tacky roll 548 even when the motor 572 is not operated. Like the cleaning heads 460 used in the fourth embodiment, the cleaning head 574 has a cleaning pad which is supplied with a cleaning liquid from suitable supply means.

As also shown in FIG. 30, the upper cleaning device 576 has a pair of cleaning heads 578 which face the tacky rolls 546, 548 of the upper tacky roll device 544 when the base plate 540 is placed in the upper position. These cleaning heads 578 are forced against the respective tacky rolls 546, 548 by respective pneumatic cylinders 580. Similarly, the lower cleaning device 582 has a pair of cleaning heads 584 which face the tacky rolls 546, 548 of the lower tacky roll device 542 when the base plate 540 is placed in the lower position. These cleaning heads 584 are forced against the respective tacky rolls 546, 548 by respective pneumatic cylinders 586. Like the cleaning heads 460 of the cleaning devices 412, 414 used in the above fourth embodiment, the cleaning heads 578, 584 of the cleaning devices 576, 582 are supplied with a cleaning liquid from suitable liquid supply means, and are pressed against the respective tacky rolls 546, 548 to clean these tacky rolls while the tacky rolls 546, 548 are rotated by the motor 550. On the side of each tacky roll 546, 548 remote from the cleaning head 578, 584, there is provided an air nozzle 588, 590 for blowing compressed air to the cleaned tacky roll 546, 548 to rapidly dry these tacky rolls. For the upper cleaning device 576, suitable means as appropriate are provided for preventing the cleaning liquid from falling down onto the lower components of the apparatus.

Like the controller 534 used in the above embodiment, the controller 569 is adapted to diagnose the tacky rolls 546, 548 for contamination, during operation of the cleaning apparatus, and clean these rolls when necessary. A routine for diagnosing and cleaning the tacky rolls 546, 548 will be explained by reference to the flow chart of FIG. 32. Initially, step S11 is implemented to determine, on the basis of the signal received from the photoelectric tube 536, whether the strip 14 has been fed to the loading station 64 of the pressing system. If an affirmative decision (YES) is obtained in step S11, step S12 is implemented to reset a timer Tim-2. Step S12 is followed by step S13 in which the pneumatic cylinder 562 is activated to move the monitoring roll 556 the operating position in which the monitoring roll 556 is pressed against the tacky roll 548 of the presently used tacky roll device 542, 544. Since the tacky rolls 546, 548 of the presently used tacky roll device 542, 544 are held rotated during operation of the pressing system irrespective of the presence or absence of the strip 14, the monitoring roll 556 is rotated in rolling contact with the tacky roll 548. The control then goes to step S14 to determine, on the basis of the signal received from the rotary encoder 566, whether the rotating speed Nc of the monitoring roll 556 is equal to or higher than a predetermined lower limit $\alpha_2$, which is determined based on the rotating speed of the tacky roll 548, that is, the feeding speed of the strip 14. If the speed Nc is equal to or higher than the lower limit $\alpha_2$, step S14 is followed by step S15. If the speed Nc is lower than the lower limit $\alpha_2$, the control goes to step S18 in which suitable alarm means such as an alarm light or buzzer is activated to indicate that the tacky rolls 546, 548 have been contaminated. On the other hand, step S15 is provided to determine whether the time measured by the timer Tim-2 has exceeded a predetermined diagnosis time tc, so that step S14 is repeatedly implemented until the diagnosis time tc has elapsed. The time tc is determined to be shorter than a cycle time of the pressing machine 174, namely, a cycle time of the cleaning apparatus. The rotating speed Nc and the lower limit $\alpha_2$ may be indicated on the control panel 172.

The determination in step S14 is based on the fact that a decrease in the tackiness of the tacky roll 548 due to foreign matters deposited thereon will cause an increase in the amount of slip of the monitoring roll 556 with respect to the tacky roll 548, which results in a decrease in the rotating speed Nc of the monitoring roll 556. Thus, the principle of determination in step S14 is basically the same as that in step S4 of the preceding fourth embodiment. If the rotating speed Nn of the tacky roll 548 is lower than a given lower limit, this may indicate some abnormality such as disconnection of the belt connecting the motor 550 and the tacky rolls 546, 548. In this case, too, the rotating speed Nc of the monitoring roll 556 is lower than the lower limit $\alpha_2$. In this event, however, it is possible to inhibit the implementation of step S18. In this fifth embodiment, a portion of the controller 569 assigned to implement steps S1–S15 and S18 constitutes means for diagnosing the tacky rolls 546, 548 for contamination. Further, the rotary encoder 566 functions as means for detecting the rotating speed Nc of the monitoring roll 556, while the motor 550 serves as means for driving the tacky rolls 546, 548.

If the predetermined diagnosis time tc has elapsed with the speed Nc kept equal to or higher than the lower limit $\alpha_2$, step S16 is implemented to activate the pneumatic cylinder 562 to move the monitoring roll 556 away from the tacky roll 548. Then, step S17 is implemented to press the cleaning head 574 against the monitoring roll 556, turn on the motor 572 to rotate the roll 556, and energize the cleaning head 574 for cleaning the roll 556. If step S18 is implemented with a negative decision (NO) obtained in step S14, the control flow then goes to step S19 to activate the pneumatic cylinders 555 for bringing the contaminated tacky roll device 542, 544 to the non-operating position while bringing the non-contaminated tacky roll device 542, 544 to the operating position. Then, the tacky rolls 546, 548 of the contaminated tacky roll device 542, 544 in the non-operating position are cleaned by the respective cleaning device 582, 576. As soon as the non-contaminated tacky roll device 542, 544 is placed in the operating position, the control returns to step S11, and the normal operation of the cleaning apparatus to clean the strips 14 is continued. Therefore, the cleaning of the contaminated tacky roll device 542, 544 is effected without interruption of the operation of the pressing system including the pressing machine 174. The belt feeder 16 and the feeding motor 56 may be temporarily turned off if it takes a considerable time to switch the positions of the tacky roll devices 542, 544 and raise the speed of the motor 550 to the predetermined operating level.

It will be understood that the present fifth embodiment uses the monitoring roll 556 which is rotated in rolling contact with the tacky roll 548 driven by the motor 550, so that the contamination of the tacky rolls 546, 548 is effected on the basis of the rotating speed Nc of the monitoring roll 556 as compared with the predetermined lower limit $\alpha_2$. Thus, the switching of the tacky roll devices 542, 544 and the cleaning of the tacky rolls 546, 548 can be accomplished when necessary. Further, the present embodiment selectively using the two tacky roll devices 542, 544 assures improved operating efficiency of the pressing machine 174, without interruption of the operation of the pressing system, since the two tacky roll devices 542, 544 are switched so that the non-contaminated tacky roll device 542, 544 is placed in the operating position for cleaning the strip 14 while at the same time the rolls 546, 548 of the contaminated tacky roll device 542, 544 are cleaned in the non-operating position. Since the cleaning devices 582, 576 for cleaning the tacky rolls 546, 548 are built in the cleaning apparatus, the tacky rolls 546, 548 can be easily cleaned without removal from the cleaning apparatus.

It is possible to suitably change the condition for determination in step S18 of the contamination of the tacky rolls 546, 548. For instance, step S18 is implemented when the negative decision (NO) in step S14 is obtained a predetermined number of times, namely, for a predetermined number of the successive strips 14. The routine of FIG. 32 may be executed each time a predetermined number of the strips 14 have been cleaned. Further, two or more different lower limit values for the rotating speed Nc may be provided so as to detect the gradual contamination of the tacky rolls 546, 548 and indicate the degree of contamination in steps.

The diagnosis for contamination of the tacky rolls 546, 548 may be based on a difference between the rotating speeds Nc and Nn of the monitoring and tacky rolls 556 and 548, as compared with a predetermined upper limit, with a difference in the diameter of the rolls 556, 548 taken into consideration. Further, the diagnosis may be effected with the monitoring roll 556 pressed against the tacky roll 548 while the strip 14 is passing the selected tacky roll device 542, 544.

Figure 33:
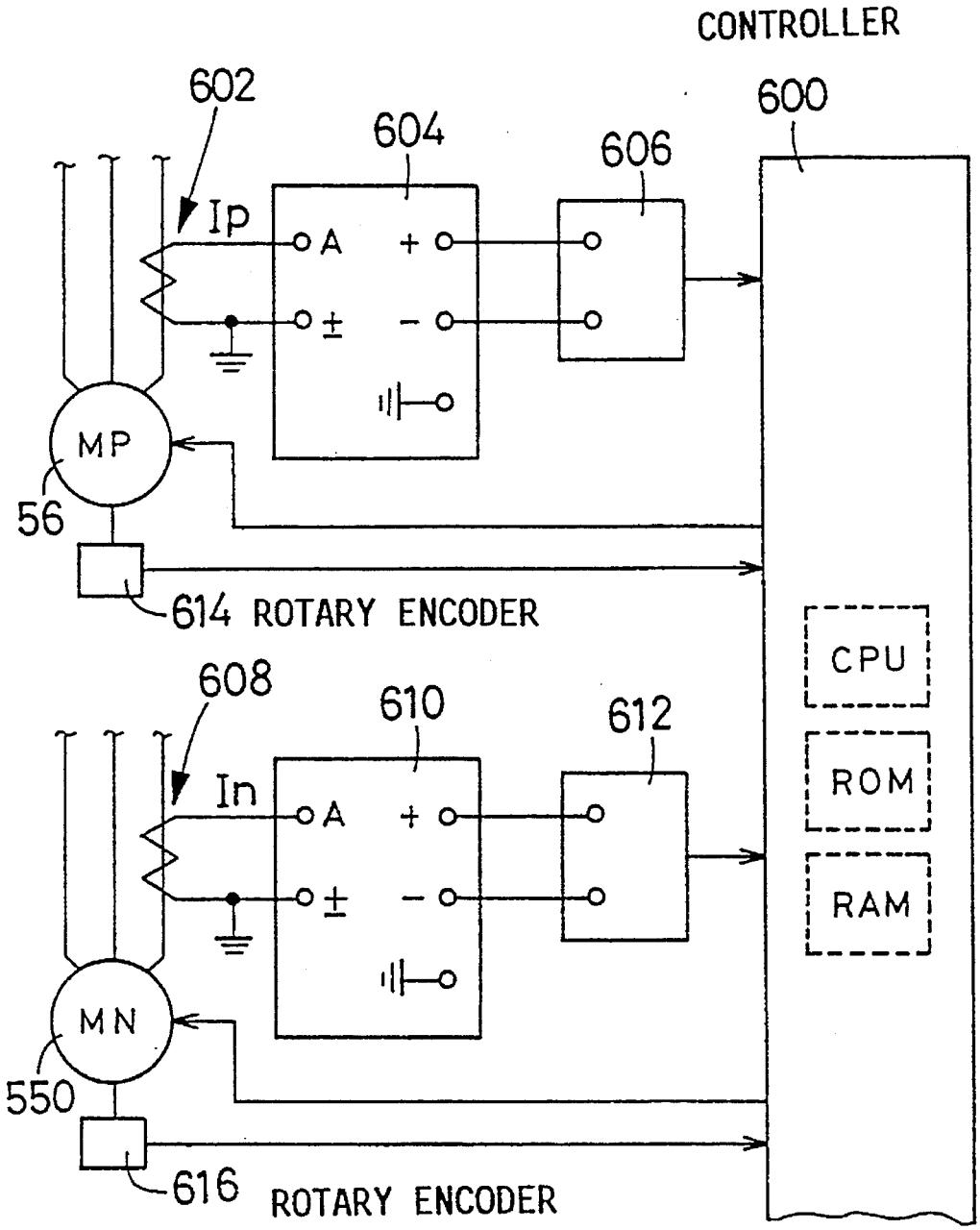
FIG. 33 is a diagram showing a circuit provided in place of the monitoring rolls, for detecting currents Ip and In of strip feeding motor and a roll drive motor, for detecting contamination of the tacky rolls of FIG. 29.
Figure 34:
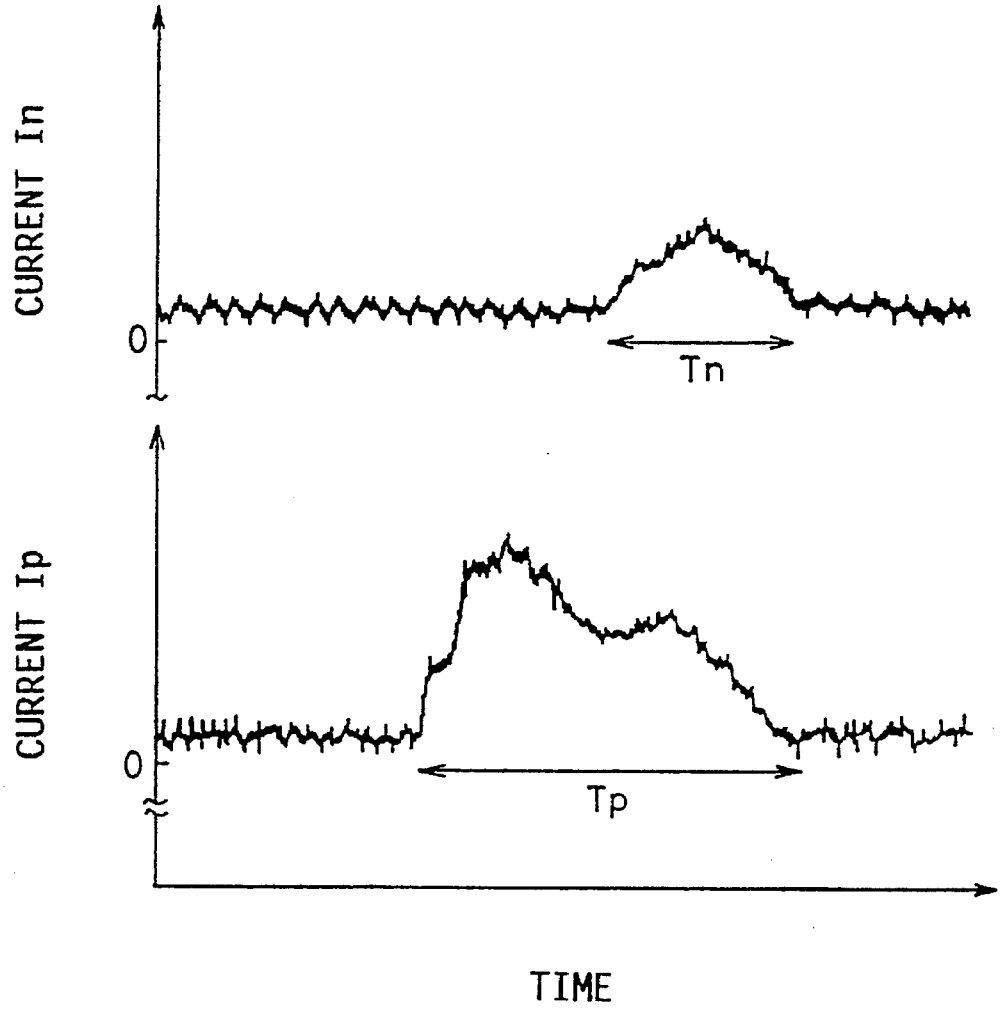
FIG. 34 is a time chart indicating changes in the currents Ip and In of FIG. 33 when the workpiece strip passes through the tacky roll device.

Referring to FIG. 33, there is shown a controller 600 used in a sixth embodiment of this invention, which is different from the preceding fifth embodiment of FIGS. 29–32 in that the monitoring roll 556 is not used in the sixth embodiment for diagnosing the tacky rolls 546, 548 for contamination. In the present embodiment, the controller 600 is adapted to effect the diagnosis of the tacky rolls 546, 548 on the basis of an on-load current Ip of the feeding motor 56 for the strip 14, or an on-load current In of the motor 550 for driving the tacky rolls 546, 548. Each of the motors 56, 550 is a three-phase AC motor which is controlled in a feed-back fashion according to the signals received from rotary encoders 614, 616, so that the strip 14 is fed at a predetermined speed through the cleaning apparatus. The load torque values of the motors 56, 550 while the strip 14 is fed through the apparatus are larger than those when the strip 14 is not fed, namely, when the motors 56, 550 are in the substantially off-load state. The current values Ip and In of the motors 56, 550 vary as indicated in the graph of FIG. 34, for example. The load torque values of the motors 56, 550 vary with the tacky forces (tackiness values) of the tacky rolls 546, 548. Accordingly, excessive reduction in the tacky forces of the tacky rolls 546, 548, which means contamination of these rolls, can be detected based on the amounts of the load currents Ip, In which correspond to the load torque values of the motors. It is noted that the motor 550 also functions to feed the strip 14 at the predetermined speed. In FIG. 34, a time period Tn is a period during which the current level In of the motor 550 is relatively high with the strip 14 passing through the presently selected tacky roll device 542, 544, while a time period Tp is a period during which the current level Ip of the motor 56 is relatively high with the strip 14 being fed through the feed path in the cleaning apparatus, which is partially defined by the tacky rolls 546, 548. Although the present sixth embodiment is adapted to diagnose the tacky rolls 546, 548 as used in the fifth embodiment of FIGS. 29–31, on the basis of the current Ip of the motor 56 or the current In of the motor 550, the principle of this sixth embodiment is also applicable to the other preceding embodiments, for instance, to diagnose the tacky rolls 110*a*, 110*b*, 112*a*, 112*b* on the basis of the current of the motor 56 or 124, 140.

In FIG. 33, the current Ip of the feeding motor 56 is detected by a current transformer 602 whose output is converted by a convertor 604 into a direct-current signal of DC4–20 mA. The direct-current signal is converted by an A/D converter 606 into a digital signal, which is fed to the controller 600. On the other hand, the current In of the drive motor 550 is detected by a current transformer 608 whose output is converted by a convertor 610 into a direct-current signal of also DC4–20 mA. This direct-current signal is converted by an A/D converter 612 into a digital signal, which is also fed to the controller 600. The current transformers 602, 608 serve to means for detecting load torque values of the motors 56, 550. Like the controller 66, 534, 569, the controller 600 controls the operation of the cleaning apparatus as a whole, and is connected to the operator's control panel 172 as described with respect to the first embodiment. The controller 600 receives various signals from the control panel 172, which represent various set values, etc. entered through the control panel 172. The controller 600 is also connected to the pressing machine 174, and receives therefrom a signal indicative of the kind of the strip 14, namely, the identification number of the product produced from the strip 14.

Figure 35:
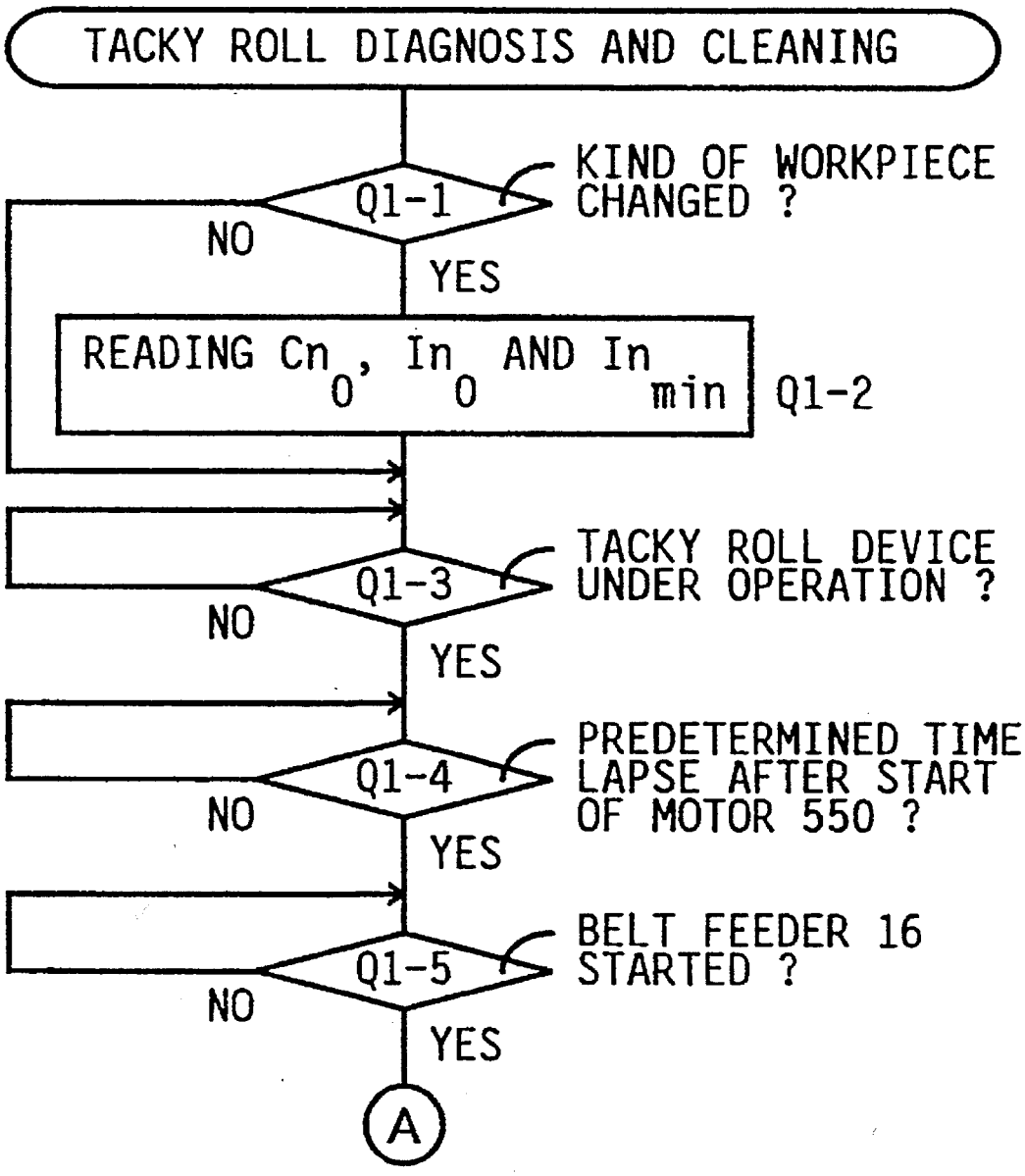
Figure 36:
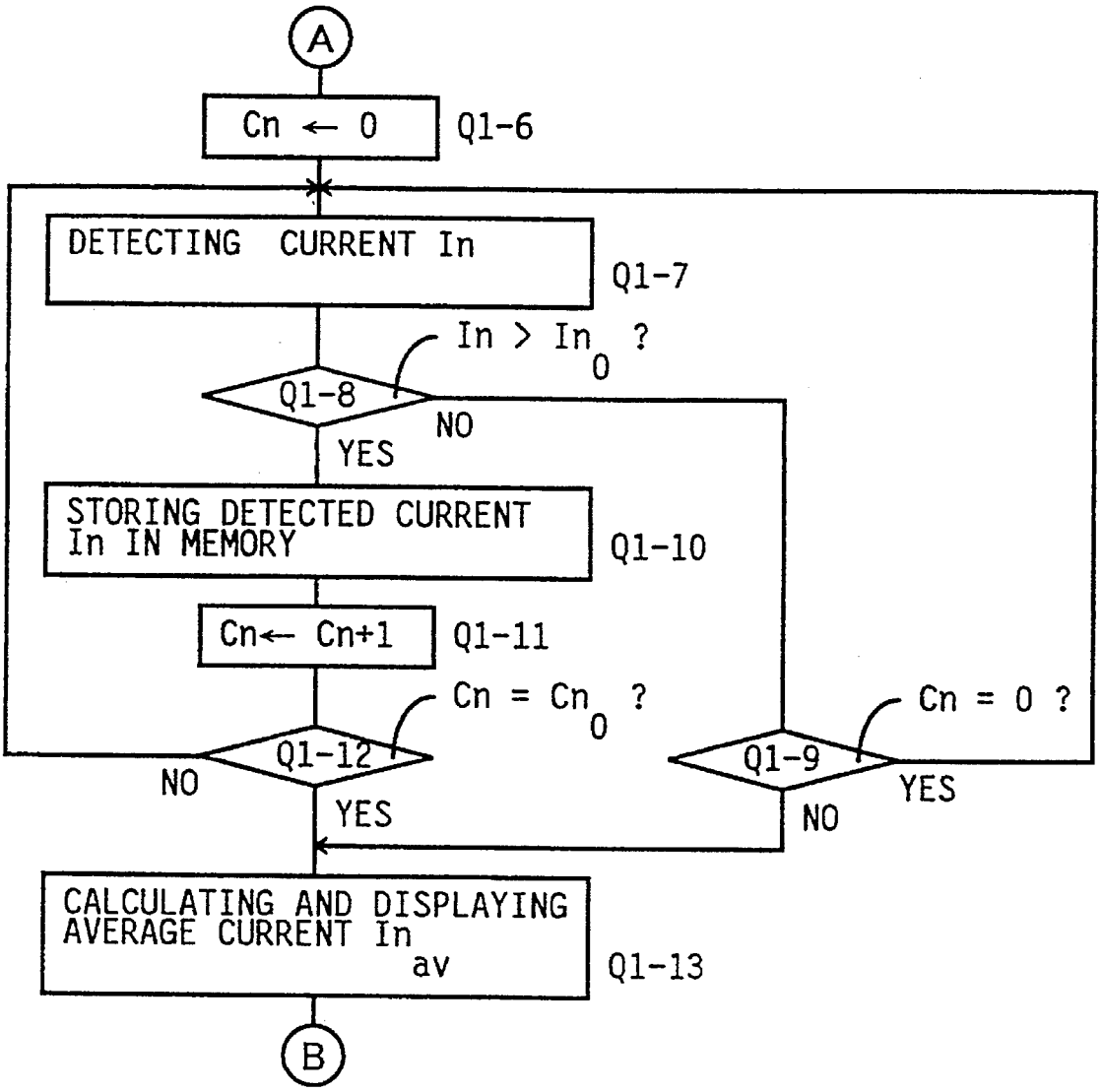
Figure 37:
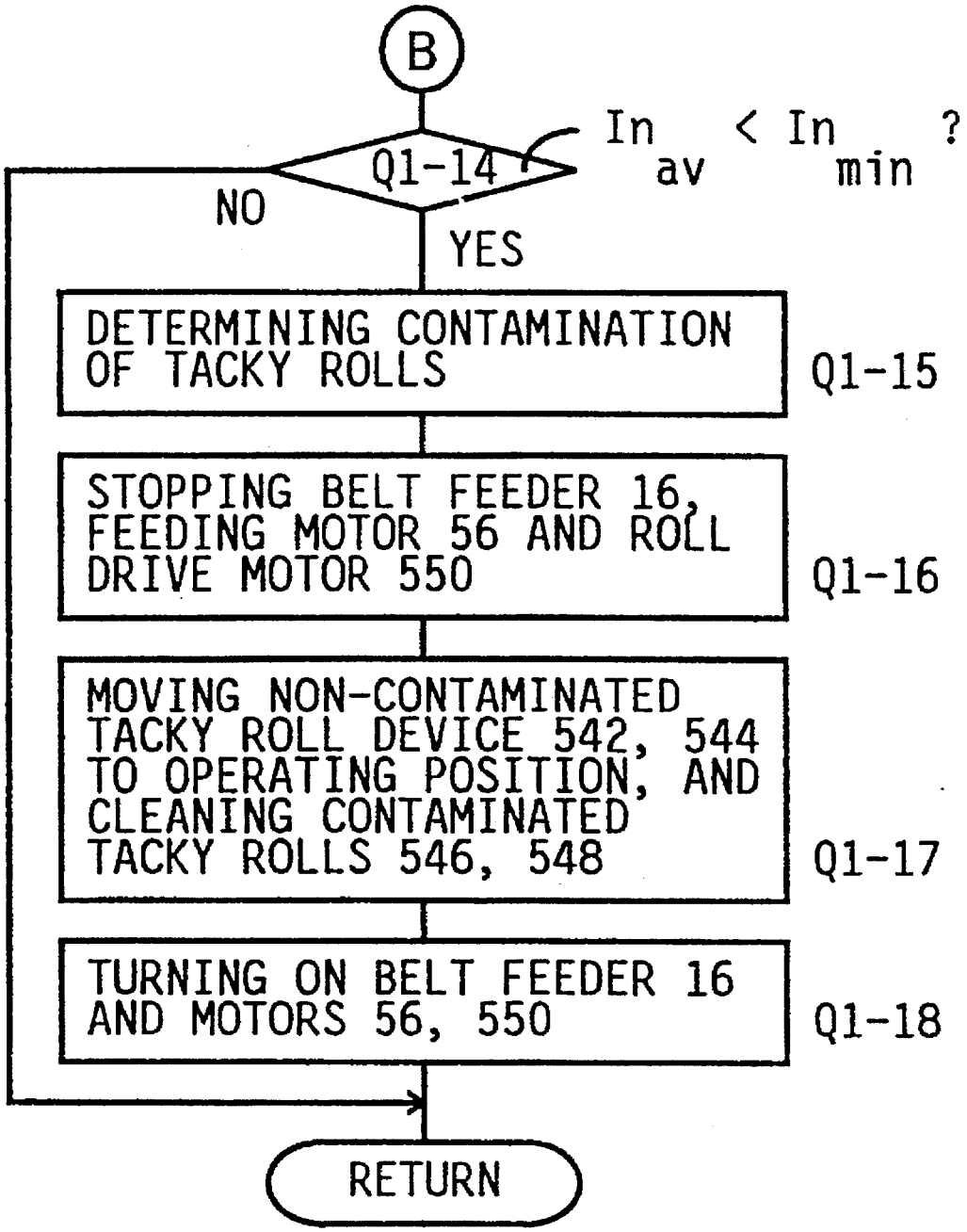

Referring to the flow chart of FIGS. 35–37, there is shown a routine for diagnosing and cleaning the tacky rolls 546, 548, according to a first form of the sixth embodiment, wherein the tacky rolls 546, 548 are diagnosed for contamination, on the basis of the current In of the motor 550 for rotating the tacky roll 548. In this form, the detection of the current Ip of the motor 56 is not necessary. The routine is initiated with step Q1—1 (FIG. 35) to determine, on the basis of the signal from the pressing machine 174, whether the kind of the workpiece strip 14 has changed or not. The signal from the pressing machine 174 indicates the part identification number, namely, the kind of the strip 14. If a negative decision (NO) is obtained in step Q1—1, the control flow goes to step Q1–3. If an affirmative decision (YES) is obtained in step S1—1, that is, if the kind of the strip 14 has changed, step Q1–2 is implemented. While the controller 600 is adapted to receive from the pressing machine 174 the signal indicative of the kind of the strip 14, the operator may designate the kind of the strip 14 through the control panel 172. In step Q1–2 implemented when the kind of the strip 14 has changed, the controller 600 reads out from its random-access memory (RAM) data representative of threshold values used for the new kind of the strip 14, that is, upper limit $Cn_0$ of a counter Cn, off-load upper limit $In_0$ of the current In of the motor 550, and diagnosis threshold $In_{min}$ of the current In. These threshold values $Cn_0$, $In_0$ and $In_{min}$ are entered through the control panel 172 and stored in the RAM of the controller 600, for each kind of the strip 14. The upper limit $Cn_o$ represents the number of the current values In which are sampled for obtaining an average current $In_{av}$. The current values In are sampled during a predetermined sampling period while the strip 14 is passing through the tacky roll device 542, 544. The upper limit $Cn_0$, i.e., the number of the current values In to be sampled is determined depending upon the length and feeding speed of the strip 14, and the sampling period. The off-load upper limit $In_0$ represents the maximum current value In of the motor 550 while the tacky rolls 546, 548 are not in contact with the strip 14, that is, while the strip 14 is not passing through the tacky roll device 542, 544. This value $In_0$ is used for determining whether the strip 14 is passing through the tacky roll device 542, 544. Where the gap between the two tacky rolls 546, 548 is constant irrespective of the kind of the strip 14, the load torque and current In of the motor 550 vary with the thickness of the strip 14, and also with the size and weight of the strip 14. In view of this fact, the off-load upper limit $In_0$ is set for each specific kind of the strip 14. However, the upper limit $In_0$ may be constant for all kinds of the strip 14. The diagnosis threshold $In_{min}$ is a lower limit of the average current $In_{av}$ of the motor 550 below which the tacky force of the tacky roll 546, 548 is insufficient to remove the foreign matters from the strip 14. This threshold value $In_{min}$ is determined depending on the kind of the strip 14, that is, material (which affects the surface smoothness or ease of slip), thickness and size of the strip 14, and entered through the control panel 172. It is noted that a decrease in the tacky force of the tacky roll 546, 548 causes a decrease in the load torque of the motor 550, which results in a decrease in the current In.

Step Q1–2 is followed by step Q1–3 to determine, on the basis of the drive signal applied to the motor 550, whether the tacky roll device 542, 544 is in operation or not. If an affirmative decision (YES) is obtained in step Q1–3, the control goes to step Q1–4 to determine, on the basis of the output of a suitable timer, whether a predetermined time has elapsed after the energization of the roll drive motor 550 or not. The motor 550 for the selected one of the two tacky roll devices 542, 544 is controlled in a feed-back manner, and the current In of the motor 550 is detected. The feeding motor 56 and the roll drive motor 550 are turned on by depression of a start switch provided on the pressing machine 174. Since the current In temporarily rises beyond the normal operating level immediately after the start of the motor 550, the suitable time is allowed before the following steps Q1–5 et. seq. are implemented. To this end, step Q1–4 is provided. Step Q1–5 is provided to determine, on the basis of the drive signal applied to the belt feeder 16, whether the belt feeder 16 has been turned on or not, that is, whether the strip 14 has been received from the belt feeder 16 or not. If an affirmative decision (YES) is obtained in step Q1–5, the control flow then goes to step Q1–6 (FIG. 36). Step Q1–5 may be adapted to determine, on the basis of the output signal of the photoelectric tube 26, whether the strip 14 has been loaded onto the cleaning apparatus or not.

In step Q1–6, the counter Cn is reset to zero. Step Q1–6 is followed by step Q1–7 to detect the current In of the motor 550 during a predetermined sampling period, about 0.01 sec. for example. This sampling period may be set for each kind of the strip 14, through the control panel 172. Step Q1–7 is followed by step Q1–8 to determine whether the current In is larger than the off-load upper limit $In_0$ or not, in other words, whether the strip 14 is now passing through the selected tacky roll device 542, 544 or not. If the current In is not larger than the off-load upper limit $In_0$, the control goes to step Q1–9 to determine whether the content of the counter Cn is equal to "0" or not. If the content of the counter Cn is "0", that is, if the strip 14 has not yet reached the tacky roll device 542, 544, the control returns to step Q1–7. If the strip 14 has reached the tacky roll device 542, 544 and the load torque of the motor 550 rises to such an extent that the current In exceeds the off-load upper limit $In_0$, an affirmative decision (YES) is obtained in step Q1–8, and step Q1–10 is implemented to store the presently detected current In in the RAM of the controller 600. Then, step Q1–11 is implemented to increment the counter Cn. Step Q1–11 is followed by step Q1–12 to determine whether the content of the counter Cn has reached the upper limit $Cn_0$. If a negative decision (NO) is obtained in step Q1–12, steps Q1–7 through Q1–12 are repeatedly implemented until an affirmative decision (YES) is obtained in step Q1–12. If the affirmative decision (YES) is not obtained in step Q1–8 even after a predetermined time has passed after the affirmative decision (YES) is obtained in step Q1–5, a suitable alarm may be provided to indicate a possible occurrence of abnormality such as disconnection of the belt 432.

When the current In falls below the off-load upper limit $In_0$ due to the passage of the strip 14 away from the tacky roll device 542, 544, the negative decision (N0) is obtained in step Q1–8. In this case, the control goes to step Q1–9. Since the content of the counter Cn is not "0" at this time, the control goes to step Q1–13. The control also goes to step Q1–13 when the content of the counter Cn has reached the upper limit $Cn_0$, that is, when the predetermined number of the current values In have been stored. In step Q1–13, the current values In stored in step Q1–10 are summed, and the sum is divided by the present count of the counter Cn to obtain the average current $In_{av}$. The obtained average current $In_{av}$ is indicated on the control panel 172. The current value In detected in step Q1–7 and the off-load upper limit $In_0$ may also be indicated on the control panel 172. It is noted that the current values In stored in step Q1–10 are erased in step Q1–6 when the routine of FIGS. 35–37 is executed next time.

Step Q1–13 is followed by step Q1–14 (FIG. 37) to determine whether the average current $In_{av}$ is smaller than the diagnosis threshold $In_{min}$ or not, in other words, whether the tacky forces of the tacky rolls 546, 548 have been lowered to a level that does not permit the tacky rolls 546, 548 to effectively remove the foreign matters from the strip 14. If a negative decision (NO) is obtained in step Q1–14, the control returns to step Q1—1 to repeat the subsequent steps described above. If an affirmative decision (YES) is obtained in step Q1–14, the control goes to step Q1–15 to determine that the tacky rolls 546, 548 have been contaminated, and indicate this fact on the control panel 172. Step Q1–15 is followed by step Q1–16 to turn off the belt feeder 16, feeding motor 56 and roll drive motor 550. Step Q1–17 is then implemented to activate the pneumatic cylinders 555 to switch the tacky roll devices 542, 544 and clean the tacky rolls 546, 548 of the contaminated tacky roll device 542, 544 by the corresponding cleaning device 582, 576. As soon as the contaminated and non-contaminated tacky roll devices 542, 544 have been placed in the non-operating and operating positions, step Q1–18 is implemented to turn on the belt feeder 16, feeding motor 56 and roll drive motor 550 for the non-contaminated tacky roll device, thereby resuming the operation of the cleaning apparatus. Thus, the cleaning of the tacky rolls 546, 548 of the contaminated tacky roll device is started after the strip cleaning operation of the cleaning apparatus is resumed.

In the present form according to the sixth embodiment, too, the tacky rolls 546, 548 are diagnosed for contamination, and the contaminated tacky rolls 546, 548 are replaced by the non-contaminated tacky rolls, without interrupting the operation of the pressing system. The operation of the cleaning apparatus is interrupted for a minimum length of time necessary to switch the contaminated and non-contaminated tacky roll devices 542, 544. Thus, the operating efficiency of the pressing machine 174 is improved as in the preceding embodiments. Further, the present sixth embodiment is adapted to diagnose the tacky roll devices 542, 544 on the basis of the current In of the roll drive motor 550, and does not require the monitoring roll 556 as used in the fifth embodiment. In this respect, the present cleaning apparatus is simpler in construction and more economical to manufacture. In the present form of the invention, a portion of the controller 600 assigned to implement steps Q1—1 through Q1–15 constitutes means for diagnosing the tacky rolls 546, 548 for contamination.

Figure 38:
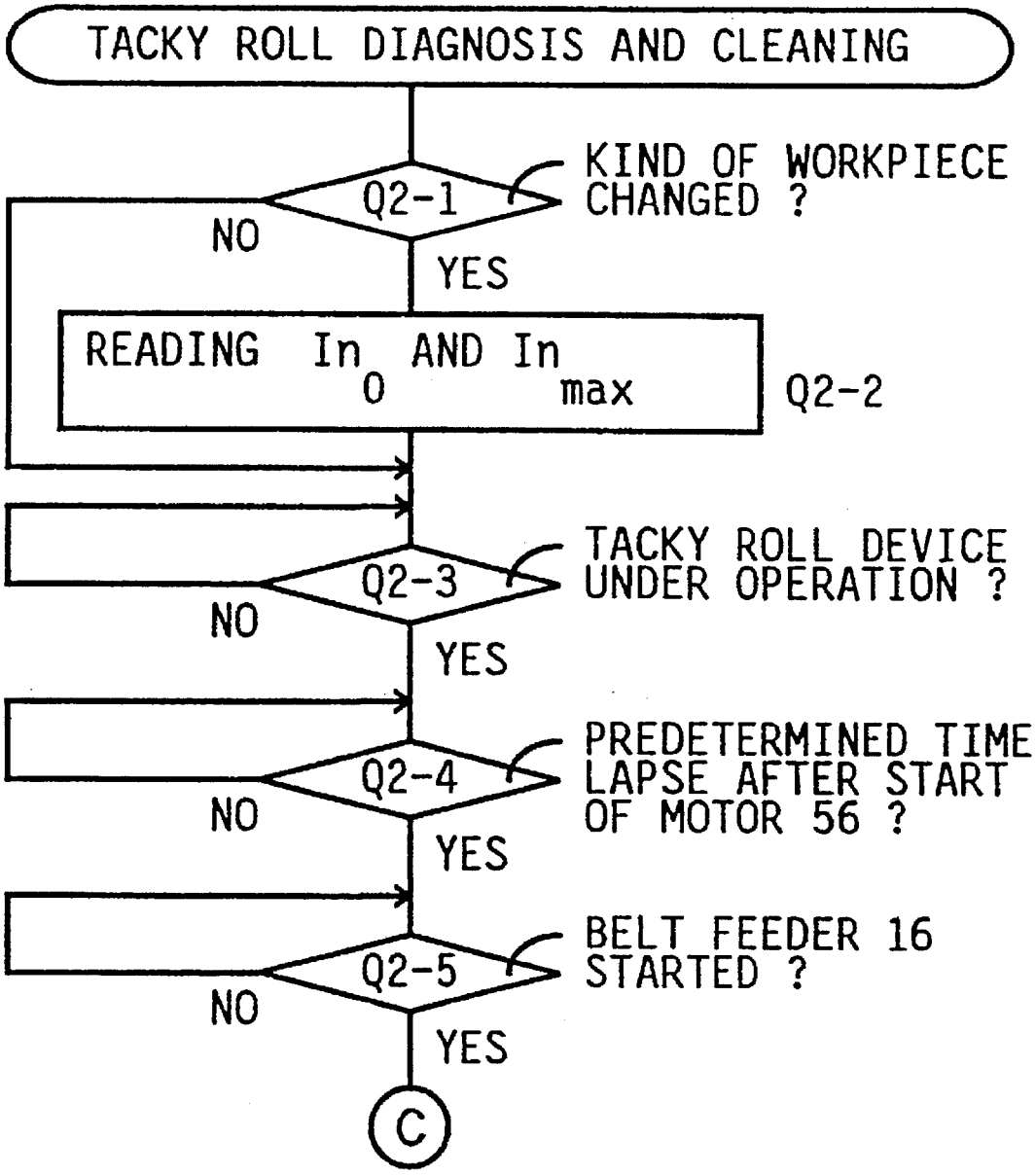
Figure 39:
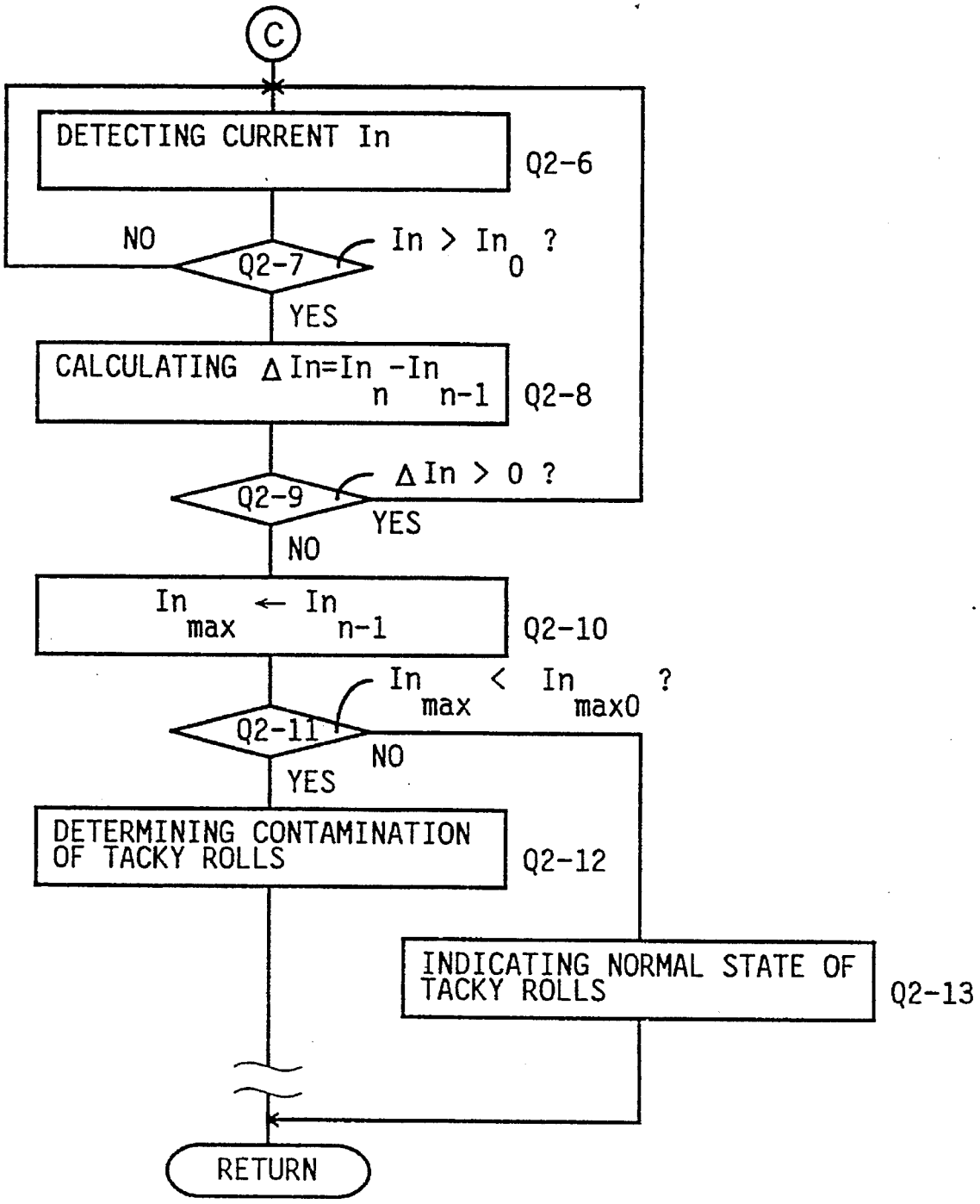

Referring to the flow chart of FIGS. 38 and 39, there is shown a routine for diagnosing and cleaning the tacky rolls 546, 548, according to a second form of the sixth embodiment, wherein the tacky rolls 546, 548 are diagnosed for contamination, also on the basis of the current In of the motor 550 for the tacky roll 548. In this second form, however, a maximum value $In_{max}$ of the current In of the motor 550 is used for the diagnosis. In the interest of simplification, those portions of this routine which are identical with the corresponding portions of the routine of FIGS. 35–37 will be omitted. Initially, there will be described step Q2—2 of FIG. 38 which is implemented when the kind of the strip has changed. In this step Q2—2, the controller 600 reads out from its random-access memory (RAM) the off-load upper limit $In_0$ and a diagnosis threshold $In_{max}{}^0$ of the current In of the motor 550, for the new kind of the strip 14. The diagnosis threshold $In_{max}^0$ is a lower limit of the maximum current value $In_{max}$ of the motor 550 below which the tacky force of the tacky roll 546, 548 is insufficient to remove the foreign matters from the strip 14. This threshold value $In_{max}^0$ is determined depending on the kind of the strip 14, that is, material (which affects the surface smoothness or ease of slip), thickness and size of the strip 14, and entered through the control panel 172. It is noted that a decrease in the tacky force of the tacky roll 546, 548 causes a decrease in the load torque of the motor 550, which results in a decrease in the maximum current value $In_{max}$.

Referring to FIG. 39, step Q2–6 to be implemented after the belt feeder 16 has been turned on is provided to detect the current In of the motor 550. Step Q2–6 is followed by step Q2–7 to determine whether the current In is larger than the off-load upper limit $In_0$ or not, in other words, whether the strip 14 is now passing through the selected tacky roll device 542, 544 or not. The detected current In and the off-load upper limit $In_0$ may be indicated on the control panel 172. If the current In is not larger than the off-load upper limit $In_0$, that is, if the strip 14 has not reached the tacky roll device 542, 544, the control returns to step Q2–6. If the strip 14 has reached the tacky roll device 542, 544 and the load torque of the motor 550 rises to such an extent that the current In exceeds the off-load upper limit $In_0$, an affirmative decision (YES) is obtained in step Q2–7, and step Q2–8 is implemented to calculate an amount of change AIn, which is a difference ($In_n$–$In_{n-1}$) obtained by subtracting the current $In_{n-1}$ sampled in step Q2–8 in the last cycle of execution of the routine, from the current $In_n$ sampled in step Q2–8 in the present cycle. Step Q2–8 is followed by step Q2–9 to determine whether the calculated amount of change ΔIn is a positive value or not. If the amount of change ΔIn is positive, the control returns to step Q2–6, and steps Q2–6 through Q2–9 are repeatedly implemented until the amount of change ΔIn becomes equal to zero or negative. If the amount of change ΔIn is zero or negative, this means that the current In has begun to decrease. In this case, step Q2–10 is implemented to set the last current value $In_{n-1}$ as the maximum current value $In_{max}$. This maximum current value $In_{max}$ and the diagnosis threshold $In_{max}^0$ may be indicated on the control panel 172.

Step Q2–10 is followed by step Q2–11 to determine whether the maximum current value $In_{max}$ is smaller than the diagnosis threshold $In_{max}^0$, namely, whether the tacky forces of the tacky rolls 546, 548 have been reduced to such extent that does not permit the tacky rolls 546, 548 to effectively remove the foreign matters from the strip 14. If a negative decision (NO) is obtained in step Q2–11, step Q2–13 is implemented to provide an indication on the control panel 172 or other indicator means, that the tacky rolls 546, 548 are normal. Then, the control returns to step Q2-1 to repeat the routine. If an affirmative decision (YES) is obtained in step Q2–11, the control goes to step Q2–12 to determine that the tacky rolls 546, 548 have been contaminated. Step Q2–12 is followed by steps similar to steps Q1–16, Q1–17 and Q1–18 of the routine of FIGS. 35–37. Then, the control returns to step Q2-1.

In the present second form of the sixth embodiment of the invention, too, the tacky rolls 546, 548 can be suitably diagnosed as in the preceding form of FIGS. 35–37, but with improved accuracy in respect of the reduction in the tacky forces of the tacky rolls 546, 548, owing to the use of the maximum current value $In_{max}$ which changes with the tacky forces in a greater degree than the average current value $In_{av}$, and which more accurately reflects a change in the tacky forces. In the present form of the invention, a portion of the controller 600 assigned to implement steps Q2-1 through Q2–12 constitutes means for diagnosing the tacky rolls 546, 548 for contamination.

Figure 40:
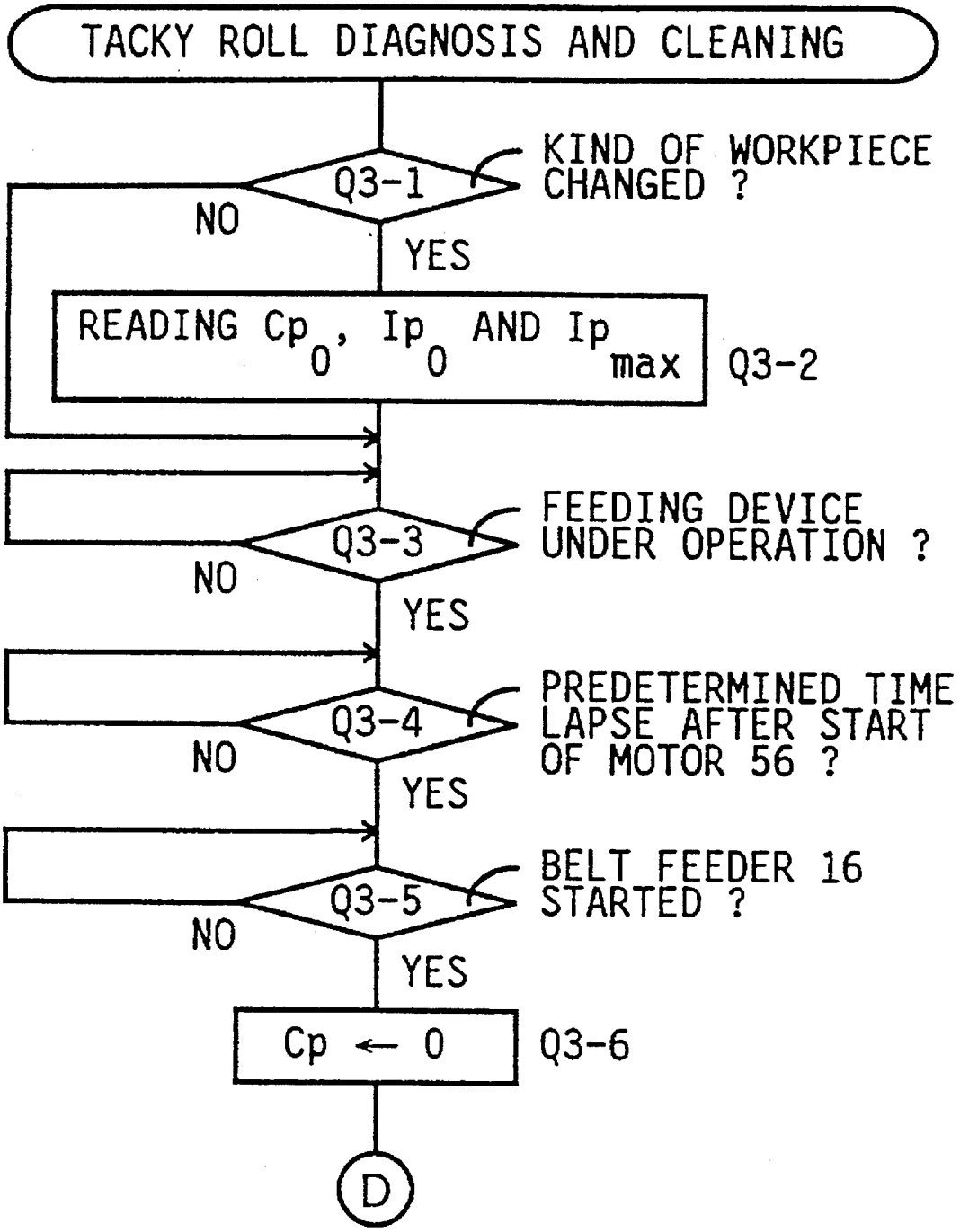
FIGS. 40 and 41 are flow charts illustrating one example of a routine executed by the controller of FIG. 33, for diagnosing the tacky rolls for contamination, on the basis of the detected current Ip.
Figure 41:
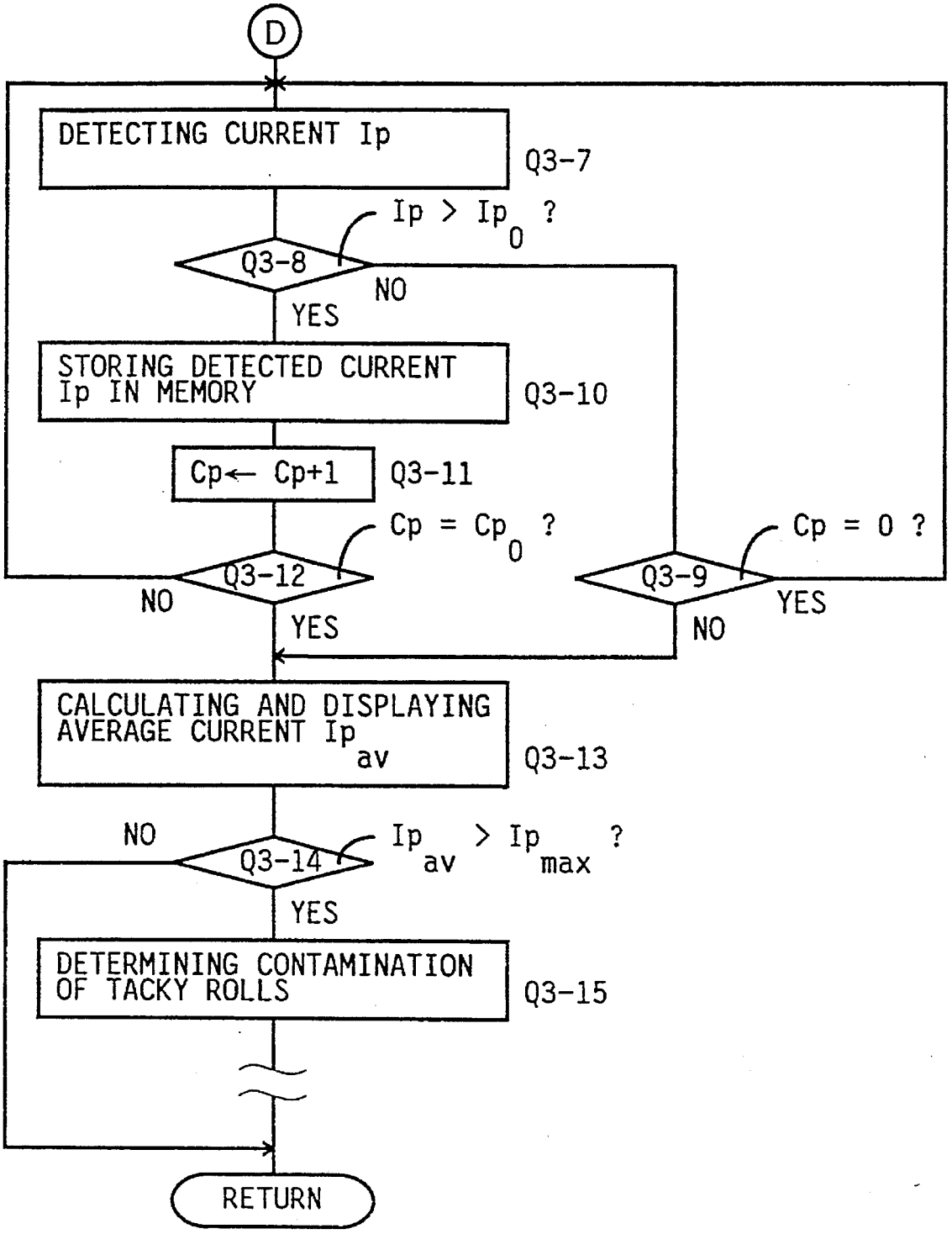

Referring to the flow chart of FIGS. 40 and 41, there is shown a routine for diagnosing the tacky rolls 546, 548 according to a third form of the sixth embodiment of this invention, wherein the current In of the feeding motor 56 is used to diagnose the tacky rolls. In the present arrangement, the detection of the current Ip of the roll drive motor 550 is not necessary. As indicated in FIG. 40, step Q3-2 is implemented when the kind of the strip 14 has changed. For the new kind of the strip 14, the controller 600 reads out from the RAM an upper limit $cp_0$ of a counter Cp, an off-load upper limit $Ip_0$ of the current Ip of the motor 56, and a diagnosis threshold $Ip_{max}$. The upper limit $Cp_0$ represents the number of the current values Ip which are sampled for a predetermined sampling period while the strip is fed through the selected tacky roll device 542, 544. This upper limit $Cp_0$ is determined for each kind of the strip 14, depending upon the length and feeding speed of the appropriate strip 14 and the sampling period. The determined upper limit values $Cp_0$ are entered through the control panel 172 and stored in the RAM of the controller 600. The off-load upper limit $Ip_0$ represents the maximum current value Ip of the motor 56 while the strip 14 is not passing through the tacky roll device 542, 544. This value $Ip_0$ is used for determining whether the strip 14 is passing through the tacky roll device 542, 544, and is entered through the control panel 172 and stored in the above-indicated RAM, for each kind of the strip 14. The diagnosis threshold $Ip_{max}$ is an upper limit of the average current $Ip_{av}$ of the motor 56 below which the tacky forces of the tacky rolls 546, 548 are insufficient to remove the foreign matters from the strip 14. This threshold value $Ip_{max}$ is determined depending on the kind of the strip 14, that is, the surface smoothness or ease of slip, thickness and size of the strip 14, and entered through the control panel 172 and stored in the above-indicated RAM, for each kind of the strip 14. It is noted that the motor 550 which drives the tacky rolls 546, 548 cooperates with the feeding motor 56 to feed the strip 14. As the tacky forces of the tacky rolls 546, 548 are reduced, the force of the motor 550 used to feed the strip 14 is accordingly reduced, whereby the load torque and the current Ip of the feeding motor 56 are accordingly increased. Thus, an increase in the current Ip indicates a decrease in the tacky forces of the tacky rolls 546, 548.

Step Q3—3 is provided to determine, on the basis of the drive signal applied to the feeding motor 56, whether the feeding device is in operation or not, and step Q3–4 is provided to determine whether a predetermined time has lapsed after the activation of the feeding motor 56. These steps Q3—3 and Q3–4 are substantially the same as the corresponding steps Q1–3 and Q1–4 of FIG. 35. After the belt feeder 16 is turned on, step Q3–6 and the subsequent steps are implemented. Of these steps, step Q3–13 indicated in FIG. 41 is provided to calculate an average current $Ip_{av}$ of the feeding motor 56. These steps Q3–6 through Q3–13 are substantially the same as the corresponding steps Q1–6 through Q1–13. Then, step Q3–14 is implemented to determine whether the calculated average current $Ip_{av}$ is larger than the diagnosis threshold $Ip_{max}$ or not. If an affirmative decision (YES) is obtained in step Q3–14, step Q3–15 is implemented to determine that the tacky rolls 546, 548 have been contaminated. In this case, the tacky roll devices 542, 544 are switched, and the tacky rolls 546, 548 of the contaminated tacky roll device 542, 544 are cleaned as in the preceding first and second forms of this sixth embodiment.

In this third form of the invention, a portion of the controller 600 assigned to implement steps Q3-1 through Q3–15 constitutes means for diagnosing the tacky rolls 546, 548 for contamination.

It is noted that a change in the current Ip of the feeding motor 56 takes place only while the strip 14 is passing through the tacky roll device 542, 544, that is, during only the time duration Tn as indicated in the graph of FIG. 34. In this respect, therefore, the diagnosis of the tacky rolls 546, 548 on the basis of the detected current Ip may be effected during only the time duration Tn, which is detected by using a timer as in the fourth embodiment of FIG. 26, or by monitoring a variation in the current In of the roll drive motor 550.

If the cleaning apparatus of this sixth embodiment were adapted such that the tacky rolls 546, 548 are rotated by a feeding movement of the strip 14, without the roll drive motor 550, as in the fourth embodiment of FIG. 20, the current Ip of the feeding motor 56 decreases as the tacky rolls 546, 548 are contaminated. In this case, therefore, the diagnosis of the tacky rolls 546, 548 is effected by determining whether the average current $Ip_{av}$ is smaller than a predetermined diagnosis threshold $Ip_{min}$, as in the step Q1–14 in the first form of the sixth embodiment of FIGS. 35–37.

Figure 42:
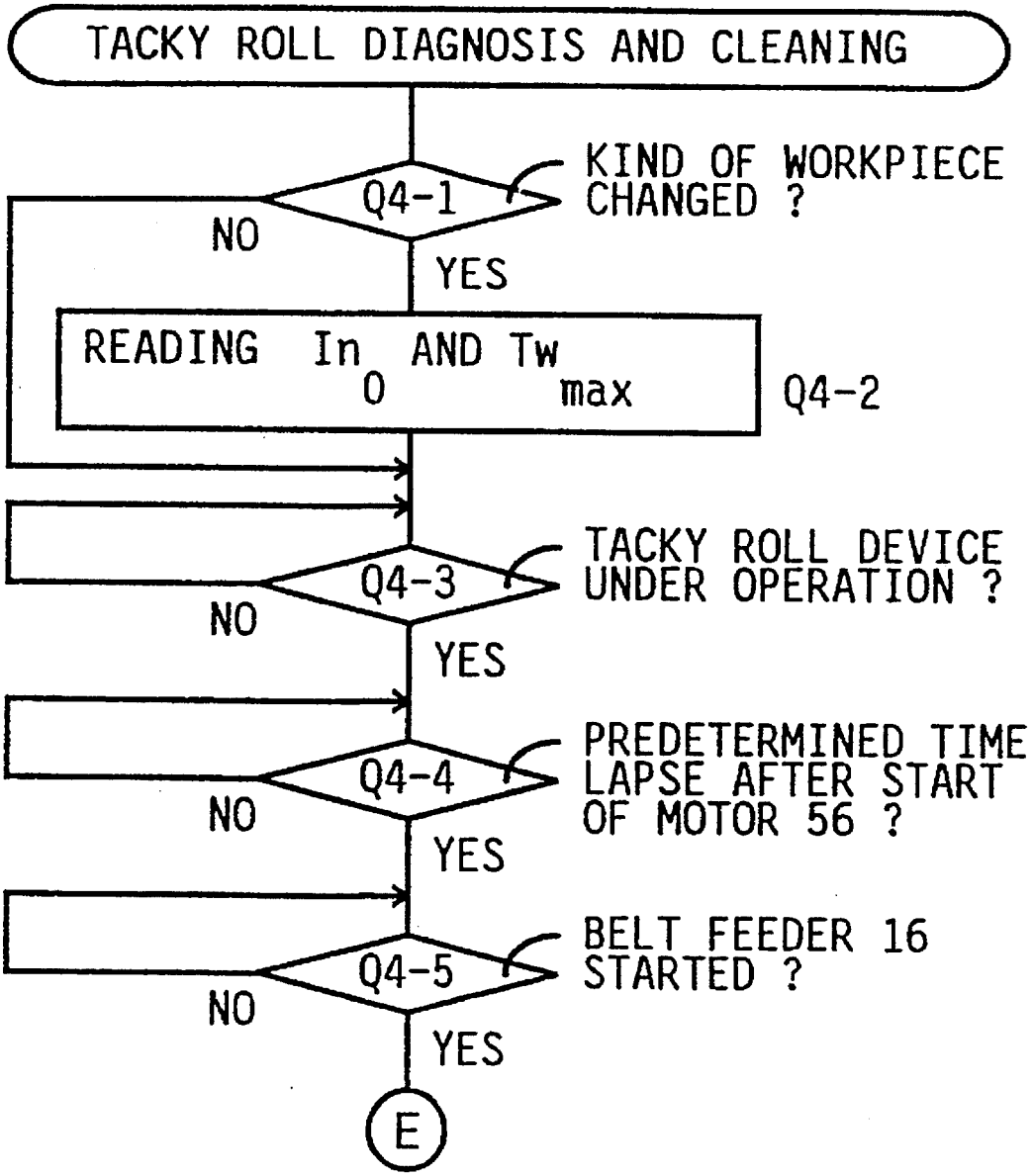
FIGS. 42 and 43 are flow charts illustrating one example of a routine executed by the controller of FIG. 33, for diagnosing the tacky rolls for contamination, on the basis of the detected current In and a time of passage of the strip through the tacky rolls.
Figure 43:
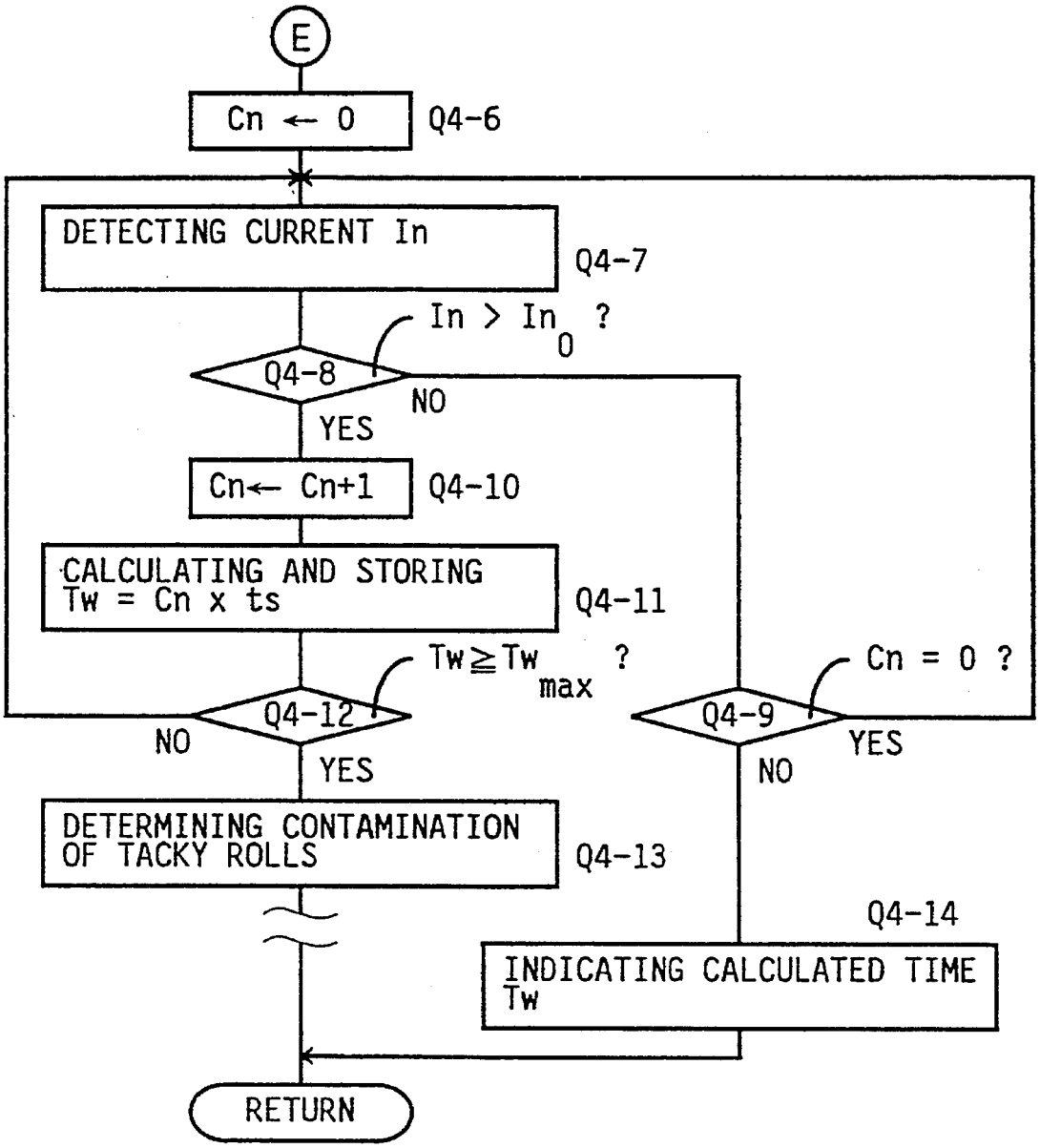

Referring to the flow chart of FIGS. 42 and 43, there is shown a fourth form of the sixth embodiment, in which the feed path of the strip 14 has a portion in which the strip 14 is fed through the tacky roll device 542, 544 by only the tacky rolls 546, 548, without contact with the pinch rolls 420, 422. In this case, the distance between the upstream and downstream pinch rolls 420 and 422 is larger than the length dimension of the strip 14, or only the upstream or downstream pinch rolls 420, 422 are provided. In this form of the invention, the tacky rolls 546, 548 are diagnosed for contamination, on the basis of a time required for the strip 14 to pass all the way through the tacky roll device 542, 544. To this end, step Q4-2 shown in FIG. 42 implemented upon changing of the kind of the strip 14 is provided to read out an off-load upper limit $In_0$ of the current In of the motor 550 and a diagnosis threshold value $Tw_{max}$. This threshold value $Tw_{max}$ is an upper limit of a passage time Tw required for the strip 14 to pass through the tacky roll device 542, 544. If the passage time Tw of the strip 14 exceeds this upper limit $Tw_{max}$, this means that the tacky forces of the tacky rolls 546, 548 are reduced and insufficient for effective removal of the foreign matters from the strip 14. The diagnosis threshold $Tw_{max}$ is determined depending upon the kind of the strip 14, namely, material (which affects the surface smoothness or ease of slip), thickness and size of the strip 14. The determined threshold $Tw_{max}$ is entered through the control panel 172 and stored in the RAM of the controller 600. In the present arrangement wherein the strip 14 is fed through the tacky roll device 542, 544 by only the tacky rolls 546, 548, reduction in the tacky forces of the tacky rolls 546, 548 results in an increase in the amount of slip of the strip 14 with respect to the tacky rolls, and a decrease in the feeding speed of the strip 14, whereby the passage time Tw of the strip 14 required to pass through the tacky roll device 542, 544 increases as the tacky rolls are contaminated.

As indicated in FIG. 43, step Q4–6 is implemented after the activation of the belt feeder 16, to reset a counter Cn. Then, the control flow goes to step Q4–7 to detect the current In of the motor 550, and step Q4–8 to determine whether the current In is larger than the off-load upper limit $In_0$, in other words, whether the strip 14 is passing through the tacky roll device 542, 544, or not. If a negative decision (NO) is obtained in step Q4–8, step Q4–9 is implemented to determine whether the content of the counter Cn is "0" or not. If the content of the counter Cn is "0", that is, if the strip 14 has not reached the tacky roll device 542, 544, the control returns to step Q4–7. When the strip 14 has reached the tacky roll device 542, 544 with a result of an increase in the load torque of the roll drive motor 550, the current In exceeds the upper limit $In_0$ whereby an affirmative decision (YES) is obtained in step Q4–8, and step Q4–10 is implemented to increment the counter Cn. In the next step Q4–11, the present content of the counter Cn is multiplied by a sampling period ts of the current In, to calculate the passage time Tw of the strip 14. The calculated passage time Tw is stored in the RAM of the controller 600.

Then, the control flow goes to step Q4–12 to determine whether the passage time Tw is equal to or larger than the diagnosis threshold $Tw_{max}$ or not. If a negative decision (NO) is obtained in step Q4–12, the control returns to step Q4–7. The passage time Tw stored in step Q4–11 is erased in step Q4–10 in the next cycle of execution of the present routine. If the strip 14 has passed all the way through the tacky roll device 542, 544, the current In of the motor 550 decreases below the off-load upper limit $In_0$ and the negative decision (NO) is obtained in step Q4–8. However, if the content of the counter Cn increases to such an extent that causes the calculated passage time Tw to be equal to or larger than the diagnosis threshold $Tw_{max}$ before the strip 14 has passed all the way through the tacky roll device 542, 544, an affirmative decision (YES) is obtained in step Q4–12, and step Q4–13 is implemented to switch the tacky roll devices 542, 544 and clean the contaminated tacky roll device 542, 544. If the negative decision (NO) is obtained in step Q4–8, that is, if the strip 14 has passed all the way through the tacky roll device 542, 544 before the affirmative decision (YES) is obtained in step Q4–12, this indicates that the tacky rolls 546, 548 are not contaminated to such an extent that requires the cleaning thereof. In this case, the negative decision (NO) is obtained in step Q4–9, and step Q4–14 is implemented to indicate the passage time Tw of the strip 14 (which has left the tacky roll device 542, 544) on the control panel 172 or other indicator means.

The present fourth form of the sixth embodiment of the invention has the same advantages as the preceding forms, in respect of the diagnosis of the tacky rolls 546, 548 for contamination. It is noted that a portion of the controller 600 assigned to implement steps Q4-1 through Q4–12 constitutes means for diagnosing the tacky rolls 546, 548 for contamination.

Although the passage time Tw calculated from the content of the counter Cn and the sampling period ts is used to diagnose the tacky rolls 546, 548 in the above form of the invention of FIGS. 42 and 43, the tacky rolls may be diagnosed on the basis of the content of the counter Cn as compared with a diagnosis threshold, which is determined depending upon the sampling period ts and the feeding speed and length dimension of the strip 14. In this respect, it is noted that the content of the counter Cn is proportional to the time required for the strip 14 to pass all the way through the tacky roll device 542, 544.

The routine of FIGS. 42 and 43 may be modified so that step Q4–13 is implemented only after the affirmative decision (YES) in step Q4–12 is obtained for a predetermined number of successive strips 14. Further, the routine may be executed each time a predetermined number of strips 14 have been cleaned by the cleaning apparatus. It is also possible to use two or more diagnosis threshold values corresponding to different degrees of contamination of the tacky rolls 546, 548, so that the degree of contamination of the tacky rolls is indicated. These modifications are also applicable to the preceding first, second and third forms of the sixth embodiment which use the current In of the motor 550 or Ip of the motor 56.

While the present invention has been described in detail in its presently preferred embodiments, it is to be understood that the invention is not limited to the details of the illustrated embodiments, but may be embodied with various changes, modifications and improvements, which may occur to those skilled in the art, in the light of the foregoing teachings.

What is claimed is:

1. A cleaning apparatus for removing oily contaminants and other foreign matter from workpieces in the form of strips or sheets having upper and lower surfaces, said cleaning apparatus comprising:

a feeding device for sequentially feeding workpieces through a feed path in a feeding direction;

de-oiling rolls rotatably disposed in an upstream portion of said feed path relative to said feeding direction, said deoiling rolls contacting upper and lower surfaces of each sequentially fed workpiece to thereby absorptively remove oily contaminants from the upper and lower surfaces of said each workpiece;

tacky rolls rotatably disposed downstream of said deoiling rolls relative to said feeding direction said tacky rolls contacting the upper and lower surfaces of said each sequentially fed workpiece to remove foreign matter other than oily contaminants from the upper and lower surfaces of each said workpiece; and a vacuum cleaning device disposed between said de-oiling rolls and said tacky rolls for removing foreign matter from said workpiece via suction, wherein said vacuum cleaning device includes:

a vacuum cleaner head provided with a suction slot extending in a substantially transverse direction relative to said feeding direction, said suction slot having a waveform shape including a plurality of extrema that extend substantially along said feeding direction; and a plurality of guide rolls provided on said vacuum cleaner head adjacent to said suction slot, wherein each said guide roll is located adjacent extremum of said suction slot relative to said feeding direction, wherein each said guide roll is rotatably supported about an axis perpendicular to said feeding direction so as to maintain rolling contact with each workpiece and to hold each workpiece spaced apart from said suction slot of said vacuum cleaner head by a predetermined distance.

2. A cleaning apparatus according to claim 1, further comprising a lubricant coating device disposed downstream of said tacky rolls and including a plurality of nozzles arranged in a row that intersects said feeding direction, at least one of said plurality of nozzles being supplied with a lubricating oil for applying said lubricating oil to at least a portion of said each workpiece.

3. A cleaning apparatus according to claim 1, further comprising an air blow for applying compressed air to the workpiece, at a position adjacent to said suction slot.

4. A cleaning apparatus according to claim 1, wherein said tacky rolls are freely rotatable about respective axes which are perpendicular to said feeding direction of the workpieces, and are rotated in rolling contact with the workpieces by a feeding movement of the workpieces, said cleaning apparatus further comprising:

speed detecting means for detecting a rotating speed of said tacky rolls while said tacky rolls are in rolling contact with the workpiece and for generating a corresponding roll speed signal; and means, operatively connected to said speed detecting means, for detecting an amount of foreign matter adhered to said tacky rolls on the basis of the roll speed signal of the tacky rolls generated by said speed detecting means.

5. A cleaning apparatus according to claim 1, further comprising:

drive means for driving said tacky rolls;

a monitoring roll rotated in rolling contact with said tacky rolls;

speed detecting means for detecting a rotating speed of said monitoring roll and for generating a corresponding monitoring roll speed signal; and means, operatively connected to said speed detecting means, for detecting an amount of foreign matter adhered to said tacky rolls on the basis of the monitoring roll speed signal generated by said speed detecting means.

6. A cleaning apparatus according to claim 1, wherein said feeding device includes a drive motor for feeding the workpieces, said cleaning apparatus further comprising torque detecting means for detecting a load torque of said drive motor, and means, operatively connected to said torque detecting means, for detecting an amount of foreign matter adhered to said tacky rolls according to the load torque detected by said torque detecting means.

7. A cleaning apparatus according to claim 1, further comprising:

a roll drive motor for rotating said tacky rolls to feed the workpieces at a constant speed through a tacky roll device which includes said tacky rolls;

torque detecting means for detecting a load torque of said roll drive motor;

timing means operatively connected to said torque detecting means for timing a passage time of each workpiece through said tacky roll device according to the load torque detected by said torque detecting means; and means, operatively connected to said timing means, for detecting an amount of foreign matter adhered to said tacky rolls on the basis of the passage time determined by said timing means.

8. A cleaning apparatus according to claim 1, further comprising a roll cleaning device including:

drive means for driving said tacky rolls;

a cleaning pad disposed movably between an operating position in which said cleaning pad contacts said tacky rolls for cleaning said tacky rolls, and a non-operating position in which said cleaning pad is spaced away from said tacky rolls; and liquid supply means for supplying a cleaning liquid to said cleaning pad, wherein when said cleaning pad is placed in said operating position, said tacky rolls are cleaned by said cleaning pad in pressing rolling contact with said tacky rolls while said tacky rolls are rotated by said drive means and while said cleaning liquid is supplied to said cleaning pad by said liquid supply means.

9. A cleaning apparatus according to claim 1, wherein a plurality of tacky roll devices, each including said tacky rolls, are disposed downstream of said de-oiling rolls relative to said feeding direction, each said tacky roll device being movable between an operating position in which said tacky rolls are positioned adjacent to said feed path of the workpieces, and a non-operating position in which said tacky rolls are spaced apart from said feed path.

10. A cleaning apparatus for cleaning sheet-shaped workpieces having upper and lower surfaces that are contaminated with oily contaminants and other foreign matter, said cleaning apparatus comprising:

a feeding device for sequentially feeding workpieces through a feed path in a feeding direction;

de-oiling rolls rotatably disposed in an upstream portion of said feed path relative to said feeding direction, and rotated in pressing rolling contact with upper and lower surfaces of each said sequentially fed workpiece to absorptively remove oily contaminants from the upper and lower surfaces of each workpiece;

tacky rolls disposed downstream of said de-oiling rolls relative to said feeding direction, and rotated in pressing rolling contact with the upper and lower surfaces of said each sequentially fed workpiece to remove foreign matter other than the oily contaminants from the upper and lower surfaces of each workpiece; and a vacuum cleaning device disposed between said de-oiling rolls and said tacky rolls relative to said feeding direction for removing foreign matter from each workpiece, said vacuum cleaning device including a cleaner head having a suction slot through which the foreign matter from said workpiece is suctioned under vacuum, and guide rolls provided on said cleaner head and disposed adjacent to said suction slot for contacting each workpiece so as to hold said each workpiece apart from said suction slot of said cleaner head.

* * * * *